US010465267B2

(12) United States Patent
Cheney et al.

(10) Patent No.: US 10,465,267 B2
(45) Date of Patent: Nov. 5, 2019

(54) HARDFACING ALLOYS RESISTANT TO HOT TEARING AND CRACKING

(71) Applicant: Scoperta, Inc., San Diego, CA (US)

(72) Inventors: Justin Lee Cheney, Encinitas, CA (US); John Hamilton Madok, San Diego, CA (US); Jonathon Bracci, Carlsbad, CA (US)

(73) Assignee: Scoperta, Inc., San Diego, CA (US)

( * ) Notice: Subject to any disclaimer, the term of this patent is extended or adjusted under 35 U.S.C. 154(b) by 306 days.

(21) Appl. No.: 14/807,169

(22) Filed: Jul. 23, 2015

(65) Prior Publication Data

US 2016/0024621 A1 Jan. 28, 2016

Related U.S. Application Data

(60) Provisional application No. 62/028,703, filed on Jul. 24, 2014.

(51) Int. Cl.

| | |
|---|---|
| ***C22C 38/02*** | (2006.01) |
| ***C22C 32/00*** | (2006.01) |
| ***B05D 1/36*** | (2006.01) |
| ***B05D 5/00*** | (2006.01) |
| ***C22C 38/04*** | (2006.01) |

(Continued)

(52) U.S. Cl.

CPC ..... *C22C 32/0052* (2013.01); *B05D 1/36* (2013.01); *B05D 5/00* (2013.01); *B22F 7/06* (2013.01); *C22C 33/0257* (2013.01); *C22C 38/02* (2013.01); *C22C 38/04* (2013.01); *C22C 38/12* (2013.01); *C22C 38/14* (2013.01); *C22C 38/22* (2013.01); *C22C 38/28* (2013.01)

(58) Field of Classification Search

CPC ..... C22C 32/0052; C22C 38/28; C22C 38/22; C22C 38/04; C22C 38/02; B05D 5/00; B05D 2/36

See application file for complete search history.

(56) References Cited

U.S. PATENT DOCUMENTS

| | | | |
|---|---|---|---|
| 2,043,952 | A | 6/1936 | Ffield |
| 2,156,306 | A | 5/1939 | Rapatz |

(Continued)

FOREIGN PATENT DOCUMENTS

| | | |
|---|---|---|
| CA | 2774546 | 1/2015 |
| CN | 102233490 A | 11/2011 |

(Continued)

OTHER PUBLICATIONS

Audouard, et al.: "Corrosion Performance and Field Experience With Super Duplex and Super Austenitic Stainless Steels in FGD Systems", Corrosion 2000; p. 4, table 2.

(Continued)

*Primary Examiner* — Veronica F Faison

(74) *Attorney, Agent, or Firm* — Knobbe Martens Olson and Bear, LLP

(57) ABSTRACT

Disclosed herein are embodiments of hardfacing alloys which can be resistant to hot tearing and cracking. In doing so, the hardfacing alloys can meet certain thermodynamic, microstructural, and performance criteria. For example, embodiments of the alloy have a martensitic matrix embedded with isolated carbides and/or borides. Further, in some embodiments the hardfacing alloys can also have high levels of macro-hardness.

23 Claims, 6 Drawing Sheets

(51) Int. Cl.

| | |
|---|---|
| ***C22C 38/12*** | (2006.01) |
| ***C22C 38/14*** | (2006.01) |
| ***C22C 38/22*** | (2006.01) |
| ***C22C 38/28*** | (2006.01) |
| ***B22F 7/06*** | (2006.01) |
| ***C22C 33/02*** | (2006.01) |

(56) References Cited

U.S. PATENT DOCUMENTS 2,936,229 A 5/1960 Shepard
3,024,137 A 3/1962 Witherell
3,113,021 A 12/1963 Witherell
3,181,970 A 5/1965 Witherell et al.
3,303,063 A 2/1967 Pietryka et al.
3,448,241 A 6/1969 Buckingham et al.
3,554,792 A 1/1971 Johnson
3,650,734 A 3/1972 Kantor et al.
3,819,364 A * 6/1974 Frehn ..... B23K 35/308 148/421
3,843,359 A 10/1974 Fiene et al.
3,859,060 A 1/1975 Eiselstein et al.
3,942,954 A 3/1976 Frehn
3,975,612 A 8/1976 Nakazaki et al.
4,010,309 A 3/1977 Peterson
4,017,339 A 4/1977 Okuda et al.
4,042,383 A 8/1977 Petersen et al.
4,066,451 A 1/1978 Rudy
4,110,514 A * 8/1978 Nicholson ..... B23K 35/308 420/10
4,214,145 A 7/1980 Zvanut et al.
4,255,709 A 3/1981 Zatsepium et al.
4,297,135 A 10/1981 Giessen et al.
4,365,994 A 12/1982 Ray
4,415,530 A 11/1983 Hunt
4,576,653 A 3/1986 Ray
4,606,977 A 8/1986 Dickson et al.
4,639,576 A 1/1987 Shoemaker et al.
4,762,681 A 8/1988 Tassen et al.
4,803,045 A 2/1989 Ohriner et al.
4,806,394 A * 2/1989 Steine ..... C23C 4/06 427/376.3
4,822,415 A 4/1989 Dorfman et al.
4,943,488 A * 7/1990 Sung ..... B22F 7/06 125/30.01
4,981,644 A 1/1991 Chang
5,306,358 A 4/1994 Lai et al.
5,375,759 A 12/1994 Hiraishi et al.
5,567,251 A 10/1996 Peker et al.
5,618,451 A 4/1997 Ni
5,820,939 A 10/1998 Popoola et al.
5,861,605 A 1/1999 Ogawa et al.
5,935,350 A 8/1999 Raghu et al.
5,942,289 A 8/1999 Jackson
5,988,302 A 11/1999 Sreshta et al.
6,210,635 B1 4/2001 Jackson et al.
6,232,000 B1 5/2001 Singh et al.
6,332,936 B1 12/2001 Hajaligo et al.
6,375,895 B1 4/2002 Daemen
6,398,103 B2 6/2002 Hasz et al.
6,441,334 B1 8/2002 Aida et al.
6,608,286 B2 8/2003 Jiang
6,669,790 B1 12/2003 Gundlach et al.
6,689,234 B2 2/2004 Branagan
6,702,906 B2 3/2004 Ogawa et al.
6,750,430 B2 6/2004 Kelly
7,052,561 B2 5/2006 Lu et al.
7,285,151 B2 10/2007 Sjodin et al.
7,361,411 B2 4/2008 Daemen et al.
7,491,910 B2 2/2009 Kapoor et al.
7,553,382 B2 6/2009 Branagan et al.
7,569,286 B2 8/2009 Daemen et al.
7,776,451 B2 8/2010 Jiang et al.
7,935,198 B2 5/2011 Branagan et al.
8,070,894 B2 12/2011 Branagan
8,097,095 B2 1/2012 Branagan
8,153,935 B2 4/2012 Jang et al.
8,187,529 B2 5/2012 Powell
8,187,725 B2 5/2012 Kiser et al.
8,562,759 B2 10/2013 Cheney et al.
8,562,760 B2 10/2013 Cheney et al.
8,640,941 B2 2/2014 Cheney
8,647,449 B2 2/2014 Cheney et al.
8,669,491 B2 * 3/2014 Menon ..... B23K 35/0261 219/145.22
8,704,134 B2 4/2014 Branagan et al.
8,801,872 B2 8/2014 Wright et al.
8,808,471 B2 8/2014 Wright et al.
8,973,806 B2 3/2015 Cheney
9,193,011 B2 11/2015 Mars et al.
2001/0019781 A1 9/2001 Hasz
2002/0148533 A1 10/2002 Kim et al.
2004/0062677 A1 4/2004 Chabenat et al.
2004/0079742 A1 4/2004 Kelly
2004/0115086 A1 6/2004 Chabenat et al.
2005/0109431 A1 5/2005 Kernan et al.
2006/0191606 A1 8/2006 Ogawa et al.
2007/0029295 A1 2/2007 Branagan
2007/0090167 A1 4/2007 Arjakine et al.
2007/0187369 A1 8/2007 Menon et al.
2007/0253856 A1 11/2007 Vecchio et al.
2007/0284018 A1 12/2007 Hamano et al.
2008/0001115 A1 1/2008 Qiao et al.
2008/0031769 A1 2/2008 Yeh
2008/0149397 A1 6/2008 Branagan
2008/0241580 A1 10/2008 Kiser et al.
2009/0017328 A1 1/2009 Katoh et al.
2009/0258250 A1 10/2009 Daemen et al.
2009/0285715 A1 11/2009 Arjakine et al.
2010/0009089 A1 1/2010 Junod et al.
2010/0044348 A1 2/2010 Buchmann
2010/0101780 A1 * 4/2010 Ballew ..... B23K 35/0261 166/242.6
2010/0166594 A1 7/2010 Hirata et al.
2010/0189588 A1 7/2010 Kawatsu et al.
2010/0258217 A1 10/2010 Kuehmann
2011/0064963 A1 3/2011 Cheney et al.
2011/0100720 A1 5/2011 Branagan et al.
2011/0121056 A1 * 5/2011 Cheney ..... B23K 35/3053 228/101
2011/0139761 A1 6/2011 Sugahara et al.
2011/0162612 A1 7/2011 Qiao et al.
2011/0171485 A1 7/2011 Kawamoto et al.
2012/0055903 A1 3/2012 Izutani et al.
2012/0156020 A1 6/2012 Kottilingam et al.
2012/0160363 A1 6/2012 Jin et al.
2012/0224992 A1 * 9/2012 Cheney ..... B23K 35/3053 420/114
2012/0288400 A1 11/2012 Hirata et al.
2013/0094900 A1 * 4/2013 Folkmann ..... B23K 9/173 403/343
2013/0167965 A1 4/2013 Cheney et al.
2013/0224516 A1 8/2013 Kusinski et al.
2013/0260177 A1 10/2013 Wallin et al.
2013/0266798 A1 10/2013 Cheney
2013/0266820 A1 * 10/2013 Kusinski ..... C22C 38/04 428/682
2013/0294962 A1 11/2013 Wallin et al.
2014/0065316 A1 3/2014 Cheney
2014/0105780 A1 4/2014 Cheney
2014/0131338 A1 5/2014 Postle
2014/0219859 A1 8/2014 Cheney
2014/0234154 A1 * 8/2014 Cheney ..... C22C 38/46 420/101
2014/0248509 A1 9/2014 Cheney
2014/0263248 A1 9/2014 Postle
2015/0075681 A1 3/2015 Wright et al.
2015/0147591 A1 5/2015 Cheney
2015/0252631 A1 9/2015 Miller
2015/0275341 A1 * 10/2015 Cheney ..... B23K 35/308 420/12
2015/0284817 A1 10/2015 Snyder et al.
2015/0284829 A1 10/2015 Cheney

(56) References Cited

U.S. PATENT DOCUMENTS

| | | | | |
|---|---|---|---|---|
| 2015/0307968 | A1 | 10/2015 | Mars et al. | |
| 2015/0328680 | A1* | 11/2015 | Tuffile | B22D 19/00 164/131 |
| 2015/0367454 | A1 | 12/2015 | Cheney | |
| 2016/0017463 | A1* | 1/2016 | Cheney | C22C 32/001 428/553 |
| 2016/0024624 | A1* | 1/2016 | Cheney | C22C 32/0052 420/100 |
| 2017/0022588 | A1* | 1/2017 | Tang | B22D 13/04 |

FOREIGN PATENT DOCUMENTS

| | | | |
|---|---|---|---|
| CN | 102686762 | | 3/2014 |
| CN | 103635284 | | 3/2014 |
| CN | 104039483 | | 9/2014 |
| CN | 104838032 | | 8/2015 |
| DE | 2754437 | | 7/1979 |
| DE | 33 20 513 | | 12/1983 |
| EP | 0 365 884 | | 5/1990 |
| EP | 1 338 663 | | 8/2003 |
| EP | 2 305 415 | | 8/2003 |
| EP | 2 778 247 | | 9/2014 |
| EP | 2 563 942 | | 10/2015 |
| GB | 2 153 846 | A | 8/1985 |
| IN | MUMNP-2003-00842 | | 4/2005 |
| JP | 58-132393 | | 8/1983 |
| JP | 60-133996 | A | 7/1985 |
| JP | 63-026205 | A | 2/1988 |
| JP | 03-133593 | A | 6/1991 |
| WO | WO 1984/000385 | | 2/1984 |
| WO | WO 1984/004760 | | 12/1984 |
| WO | WO 2006/086350 | | 8/2006 |
| WO | WO 2011/035193 | | 9/2010 |
| WO | WO 2011/071054 | | 6/2011 |
| WO | WO 2011/158706 | | 12/2011 |
| WO | WO/2012/037339 | | 3/2012 |
| WO | WO/2012/129505 | | 9/2012 |
| WO | WO 2013/101561 | | 7/2013 |
| WO | WO/2013/133944 | | 9/2013 |
| WO | WO 2014/059177 | | 4/2014 |
| WO | WO 2014/081491 | | 5/2014 |
| WO | WO 2014/114714 | | 7/2014 |
| WO | WO 2014/114715 | | 7/2014 |
| WO | WO 2014/127062 | | 8/2014 |
| WO | WO 2015/081209 | | 6/2015 |
| WO | WO 2015/157169 | | 10/2015 |
| WO | WO 2015/183955 | | 12/2015 |
| WO | WO 2015/191458 | | 12/2015 |
| ZA | 2013/02311 | | 12/2013 |

OTHER PUBLICATIONS

Branagan, et al.: Developing extreme hardness (>15GPa) in iron based nanocomosites, Composites Part A: Applied Science and Manufacturing, Elsevier Science Publishers B.V., Amsterdam, NL, vol. 33, No. 6, Jun. 1, 2002, pp. 855-859.

Cheney, et al.: "Development of quaternary Fe-based bulk metallic glasses," Materials Science and Engineering, vol. 492, No. 1-2, Sep. 25, 2008, pp. 230-235.

Cheney: Modeling the Glass Forming Ability of Metals. A Dissertation submitted in partial satisfaction of the Requirements for the degree of Doctor of Philosophy. University of California, San Diego. Dec. 2007.

Cr—C Phase Diagram [online], [retrieved on Jan. 27, 2015]. Retrieved from the Internet: http://www.azom.com/work/3ud2quvLOU9g4VBMjVEh_files/image002.gif.

Davis, Jr, ed. Stainless steels. ASM International, 1994; p. 447. http://www.crct.polymtl.ca/fact/documentation/BINARY/C-Nb.jpg>.

Iron-Carbon (Fe—C) Phase diagram [online], [retrieved on Jan. 27, 2014]. Retrieved from the internet: <URL:http://www.calphad.com/iron-carbon.html>.

Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.

Miracle, D.B.: The efficient cluster packing model—An atomic structural model for metallic glasses, Acta Materialia vol. 54, Issue 16, Sep. 2006, pp. 4317-4336.

Mo—C Phase Diagram [online], [retrieved on Jan. 27, 2015]. Retrieved from the Internet: <URL: http:www.crct.polymtl.ca/fact/documentation/BINARY/C-Mo.jpg.

Nb—C Phase Diagram [online], [retrieved on Jan. 27, 2015]. Retrieved from the Internet: <URL: http:www.crct.polymtl.ca/fact/documentation/BINARY/C-Nb.jpg.

Tillack, et al.: "Selection of Nickel, Nickel-Copper, Nickel-Cromium, and Nickel-Chromium-Iron Allows", ASM Handbook, Welding, Brazing and Soldering, vol. 6, Dec. 1, 1993 (Dec. 1, 1993) pp. 586-592, XP008097120, p. 589.

Titanium-Boron (TiB) Phase Diagram [online], [retrieved on Jan. 27, 2015]. Retrieved from the internet:<URL:http://www.calphad.com/titaniumboron.html>.

Yoo et al.: "The effect of boron on the wear behavior of iron-based hardfacing alloys for nuclear power plants valves," Journal of Nuclear Materials 352 (2006) 90-96.

International Search Report and Written Opinion for Int'l. App. No. PCT/US15/41827 dated Oct. 23, 2015.

* cited by examiner

HARDFACING ALLOYS RESISTANT TO HOT TEARING AND CRACKING

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

Field

The disclosure generally relates to hardfacing materials which can be deposited onto a substrate without generating cracks of any kind.

Description of the Related Art

Hardfacing alloys generally refer to a class of materials which are deposited onto a substrate for the purpose of producing a hard layer resistant to various wear mechanisms: abrasion, impact, erosion, gouging, etc. In some applications it can be advantageous for the hardfacing layer to be deposited without the presence of any cracks.

It is particularly difficult to develop alloys which are highly resistant to stress cracking as well as highly resistant to hot tearing. It is known by those skilled in the art that eutectic carbide and/or boride formation increases the tendency to stress crack, but lack of eutectic carbides or borides increases the tendency to hot tear. An example of an alloy which is highly resistant to stress cracking is shown in FIG. 1. However, this alloy has a tendency to hot tear when welded as multiple layers in application where the weld is cooled. This type of welding procedure is commonly used in oil and gas applications where hardfacing layers are deposited onto drill pipe, but the pipe must be cooled to protect an interior plastic lining. It is further desirable to deposit the hardfacing layer without cracking in the weld, as it is known by those skilled in the art that such cracks can penetrate into the substrate and cause component failure. Thus, there is a need to develop alloys which can function within these performance and deposition constraints.

SUMMARY

Embodiments of the present application include but are not limited to hardfacing materials, alloy or powder compositions used to make such hardfacing materials, methods of forming the hardfacing materials, and the components or substrates incorporating or protected by these hardfacing materials.

Disclosed herein are embodiments of a work piece having at least a portion of its surface covered by a layer comprising a microstructure which contains below 5 volume % grain boundary carbides, and contains at least 5% Ti, Nb carbides and/or complex carbides comprising one or more of Nb, Ti, and V, wherein the layer and/or the feedstock welding material used to form the layer comprises a macro-hardness of at least 50 HRC, and wherein the layer and/or the feedstock welding material used to form the layer comprises Fe and in weight percent Nb:+Ti: 2.5 to 3.5 and C: 0.75 to 1.2.

In some embodiments, the layer and/or the feedstock welding material can further comprise, in weight percent, Cr: up to 10.5, Mn: up to 1.5, Mo: up to 1.5, Ni: up to 0.75, Si: up to 1, V: up to 1, and W: up to 1.

In some embodiments, the layer and/or the feedstock welding material can comprise a mixture of one or more of the following, in weight %: Fe: BAL, C: about 1.2%, Cr: about 6%, and Ti: about 2.9%; Fe: BAL, C: about 1.2%, Cr: about 7.8%, Mn: about 1.4%, Mo: about 1.2%, Si: about 1%, and Ti: about 3.4%; Fe: BAL, C: about 1.15%, Cr: about 7.8%, Mn: about 1.4%, Mo: about 1.2%, Si: about 1%, and Ti: about 3.4%; Fe: BAL, C: about 1.1%, Cr: about 7.8%, Mn: about 1.4%, Mo: about 1.2%, Si: about 1%, and Ti: about 3.4%; Fe: BAL, C: about 1%, Cr: about 7.8%, Mn: about 1.4%, Mo: about 1.2%, Si: about 1%, and Ti: about 3.4%; Fe: BAL, C: about 0.9%, Cr: about 7.8%, Mn: about 1.4%, Mo: about 1.2%, Si: about 1%, Ti: about 3.4%; Fe: BAL, C: about 0.85%, Cr: about 7.2%, Mn: about 1.3%, Mo: about 1%, Si: about 0.8%, Ti: about 3%; and Fe: BAL, C: about 0.7%, Cr: about 7.8%, Mn: about 1.4%, Mo: about 1.2%, Si: about 0.8%, and Ti: about 3.4%.

In some embodiments, the layer can comprise high abrasion resistance as defined by an ASTM G65A mass loss of less than 1 gram.

In some embodiments, additional layers can be deposited over existing layers of a similar chemistry, the top layer comprising a microstructure which contains below 10 volume % grain boundary carbides, and contains at least 2% isolated primary carbides, and the top layer configured to be deposited onto a substrate which is chilled during the welding process such that the substrate temperature remains at 500° F. or below without forming cracks in the top layer itself or any of the underlying layers, wherein the top layer comprises a macrohardness of at least 45HRC.

In some embodiments, at least 3 additional layers can be deposited over an existing layer of a similar chemistry, the top layer comprising a microstructure which contains below 10 volume % grain boundary carbides, and contains at least 2% isolated primary carbides, the top layer configured to be deposited onto a substrate which is chilled during the welding process without forming cracks in the top layer itself or any of the underlying layers, wherein the top layer comprises a macrohardness of at least 45HRC.

Also disclosed herein are embodiments of a method of forming a coated work piece comprising depositing a layer on at least a portion of a work piece, wherein the layer comprises a microstructure which contains below 10 volume % grain boundary carbides, and contains at least 2% isolated primary carbides, wherein the layer can be deposited onto a substrate which is chilled during the welding process without forming cracks, wherein the layer comprises a macrohardness of at least 45HRC, and wherein the layer is deposited using a welding feedstock comprising Fe and, in weight percent, Nb:+Ti: 2.5 to 3.5 and C: 0.75 to 1.2.

In some embodiments, the welding feedstock can further comprise, in weight percent, Cr: up to 10.5, Mn: up to 1.5, Mo: up to 1.5, Ni: up to 0.75, Si: up to 1, V: up to 1, and W: up to 1.

In some embodiments, the layer can comprise a mixture of one or more of the following, in weight %: Fe: BAL, C: about 1.2%, Cr: about 6%, and Ti: about 2.9%; Fe: BAL, C: about 1.2%, Cr: about 7.8%, Mn: about 1.4%, Mo: about 1.2%, Si: about 1%, and Ti: about 3.4%; Fe: BAL, C: about 1.15%, Cr: about 7.8%, Mn: about 1.4%, Mo: about 1.2%, Si: about 1%, and Ti: about 3.4%; Fe: BAL, C: about 1.1%, Cr: about 7.8%, Mn: about 1.4%, Mo: about 1.2%, Si: about 1%, and Ti: about 3.4%; Fe: BAL, C: about 1%, Cr: about 7.8%, Mn: about 1.4%, Mo: about 1.2%, Si: about 1%, and Ti: about 3.4%; Fe: BAL, C: about 0.9%, Cr: about 7.8%, Mn: about 1.4%, Mo: about 1.2%, Si: about 1%, Ti: about 3.4%; Fe: BAL, C: about 0.85%, Cr: about 7.2%, Mn: about 1.3%, Mo: about 1%, Si: about 0.8%, Ti: about 3%; and Fe: BAL, C: about 0.7%, Cr: about 7.8%, Mn: about 1.4%, Mo: about 1.2%, Si: about 0.8%, and Ti: about 3.4%.

In some embodiments, the method can further comprise depositing additional layers over existing layers of a similar chemistry, the top layer comprising a microstructure which contains below 10 volume % grain boundary carbides, and contains at least 2% isolated primary carbides, the top layer configured to be deposited onto a substrate which is chilled during the welding process such that the substrate temperature remains at 500° F. or below without forming cracks in the top layer itself or any of the underlying layers, and wherein the top layer comprises a macrohardness of at least 45HRC.

In some embodiments, the method can further comprise depositing at least 3 additional layers over an existing layer of a similar chemistry, the top layer comprising a microstructure which contains below 10 volume % grain boundary carbides, and contains at least 2% isolated primary carbides, the top layer configured to be deposited onto a substrate which is chilled during the welding process such that the substrate temperature remains at 500° F. or below without forming cracks in the top layer itself or any of the underlying layers, and wherein the top layer comprises a macrohardness of at least 45HRC.

Also disclosed herein are embodiments of a method of forming a coated work piece comprising depositing a layer on at least a portion of a surface of a work piece, wherein the layer comprises a macro-hardness of 45 HRC or greater, wherein the layer comprises at least 2% mole fraction Nb and/or Ti carbides which are thermodynamically stable at temperatures at least 10K above the solidification temperature of a Fe-based matrix in the alloy, wherein the microstructure comprises less than 5% mole fraction carbides which are only thermodynamically stable below the liquid temperature of the iron matrix phase, wherein the layer and/or feedstock material used to form the layer comprises Fe and, in weight percent, Nb:+Ti: 2.5 to 3.5, and C: 0.75 to 1.2.

In some embodiments, the layer can further comprise, in weight percent, Cr: up to 10.5, Mn: up to 1.5, Mo: up to 1.5, Ni: up to 0.75, Si: up to 1, V: up to 1, and W: up to 1.

In some embodiments, the layer can comprise a mixture of one or more of the following, in weight %: Fe: BAL, C: about 1.2%, Cr: about 7.8%, Mn: about 1.4%, Mo: about 1.2%, Si: about 1%, and Ti: about 3.4%; Fe: BAL, C: about 1.1%, Cr: about 7.8%, Mn: about 1.4%, Mo: about 1.2%, Si: about 1%, and Ti: about 3.4%; Fe: BAL, C: about 1%, Cr: about 7.8%, Mn: about 1.4%, Mo: about 1.2%, Si: about 1%, and Ti: about 3.4%; Fe: BAL, C: about 1.2%, Cr: about 6%, and Ti: about 2.9%; Fe: BAL, C: about 0.9%, Cr: about 7.8%, Mn: about 1.4%, Mo: about 1.2%, Si: about 1%, Ti: about 3.4%, and V: about 0.1%; and Fe: BAL, C: about 0.85%, Cr: about 7.2%, Mn: about 1.3%, Mo: about 1%, Si: about 0.8%, Ti: about 3%, and V: about 0.1%.

In some embodiments, the layer can comprise high abrasion resistance as defined by an ASTM G65A mass loss of less than 1 gram.

In some embodiments, the method can further comprise depositing additional layers over existing layers of a similar chemistry, wherein the top layer is configured to be deposited onto a substrate which is chilled during the welding process without forming cracks in the top layer itself or any of the underlying layers.

In some embodiments, the method can further comprise depositing additional layers over an existing layer of a similar chemistry, wherein the top layer is configured to be deposited onto a substrate which is chilled during the welding process such that the substrate temperature remains at 500° F. or below without forming cracks in the top layer itself or any of the underlying layers.

Also disclosed herein are embodiments of a hardfacing layer comprising a microstructure which contains below 5 volume % grain boundary carbides, and contains at least 5% Ti and/or Nb carbides, wherein the layer and/or the feedstock welding material used to form the layer comprises a macro-hardness of at least 50 HRC, and wherein the layer and/or the feedstock welding material comprises Fe and, in weight percent, Nb:+Ti: 2.5 to 3.5, and C: 0.75 to 1.2.

Disclosed herein are embodiments of a hardfacing layer comprising a microstructure which contains below 5 volume % grain boundary carbides, and contains at least 5 volume % Ti and/or Nb carbides, wherein the hardfacing layer and/or a feedstock welding material used to form the hardfacing layer comprises a macro-hardness of at least 50 HRC, and wherein the hardfacing layer and/or the feedstock welding material comprises Fe and in weight percent Nb+Ti: 2.5 to 3.5 and C: 0.75 to 1.2.

In some embodiments, the hardfacing layer and/or the feedstock welding material can comprise, in weight percent, Nb+Ti+V: 2.5 to 3.5. In some embodiments, the hardfacing layer can comprise high abrasion resistance as defined by an ASTM G65A mass loss of less than 1 gram, at least 50% martensite, a melt range of 60K or below, below 5 mole % grain boundary carbides, and at least 5 mole % Ti and/or Nb carbides.

Also disclosed herein are embodiments of a work piece having at least a portion of its surface covered by a substrate layer comprising a microstructure which contains below 5 volume % grain boundary carbides, and contains at least 5 volume % Ti and/or Nb carbides, wherein the substrate layer and/or a feedstock welding material used to form the substrate layer comprises a macro-hardness of at least 50 HRC, and wherein the substrate layer and/or a feedstock welding material comprises a melt range of 60K or below.

In some embodiments, the substrate layer and/or the feedstock welding material can comprise Fe and, in weight percent Nb+Ti: 2.5 to 3.5, and C: 0.75 to 1.2. The work piece of claim 4, wherein the substrate layer and/or the feedstock welding material can comprise Fe and, in weight percent, Nb+Ti+V: 2.5 to 3.5.

In some embodiments, the substrate layer and/or the feedstock welding material can comprise a mixture of one or more of the following compositions, in weight %:

- Fe: BAL, C: about 1.2%, Cr: about 6%, and Ti: about 2.9%;
- Fe: BAL, C: about 1.2%, Cr: about 7.8%, Mn: about 1.4%, Mo: about 1.2%, Si: about 1%, and Ti: about 3.4%;
- Fe: BAL, C: about 1.15%, Cr: about 7.8%, Mn: about 1.4%, Mo: about 1.2%, Si: about 1%, and Ti: about 3.4%;
- Fe: BAL, C: about 1.1%, Cr: about 7.8%, Mn: about 1.4%, Mo: about 1.2%, Si: about 1%, and Ti: about 3.4%;
- Fe: BAL, C: about 1%, Cr: about 7.8%, Mn: about 1.4%, Mo: about 1.2%, Si: about 1%, and Ti: about 3.4%;
- Fe: BAL, C: about 0.9%, Cr: about 7.8%, Mn: about 1.4%, Mo: about 1.2%, Si: about 1%, Ti: about 3.4%;
- Fe: BAL, C: about 0.85%, Cr: about 7.2%, Mn: about 1.3%, Mo: about 1%, Si: about 0.8%, Ti: about 3%; and
- Fe: BAL, C: about 0.7%, Cr: about 7.8%, Mn: about 1.4%, Mo: about 1.2%, Si: about 0.8%, and Ti: about 3.4%.

In some embodiments, the substrate layer can comprise high abrasion resistance as defined by an ASTM G65A mass loss of less than 1 gram, at least 50% martensite, below 5 mole % grain boundary carbides, and at least 5 mole % Ti and/or Nb carbides.

In some embodiments, the work piece can further comprise a top layer formed over the substrate layer, the top layer having approximately the same chemistry as the substrate layer and comprising a microstructure which contains below 10 volume % grain boundary carbides, and contains at least 2% isolated primary carbides, and a macrohardness of at least 45HRC, wherein the top layer is configured to be deposited onto the work piece over the substrate layer, wherein the work piece and substrate layer remain at 500° F. or below during deposition without forming cracks in the top layer or the substrate layer.

In some embodiments, the work piece can further comprise a middle and top layer formed over the substrate layer, the middle and top layer having approximately the same chemistry as the substrate layer, wherein the top layer comprises a microstructure which contains below 10 volume % grain boundary carbides, and contains at least 2 volume % isolated primary carbides, the top layer comprises a macrohardness of at least 45HRC, and the top layer is configured to be deposited onto the work piece over the middle layer, wherein the work piece, substrate layer, and middle layer remain at 500° F. or below during deposition without forming cracks in the top layer, middle layer, or substrate layer.

Also disclosed herein are embodiments of a method of forming a coated work piece comprising depositing a first layer on at least a portion of a work piece, wherein the first layer comprises a microstructure which contains below 10 volume % grain boundary carbides, and contains at least 2 volume % isolated primary carbides, wherein the first layer is configured to be deposited onto the work piece which is chilled during the welding process without forming cracks, wherein the first layer comprises a macrohardness of at least 45HRC, and wherein the first layer has a melt range of 60K or below.

In some embodiments, the first layer can be deposited using a welding feedstock comprising Fe and in weight percent Nb+Ti: 2.5 to 3.5 and C: 0.75 to 1.2.

In some embodiments, the welding feedstock can comprise a mixture of one or more of the following compositions, in weight %:

- Fe: BAL, C: about 1.2%, Cr: about 6%, and Ti: about 2.9%;
- Fe: BAL, C: about 1.2%, Cr: about 7.8%, Mn: about 1.4%, Mo: about 1.2%, Si: about 1%, and Ti: about 3.4%;
- Fe: BAL, C: about 1.15%, Cr: about 7.8%, Mn: about 1.4%, Mo: about 1.2%, Si: about 1%, and Ti: about 3.4%;
- Fe: BAL, C: about 1.1%, Cr: about 7.8%, Mn: about 1.4%, Mo: about 1.2%, Si: about 1%, and Ti: about 3.4%;
- Fe: BAL, C: about 1%, Cr: about 7.8%, Mn: about 1.4%, Mo: about 1.2%, Si: about 1%, and Ti: about 3.4%;
- Fe: BAL, C: about 0.9%, Cr: about 7.8%, Mn: about 1.4%, Mo: about 1.2%, Si: about 1%, Ti: about 3.4%;
- Fe: BAL, C: about 0.85%, Cr: about 7.2%, Mn: about 1.3%, Mo: about 1%, Si: about 0.8%, Ti: about 3%; and
- Fe: BAL, C: about 0.7%, Cr: about 7.8%, Mn: about 1.4%, Mo: about 1.2%, Si: about 0.8%, and Ti: about 3.4%.

In some embodiments, the method can further comprise depositing a second layer over the first layer, the first and second layers having approximately the same chemistry, wherein the second layer comprises a microstructure which contains below 10 volume % grain boundary carbides, and contains at least 2 volume % isolated primary carbides, the second layer configured to be deposited onto the work piece over the first layer, wherein the work piece and first layer temperature remain at 500° F. or below during deposition without forming cracks in the second layer or the first layer, and wherein the second layer comprises a macrohardness of at least 45HRC.

In some embodiments, the method can further comprise depositing a second layer over the first layer and a third layer of the second layer, the first, second, and third layers having approximately the same chemistry, wherein the third layer comprises a microstructure which contains below 10 volume % grain boundary carbides, and contains at least 2 volume % isolated primary carbides, the third layer configured to be deposited onto the work piece over the second layer, wherein the work piece, first layer, and second layer temperatures remain at 500° F. or below during deposition without forming cracks in the first, second, or third layer, and wherein the second layer comprises a macrohardness of at least 45HRC.

In some embodiments, the work piece layer can comprise high abrasion resistance as defined by an ASTM G65A mass loss of less than 1 gram, at least 50% martensite, below 5 mole % grain boundary carbides, and at least 5 mole % Ti and/or Nb carbides. In some embodiments, the welding feedstock can comprise Fe and, in weight percent, Nb+Ti+V: 2.5 to 3.5. In some embodiments, the microstructure can comprise at least 2% mole fraction Nb and/or Ti carbides which are thermodynamically stable at temperatures at least 10K above the solidification temperature of a Fe-based matrix in the microstructure. In some embodiments, the microstructure can comprise less than 5% mole fraction carbides which are only thermodynamically stable below a liquid temperature of an iron matrix phase of the microstructure.

DETAILED DESCRIPTION

Figure 1:
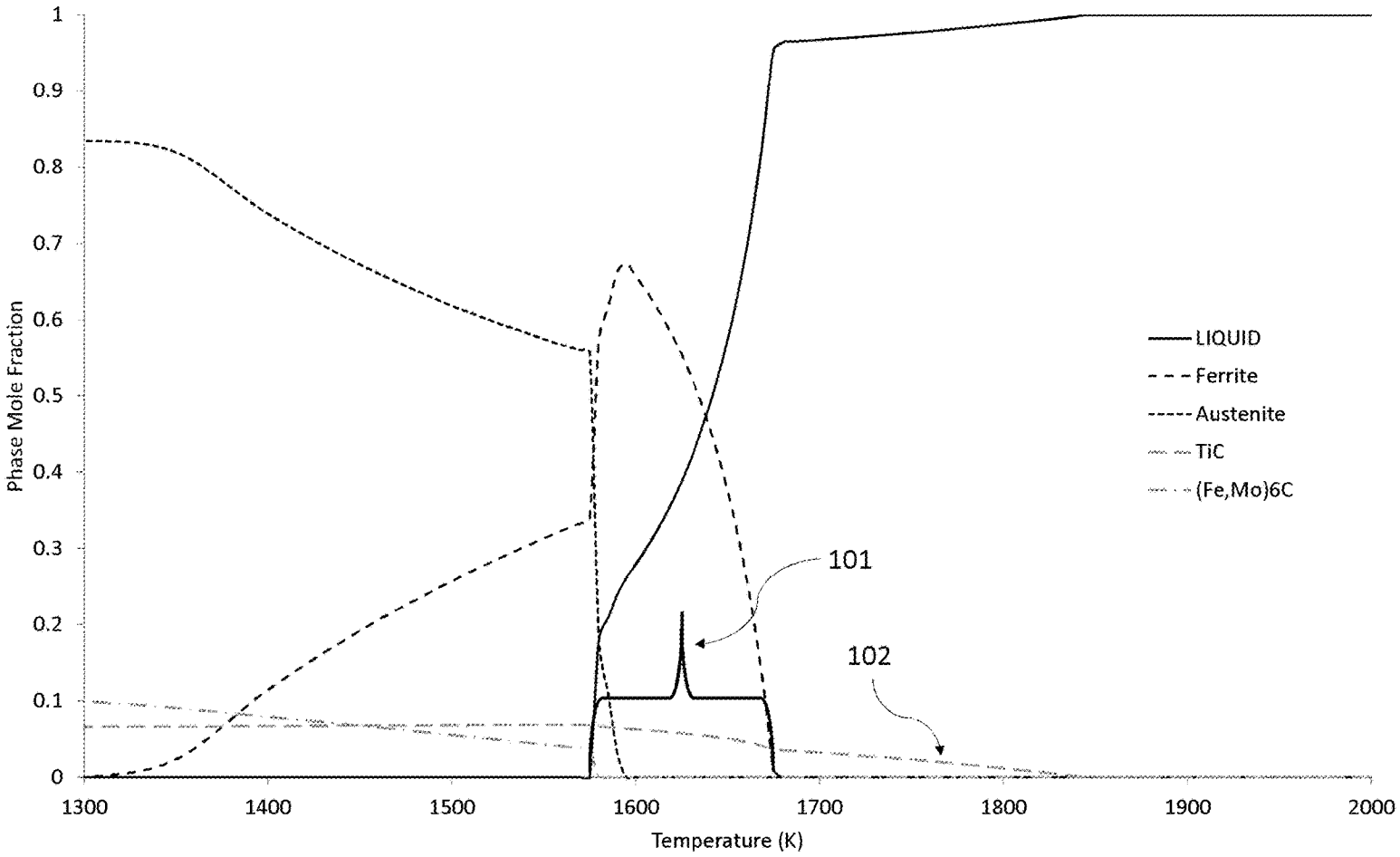
FIG. 1 shows a solidification profile for $Fe_{bal}C_{1.4}Cr_{7.8}Mn_{1.4}Mo_{1.2}Si_{0.8}Ti_{3.3}$, Alloy X3, $2^{nd}$ layer chemistry in a 30% dilution model.

In some embodiments, computational metallurgy can be used to identify alloy compositions which simultaneously contain compositional, thermodynamic, and microstructural aspects which make them resistant to stress cracking and hot tearing. For example, in some embodiments, a group of alloys is disclosed which can possesses a martensitic matrix embedded with isolated carbides and/or borides. In some embodiments, the disclosed alloys can be deposited onto a substrate without the formation of stress cracks or hot tears under a variety of welding environments which will be further described.

As disclosed herein, the term alloy can refer to the chemical composition forming the powder disclosed within, the powder itself, and the composition of the metal component formed by the heating and/or deposition of the powder.

Metal Alloy Composition

In some embodiments, an alloy can be described by the metal alloy compositions which produce the thermodynamic, microstructural, and performance criteria discussed in detail below.

In some embodiments, the alloy can be described by a composition in weight percent comprising the following elemental ranges, which have been experimentally produced and demonstrate the performance characteristics of this disclosure. In some embodiments, the composition can comprise the following elements, in wt. %:

Fe: Bal

Nb+Ti: 2.5 to 3.5 (or about 2.5 to about 3.5)

C: 0.75 to 6 (or about 0.75 to about 6)

In some embodiments, the composition can comprise the following elements, in wt. %:

Fe: Bal

Nb+Ti+V: 2.5 to 3.5 (or about 2.5 to about 3.5)

C: 0.75 to 6 (or about 0.75 to about 6)

In some embodiments, the composition can comprise C: 0.75 to 1.2 (or about 0.75 to about 1.2).

In some embodiments, the composition can comprise Nb+Ti: 1 to 33.5 (or about 1 to about 33.5). In some embodiments, the composition can comprise Nb+Ti+V: 1 to 33.5 (or about 1 to about 33.5). Having high levels of Nb, Ti, V, and combinations thereof can be advantageous to form carbides that are small, isolated square-shaped particles. These particles are extremely hard, but do not significantly, if at all, lower crack resistance of the material.

In some embodiments, the composition can further comprise the following elements, in wt. %:

Cr: up to 10.5 (or up to about 10.5)

Mn: up to 1.5 (or up to about 1.5)

Mo: up to 1.5 (or up to about 1.5)

Ni: up to 0.75 (or up to about 0.75)

Si: up to 1 (or up to about 1)

W: up to 1 (or up to about 1)

In some embodiments, the composition can further comprise, in wt. %: V: up to 1 (or up to about 1).

In some embodiments, the alloys can be described by specific compositions which have been produced in the form of welding wire and experimentally demonstrated to meet the microstructural and performance criteria described in this disclosure:

1. Fe: BAL, C: 1.2%, Cr: 6%, and Ti: 2.9% (or Fe: BAL, C: about 1.2%, Cr: about 6%, and Ti: about 2.9%)
2. Fe: BAL, C: 1.2%, Cr: 7.8%, Mn: 1.4%, Mo: 1.2%, Si: 1%, and Ti: 3.4% (or Fe: BAL, C: about 1.2%, Cr: about 7.8%, Mn: about 1.4%, Mo: about 1.2%, Si: about 1%, and Ti: about 3.4%)
3. Fe: BAL, C: 1.15%, Cr: 7.8%, Mn: 1.4%, Mo: 1.2%, Si: 0.8%, and Ti: 3.4% (or about Fe: BAL, C: about 1.15%, Cr: about 7.8%, Mn: about 1.4%, Mo: about 1.2%, Si: about 0.8%, and Ti: about 3.4%)
4. Fe: BAL, C: 1.1%, Cr: 7.8%, Mn: 1.4%, Mo: 1.2%, Si: 1%, and Ti: 3.4% (or Fe: BAL, C: about 1.1%, Cr: about 7.8%, Mn: about 1.4%, Mo: about 1.2%, Si: about 1%, and Ti: about 3.4%)
5. Fe: BAL, C: 1%, Cr: 7.8%, Mn: 1.4%, Mo: 1.2%, Si: 1%, and Ti: 3.4% (or Fe: BAL, C: about 1%, Cr: about 7.8%, Mn: about 1.4%, Mo: about 1.2%, Si: about 1%, and Ti: about 3.4%)
6. Fe: BAL, C: 0.85%, Cr: 7.8%, Mn: 1.4%, Mo: 1.2%, Si: 0.8%, and Ti: 3.4% (or Fe: BAL, C: about 0.85%, Cr: about 7.8%, Mn: about 1.4%, Mo: about 1.2%, Si: about 0.8%, and Ti: about 3.4%)
7. Fe: BAL, C: 0.7%, Cr: 7.8%, Mn: 1.4%, Mo: 1.2%, Si: 0.8%, and Ti: 3.4% (or Fe: BAL, C: about 0.7%, Cr: about 7.8%, Mn: about 1.4%, Mo: about 1.2%, Si: about 0.8%, and Ti: about 3.4%)

Table 1 shows a list of compositions that can have resistance to hot tearing and stress cracking.

TABLE 1

List of alloy compositions manufactured into welding wire which demonstrate resistance to hot tearing and stress cracking

| Alloy | C | Cr | Mn | Mo | Si | Ti |
|---|---|---|---|---|---|---|
| 1 | 1.2 | 6 | | | | 2.9 |
| 2 | 1.2 | 7.8 | 1.4 | 1.2 | 1 | 3.4 |
| 3 | 1.15 | 7.8 | 1.4 | 1.2 | 1 | 3.4 |
| 4 | 1.1 | 7.8 | 1.4 | 1.2 | 1 | 3.4 |
| 5 | 1 | 7.8 | 1.4 | 1.2 | 1 | 3.4 |
| 6 | 0.85 | 7.8 | 1.4 | 1.2 | 1 | 3.4 |
| 7 | 0.7 | 7.8 | 1.4 | 1.2 | 1 | 3.4 |

Table 2 shows compositions of experimental wires produced for this study (X1-X3) and commercially available hardbanding alloys (C1-C2).

TABLE 2

List of test alloys used to determine thermodynamics of hot tear formation

| Alloy | C | Cr | Mn | Mo | Nb | Si | Ti |
|---|---|---|---|---|---|---|---|
| X1 | 1.2 | 6.8 | 1.2 | 1.0 | 0.0 | 0.5 | 2.8 |
| X2 | 0.9 | 6.8 | 1.2 | 1.0 | 0.0 | 0.5 | 2.8 |
| X3 | 1.4 | 7.8 | 1.4 | 1.2 | 0.0 | 0.8 | 3.3 |
| C1 | 1.5 | 8.2 | 1.1 | 0.0 | 5.7 | 1.0 | 0.0 |
| C2 | 1.9 | 8.0 | 1.3 | 1.1 | 0.0 | 1.2 | 5.2 |

In some embodiments the alloy can be described by the compositional range encompassing alloys which have been calculated to meet the thermodynamic criteria discussed below. This range is at least partially based on the alloys presented in Table 3. In this embodiment the alloy can comprise in weight percent, the balance comprising Fe:

Al: 0 to 5 (or about 0 to about 5)

B: 0 to 5 (or about 0 to about 5)

C: 0 to 6 (or about 0 to about 6)

Cr: 0 to 19.5 (or about 0 to about 19.5)

Cu: 0 to 2 (or about 0 to about 2)

Mn: 0 to 10 (or about 0 to about 10)

Mo: 0 to 30 (or about 0 to about 30)

Nb: 0 to 28.5 (or about 0 to about 28.5)

Ni: 0 to 17.5 (or about 0 to about 17.5)

Si: 0 to 4 (or about 0 to about 4)

Ti: 0 to 12 (or about 0 to about 12)

V: 0 to 10 (or about 0 to about 10)

W: 0 to 30 (or about 0 to about 30)

The below Table 3 lists alloys with compositions that can meet the below disclosed thermodynamic criteria. In the table, 1) Nb+Ti+V; 2) GB Hard; 3) Isolated Hard; 4) Melt Range.

TABLE 3

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 0.50 | 0.50 | 0.00 | 0.75 | 0.50 | 2.00 | 0.00 | 0.50 | 0.00 | 0.50 | 0.00 | 1.75 | 0.0% | 2.6% | 55 |
| 0.00 | 0.00 | 0.50 | 0.50 | 0.00 | 0.75 | 0.50 | 0.00 | 0.00 | 0.50 | 1.00 | 0.50 | 0.00 | 1.75 | 0.0% | 2.9% | 60 |
| 0.00 | 0.00 | 0.40 | 19.30 | 0.72 | 1.16 | 6.27 | 3.09 | 17.37 | 0.97 | 0.00 | 0.00 | 0.00 | 7.831 | 0.0% | 3.4% | 60 |
| 0.00 | 0.00 | 0.95 | 6.26 | 0.00 | 1.04 | 0.76 | 0.00 | 0.00 | 0.72 | 1.25 | 0.00 | 0.00 | 2.75 | 0.0% | 3.4% | 70 |
| 0.00 | 0.50 | 2.50 | 0.00 | 0.00 | 1.16 | 0.74 | 8.00 | 0.00 | 0.76 | 8.00 | 0.00 | 0.00 | 4.4 | 0.0% | 3.5% | 20 |
| 0.00 | 0.50 | 2.50 | 0.00 | 0.00 | 1.16 | 0.74 | 9.00 | 0.00 | 0.76 | 8.00 | 0.00 | 0.00 | 4.4 | 0.0% | 3.5% | 15 |
| 0.00 | 0.50 | 0.50 | 0.50 | 0.00 | 0.75 | 0.50 | 0.00 | 0.00 | 0.50 | 4.00 | 0.50 | 0.00 | 1.75 | 6.1% | 3.7% | 10 |
| 0.00 | 0.50 | 0.50 | 0.50 | 0.00 | 0.75 | 0.50 | 2.00 | 0.00 | 0.50 | 4.00 | 0.50 | 0.00 | 1.75 | 7.4% | 3.7% | 60 |
| 0.00 | 0.50 | 0.50 | 0.50 | 0.00 | 0.75 | 0.50 | 3.00 | 0.00 | 0.50 | 4.00 | 0.50 | 0.00 | 1.75 | 7.0% | 3.7% | 60 |
| 0.00 | 0.50 | 0.00 | 0.50 | 0.00 | 0.75 | 0.50 | 0.00 | 0.00 | 0.50 | 3.00 | 0.50 | 0.00 | 1.25 | 0.0% | 3.8% | 60 |
| 0.00 | 0.50 | 0.00 | 0.50 | 0.00 | 0.75 | 0.50 | 0.00 | 0.00 | 0.50 | 2.00 | 0.50 | 0.00 | 1.25 | 0.0% | 3.8% | 30 |
| 0.00 | 0.50 | 0.00 | 0.50 | 0.00 | 0.75 | 0.50 | 1.00 | 0.00 | 0.50 | 2.00 | 0.50 | 0.00 | 1.25 | 0.0% | 3.8% | 55 |
| 0.00 | 0.50 | 0.00 | 0.50 | 0.00 | 0.75 | 0.50 | 2.00 | 0.00 | 0.50 | 2.00 | 0.50 | 0.00 | 1.25 | 0.0% | 3.8% | 75 |
| 0.00 | 0.50 | 0.00 | 0.50 | 0.00 | 0.75 | 0.50 | 3.00 | 0.00 | 0.50 | 4.00 | 0.50 | 0.00 | 1.25 | 0.0% | 3.8% | 75 |
| 0.00 | 0.50 | 0.00 | 0.50 | 0.00 | 0.75 | 0.50 | 3.00 | 0.00 | 0.50 | 3.00 | 0.50 | 0.00 | 1.25 | 0.0% | 3.8% | 75 |
| 0.00 | 0.50 | 0.00 | 0.50 | 0.00 | 0.75 | 0.50 | 3.00 | 0.00 | 0.50 | 2.00 | 0.50 | 0.00 | 1.25 | 0.0% | 3.8% | 65 |
| 0.00 | 0.50 | 0.00 | 0.50 | 0.00 | 0.75 | 0.50 | 4.00 | 0.00 | 0.50 | 4.00 | 0.50 | 0.00 | 1.25 | 0.0% | 3.8% | 65 |
| 0.00 | 0.50 | 0.00 | 0.50 | 0.00 | 0.75 | 0.50 | 4.00 | 0.00 | 0.50 | 3.00 | 0.50 | 0.00 | 1.25 | 0.0% | 3.8% | 65 |
| 0.00 | 0.50 | 0.00 | 0.50 | 0.00 | 0.75 | 0.50 | 4.00 | 0.00 | 0.50 | 2.00 | 0.50 | 0.00 | 1.25 | 0.0% | 3.8% | 55 |
| 0.00 | 0.50 | 0.00 | 0.50 | 0.00 | 0.75 | 0.50 | 5.00 | 0.00 | 0.50 | 4.00 | 0.50 | 0.00 | 1.25 | 0.0% | 3.8% | 55 |
| 0.00 | 0.50 | 0.00 | 0.50 | 0.00 | 0.75 | 0.50 | 5.00 | 0.00 | 0.50 | 3.00 | 0.50 | 0.00 | 1.25 | 0.0% | 3.8% | 55 |
| 0.00 | 0.50 | 0.00 | 0.50 | 0.00 | 0.75 | 0.50 | 5.00 | 0.00 | 0.50 | 2.00 | 0.50 | 0.00 | 1.25 | 8.0% | 3.8% | 45 |
| 0.00 | 0.50 | 0.00 | 5.04 | 0.00 | 1.16 | 0.74 | 10.00 | 0.00 | 0.76 | 3.00 | 0.00 | 0.00 | 1.9 | 0.0% | 3.9% | 50 |
| 0.00 | 0.00 | 0.95 | 6.26 | 0.00 | 1.04 | 0.76 | 0.00 | 0.00 | 0.72 | 1.50 | 0.00 | 0.00 | 2.75 | 0.0% | 4.0% | 65 |
| 0.00 | 0.00 | 0.50 | 19.13 | 0.72 | 1.15 | 6.22 | 3.87 | 17.21 | 0.96 | 0.00 | 0.00 | 0.00 | 7.8637 | 0.0% | 4.3% | 60 |
| 0.00 | 0.00 | 0.50 | 5.04 | 0.00 | 1.16 | 0.74 | 0.00 | 0.00 | 0.76 | 2.00 | 0.00 | 0.00 | 2.4 | 0.0% | 4.4% | 50 |
| 0.00 | 0.00 | 0.95 | 6.26 | 0.00 | 1.04 | 0.76 | 0.00 | 0.00 | 0.72 | 1.75 | 0.00 | 0.00 | 2.75 | 0.0% | 4.6% | 60 |
| 0.00 | 0.00 | 1.13 | 7.86 | 0.00 | 1.11 | 0.91 | 0.00 | 0.00 | 0.86 | 1.75 | 0.00 | 0.00 | 3.15 | 1.4% | 4.8% | 75 |
| 0.00 | 0.00 | 1.07 | 5.04 | 0.00 | 1.16 | 0.74 | 4.00 | 0.00 | 0.76 | 0.00 | 0.00 | 0.00 | 2.97 | 0.0% | 4.8% | 55 |
| 0.00 | 0.00 | 0.67 | 4.58 | 0.00 | 1.08 | 0.67 | 0.00 | 0.00 | 0.24 | 2.10 | 0.00 | 0.00 | 2.42 | 0.0% | 4.8% | 50 |
| 0.00 | 0.00 | 1.07 | 5.04 | 0.00 | 1.16 | 0.74 | 0.00 | 0.00 | 0.76 | 2.00 | 0.00 | 0.00 | 2.97 | 0.0% | 4.9% | 70 |
| 0.00 | 0.00 | 1.00 | 5.04 | 0.00 | 1.16 | 0.74 | 4.00 | 0.00 | 0.76 | 0.00 | 0.00 | 0.00 | 2.9 | 0.0% | 4.9% | 50 |
| 0.00 | 0.00 | 0.50 | 0.00 | 0.00 | 1.16 | 0.00 | 0.00 | 0.00 | 0.76 | 3.00 | 0.50 | 0.00 | 1.66 | 0.0% | 4.9% | 50 |
| 0.00 | 0.00 | 0.50 | 0.00 | 0.00 | 1.16 | 0.74 | 0.00 | 0.00 | 0.76 | 3.00 | 0.50 | 0.00 | 2.4 | 0.0% | 4.9% | 50 |
| 0.00 | 0.00 | 0.50 | 5.04 | 0.00 | 1.16 | 0.74 | 0.00 | 0.00 | 0.76 | 3.00 | 0.00 | 0.00 | 2.4 | 0.0% | 4.9% | 50 |
| 0.00 | 0.00 | 0.50 | 0.00 | 0.00 | 1.16 | 2.00 | 0.00 | 0.00 | 0.76 | 3.00 | 0.50 | 0.00 | 3.66 | 0.0% | 4.9% | 50 |
| 0.00 | 0.00 | 0.50 | 5.04 | 0.00 | 1.16 | 0.74 | 2.00 | 0.00 | 0.76 | 2.00 | 0.00 | 0.00 | 2.4 | 0.0% | 5.0% | 50 |
| 0.00 | 0.00 | 1.10 | 5.04 | 0.00 | 1.16 | 0.74 | 4.00 | 0.00 | 0.76 | 0.00 | 0.00 | 0.00 | 3 | 0.0% | 5.0% | 60 |
| 0.00 | 0.00 | 0.50 | 0.00 | 0.00 | 1.16 | 0.74 | 0.00 | 0.00 | 0.76 | 3.00 | 0.50 | 2.00 | 2.4 | 0.0% | 5.0% | 50 |
| 0.00 | 0.00 | 1.20 | 5.04 | 0.00 | 1.16 | 0.74 | 4.00 | 0.00 | 0.76 | 0.00 | 0.00 | 0.00 | 3.1 | 0.0% | 5.0% | 75 |
| 0.00 | 0.00 | 0.50 | 5.04 | 0.00 | 1.16 | 0.74 | 10.00 | 0.00 | 0.76 | 0.00 | 0.00 | 0.00 | 2.4 | 0.0% | 5.0% | 50 |
| 0.00 | 0.00 | 0.50 | 0.00 | 0.00 | 1.16 | 0.74 | 0.00 | 0.00 | 0.76 | 3.00 | 0.50 | 4.00 | 2.4 | 0.0% | 5.1% | 50 |
| 0.00 | 0.00 | 0.50 | 5.04 | 0.00 | 1.16 | 0.74 | 10.00 | 0.00 | 0.76 | 2.00 | 0.00 | 0.00 | 2.4 | 0.0% | 5.1% | 50 |
| 0.00 | 0.00 | 0.50 | 0.00 | 0.00 | 1.16 | 10.00 | 0.00 | 0.00 | 0.76 | 3.00 | 0.50 | 0.00 | 11.66 | 0.0% | 5.1% | 50 |
| 0.00 | 0.00 | 0.95 | 6.26 | 0.00 | 1.04 | 0.76 | 0.00 | 0.00 | 0.72 | 2.00 | 0.00 | 0.00 | 2.75 | 0.0% | 5.1% | 50 |
| 0.00 | 0.00 | 0.50 | 0.00 | 0.00 | 1.16 | 0.74 | 0.00 | 0.00 | 0.76 | 3.00 | 0.50 | 6.00 | 2.4 | 0.0% | 5.1% | 50 |
| 0.00 | 0.00 | 0.50 | 5.04 | 0.00 | 1.16 | 0.74 | 10.00 | 0.00 | 0.76 | 6.00 | 0.00 | 0.00 | 2.4 | 0.0% | 5.2% | 50 |
| 0.00 | 0.00 | 0.50 | 0.00 | 0.00 | 1.16 | 12.00 | 0.00 | 0.00 | 0.76 | 3.00 | 0.50 | 0.00 | 13.66 | 0.0% | 5.2% | 50 |
| 0.00 | 0.00 | 0.50 | 0.00 | 0.00 | 1.16 | 0.74 | 0.00 | 0.00 | 0.76 | 3.00 | 0.50 | 8.00 | 2.4 | 0.0% | 5.2% | 50 |
| 0.00 | 0.00 | 0.50 | 0.00 | 0.00 | 1.16 | 0.74 | 6.00 | 0.00 | 0.76 | 3.00 | 0.50 | 6.00 | 2.4 | 0.0% | 5.3% | 50 |
| 0.00 | 0.00 | 0.50 | 0.00 | 0.00 | 1.16 | 0.74 | 0.00 | 0.00 | 0.76 | 3.00 | 0.50 | 10.00 | 2.4 | 3.2% | 5.3% | 50 |
| 0.00 | 0.00 | 0.50 | 0.00 | 0.00 | 1.16 | 0.74 | 6.00 | 0.00 | 0.76 | 3.00 | 0.50 | 8.00 | 2.4 | 0.0% | 5.3% | 50 |
| 0.00 | 0.00 | 0.50 | 0.00 | 0.00 | 1.16 | 22.00 | 0.00 | 0.00 | 0.76 | 3.00 | 0.50 | 0.00 | 23.66 | 0.0% | 5.4% | 50 |
| 0.00 | 0.00 | 0.50 | 0.00 | 0.00 | 1.16 | 16.00 | 6.00 | 0.00 | 0.76 | 3.00 | 0.50 | 0.00 | 17.66 | 0.0% | 5.4% | 50 |
| 0.00 | 0.00 | 0.50 | 0.00 | 0.00 | 1.16 | 24.00 | 0.00 | 0.00 | 0.76 | 3.00 | 0.50 | 0.00 | 25.66 | 0.0% | 5.4% | 50 |
| 0.00 | 0.00 | 0.50 | 0.00 | 0.00 | 1.16 | 18.00 | 6.00 | 0.00 | 0.76 | 3.00 | 0.50 | 0.00 | 19.66 | 0.0% | 5.4% | 50 |
| 0.00 | 0.00 | 0.50 | 0.00 | 0.00 | 1.16 | 0.74 | 6.00 | 0.00 | 0.76 | 3.00 | 0.50 | 10.00 | 2.4 | 0.0% | 5.4% | 50 |
| 0.00 | 0.00 | 1.13 | 7.86 | 0.00 | 1.11 | 0.91 | 0.00 | 0.00 | 0.86 | 2.00 | 0.00 | 0.00 | 3.15 | 0.6% | 5.4% | 70 |
| 0.00 | 0.00 | 0.50 | 0.00 | 0.00 | 1.16 | 20.00 | 6.00 | 0.00 | 0.76 | 3.00 | 0.50 | 0.00 | 21.66 | 0.0% | 5.4% | 50 |
| 0.00 | 0.00 | 0.50 | 0.00 | 0.00 | 1.16 | 0.74 | 6.00 | 0.00 | 0.76 | 3.00 | 0.50 | 12.00 | 2.4 | 0.0% | 5.5% | 50 |
| 0.00 | 0.00 | 0.50 | 0.00 | 0.00 | 1.16 | 0.74 | 6.00 | 0.00 | 0.76 | 3.00 | 0.50 | 14.00 | 2.4 | 0.0% | 5.6% | 50 |
| 0.00 | 0.00 | 0.50 | 0.00 | 0.00 | 1.16 | 0.74 | 6.00 | 0.00 | 0.76 | 3.00 | 0.50 | 16.00 | 2.4 | 0.0% | 5.6% | 50 |
| 0.00 | 0.00 | 0.50 | 0.00 | 0.00 | 1.16 | 0.74 | 6.00 | 0.00 | 0.76 | 3.00 | 0.50 | 18.00 | 2.4 | 0.0% | 5.7% | 50 |
| 0.00 | 0.00 | 0.80 | 5.04 | 0.00 | 1.16 | 0.74 | 3.00 | 0.00 | 0.76 | 1.00 | 0.00 | 0.00 | 2.7 | 0.0% | 5.8% | 50 |
| 0.00 | 0.00 | 0.50 | 0.00 | 0.00 | 1.16 | 0.74 | 6.00 | 0.00 | 0.76 | 3.00 | 0.50 | 20.00 | 2.4 | 0.0% | 5.8% | 50 |
| 0.00 | 0.00 | 1.13 | 7.86 | 0.00 | 1.11 | 0.91 | 0.00 | 0.00 | 0.86 | 2.25 | 0.00 | 0.00 | 3.15 | 0.0% | 6.1% | 65 |
| 0.00 | 0.00 | 1.00 | 0.50 | 0.00 | 0.75 | 0.50 | 3.00 | 0.00 | 0.50 | 1.00 | 0.50 | 0.00 | 2.25 | 0.0% | 6.3% | 60 |
| 0.00 | 0.00 | 1.00 | 0.50 | 0.00 | 0.75 | 0.50 | 1.00 | 0.00 | 0.50 | 2.00 | 0.50 | 0.00 | 2.25 | 0.0% | 6.4% | 60 |
| 0.00 | 0.00 | 1.00 | 0.50 | 0.00 | 0.75 | 0.50 | 5.00 | 0.00 | 0.50 | 0.00 | 0.50 | 0.00 | 2.25 | 0.0% | 6.5% | 50 |
| 0.00 | 0.00 | 0.70 | 5.00 | 0.00 | 1.16 | 1.00 | 0.00 | 0.00 | 0.76 | 3.00 | 0.50 | 0.00 | 2.86 | 0.0% | 6.6% | 50 |
| 0.00 | 0.00 | 1.13 | 7.86 | 0.00 | 1.11 | 0.91 | 0.00 | 0.00 | 0.86 | 2.50 | 0.00 | 0.00 | 3.15 | 0.0% | 6.6% | 60 |
| 0.00 | 0.00 | 0.80 | 5.04 | 0.00 | 1.16 | 0.74 | 0.00 | 0.00 | 0.76 | 3.00 | 0.00 | 0.00 | 2.7 | 0.0% | 6.7% | 50 |
| 0.00 | 0.00 | 0.80 | 5.04 | 0.00 | 1.16 | 0.74 | 2.00 | 0.00 | 0.76 | 2.00 | 0.00 | 0.00 | 2.7 | 0.0% | 6.7% | 50 |
| 0.00 | 0.00 | 0.80 | 5.04 | 0.00 | 1.16 | 0.74 | 4.00 | 0.00 | 0.76 | 1.00 | 0.00 | 0.00 | 2.7 | 0.0% | 6.8% | 50 |
| 0.00 | 0.00 | 1.07 | 5.04 | 0.00 | 1.16 | 0.74 | 2.00 | 0.00 | 0.76 | 2.00 | 0.00 | 0.00 | 2.97 | 0.0% | 6.8% | 40 |
| 0.00 | 0.00 | 6.00 | 0.00 | 0.00 | 1.16 | 0.74 | 0.00 | 0.00 | 0.76 | 3.00 | 0.50 | 0.00 | 7.9 | 9.5% | 6.8% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 1.18 | 15.00 | 0.00 | 1.10 | 1.00 | 0.00 | 0.00 | 0.90 | 2.80 | 0.00 | 0.00 | 3.28 | 3.9% | 6.9% | 75 |
| 0.00 | 0.00 | 1.00 | 5.04 | 0.00 | 1.16 | 0.74 | 0.00 | 0.00 | 0.76 | 3.00 | 0.00 | 0.00 | 2.9 | 0.0% | 6.9% | 30 |
| 0.00 | 1.00 | 2.50 | 0.00 | 0.00 | 1.16 | 0.74 | 7.00 | 0.00 | 0.76 | 8.00 | 0.00 | 0.00 | 4.4 | 0.0% | 6.9% | 65 |
| 0.00 | 1.00 | 2.50 | 0.00 | 0.00 | 1.16 | 0.74 | 8.00 | 0.00 | 0.76 | 8.00 | 0.00 | 0.00 | 4.4 | 0.0% | 6.9% | 50 |
| 0.00 | 0.00 | 1.18 | 14.00 | 0.00 | 1.10 | 1.00 | 0.00 | 0.00 | 0.90 | 2.80 | 0.00 | 0.00 | 3.28 | 3.0% | 7.0% | 65 |
| 0.00 | 1.00 | 2.50 | 0.00 | 0.00 | 1.16 | 0.74 | 10.00 | 0.00 | 0.76 | 8.00 | 0.00 | 0.00 | 4.4 | 0.0% | 7.0% | 25 |
| 0.00 | 0.00 | 1.18 | 13.00 | 0.00 | 1.10 | 1.00 | 0.00 | 0.00 | 0.90 | 2.80 | 0.00 | 0.00 | 3.28 | 1.8% | 7.0% | 60 |
| 0.00 | 0.20 | 1.00 | 0.50 | 0.00 | 0.75 | 0.00 | 0.00 | 0.00 | 0.00 | 3.00 | 0.00 | 0.00 | 1.75 | 0.0% | 7.1% | 65 |
| 0.00 | 0.00 | 1.10 | 8.30 | 0.00 | 1.10 | 1.00 | 0.00 | 0.00 | 0.90 | 2.80 | 0.00 | 0.00 | 3.2 | 0.0% | 7.1% | 50 |
| 0.00 | 0.00 | 1.07 | 5.04 | 0.00 | 1.16 | 0.74 | 6.00 | 0.00 | 0.76 | 0.00 | 0.00 | 0.00 | 2.97 | 0.0% | 7.1% | 30 |
| 0.00 | 0.00 | 1.18 | 12.00 | 0.00 | 1.10 | 1.00 | 0.00 | 0.00 | 0.90 | 2.80 | 0.00 | 0.00 | 3.28 | 1.3% | 7.1% | 65 |
| 0.00 | 0.50 | 0.50 | 0.50 | 0.00 | 0.75 | 0.50 | 1.00 | 0.00 | 0.50 | 2.00 | 0.50 | 0.00 | 1.75 | 0.0% | 7.1% | 60 |
| 2.00 | 0.00 | 1.18 | 8.30 | 0.00 | 1.10 | 1.00 | 0.00 | 0.00 | 0.90 | 2.80 | 0.00 | 0.00 | 3.28 | 0.0% | 7.2% | 55 |
| 0.00 | 0.00 | 1.50 | 0.00 | 0.00 | 1.16 | 28.00 | 0.00 | 0.00 | 0.76 | 3.00 | 0.50 | 0.00 | 30.66 | 0.0% | 7.2% | 50 |
| 0.00 | 0.00 | 1.18 | 11.00 | 0.00 | 1.10 | 1.00 | 0.00 | 0.00 | 0.90 | 2.80 | 0.00 | 0.00 | 3.28 | 0.8% | 7.2% | 60 |
| 0.00 | 0.00 | 1.18 | 8.30 | 0.00 | 5.00 | 1.00 | 0.00 | 0.00 | 0.90 | 2.80 | 0.00 | 0.00 | 7.18 | 0.0% | 7.2% | 65 |
| 1.00 | 0.00 | 1.18 | 8.30 | 0.00 | 1.10 | 1.00 | 0.00 | 0.00 | 0.90 | 2.80 | 0.00 | 0.00 | 3.28 | 0.0% | 7.2% | 55 |
| 0.00 | 0.00 | 1.50 | 0.00 | 0.00 | 1.16 | 30.00 | 0.00 | 0.00 | 0.76 | 3.00 | 0.50 | 0.00 | 32.66 | 0.0% | 7.2% | 50 |
| 0.00 | 0.00 | 1.18 | 8.30 | 0.00 | 4.00 | 1.00 | 0.00 | 0.00 | 0.90 | 2.80 | 0.00 | 0.00 | 6.18 | 0.0% | 7.2% | 65 |
| 0.00 | 0.00 | 1.18 | 8.30 | 0.00 | 3.00 | 1.00 | 0.00 | 0.00 | 0.90 | 2.80 | 0.00 | 0.00 | 5.18 | 0.0% | 7.2% | 60 |
| 0.00 | 0.00 | 1.18 | 8.30 | 0.00 | 2.00 | 1.00 | 0.00 | 0.00 | 0.90 | 2.80 | 0.00 | 0.00 | 4.18 | 0.0% | 7.3% | 60 |
| 0.00 | 0.00 | 1.18 | 10.00 | 0.00 | 1.10 | 1.00 | 0.00 | 0.00 | 0.90 | 2.80 | 0.00 | 0.00 | 3.28 | 0.2% | 7.3% | 55 |
| 0.00 | 0.00 | 1.18 | 8.30 | 0.00 | 1.10 | 1.00 | 0.00 | 0.00 | 1.00 | 2.80 | 0.00 | 0.00 | 3.28 | 0.0% | 7.3% | 55 |
| 0.00 | 0.00 | 1.50 | 0.00 | 0.00 | 1.16 | 26.00 | 0.00 | 0.00 | 0.76 | 3.00 | 0.50 | 0.00 | 28.66 | 0.0% | 7.3% | 50 |
| 0.00 | 0.00 | 1.18 | 9.00 | 0.00 | 1.10 | 1.00 | 0.00 | 0.00 | 0.90 | 2.80 | 0.00 | 0.00 | 3.28 | 0.0% | 7.3% | 55 |
| 0.00 | 0.00 | 1.20 | 8.30 | 0.00 | 1.10 | 1.00 | 0.00 | 0.00 | 0.90 | 2.80 | 0.00 | 0.00 | 3.3 | 0.0% | 7.3% | 55 |
| 0.00 | 0.00 | 1.18 | 8.30 | 0.00 | 1.10 | 1.00 | 0.00 | 1.00 | 0.90 | 2.80 | 0.00 | 0.00 | 3.28 | 0.0% | 7.3% | 60 |
| 0.00 | 1.00 | 0.00 | 5.04 | 0.00 | 1.16 | 0.74 | 0.00 | 0.00 | 0.76 | 3.00 | 0.00 | 0.00 | 1.9 | 0.0% | 7.3% | 50 |
| 0.00 | 0.00 | 1.00 | 0.50 | 0.00 | 0.75 | 0.50 | 4.00 | 0.00 | 0.50 | 1.00 | 0.50 | 0.00 | 2.25 | 0.0% | 7.4% | 45 |
| 0.00 | 0.00 | 1.00 | 0.50 | 0.00 | 0.75 | 0.50 | 2.00 | 0.00 | 0.50 | 2.00 | 0.50 | 0.00 | 2.25 | 0.0% | 7.4% | 45 |
| 0.00 | 1.00 | 0.00 | 0.00 | 0.00 | 1.16 | 1.00 | 0.00 | 0.00 | 0.76 | 3.00 | 0.50 | 0.00 | 2.16 | 0.0% | 7.4% | 50 |
| 3.00 | 0.00 | 1.18 | 8.30 | 0.00 | 1.10 | 1.00 | 0.00 | 0.00 | 0.90 | 2.80 | 0.00 | 0.00 | 3.28 | 0.0% | 7.4% | 55 |
| 0.00 | 0.00 | 1.18 | 8.30 | 0.00 | 1.10 | 1.00 | 0.00 | 2.00 | 0.90 | 2.80 | 0.00 | 0.00 | 3.28 | 0.0% | 7.4% | 55 |
| 0.00 | 0.00 | 1.18 | 8.30 | 0.00 | 1.10 | 1.00 | 0.00 | 0.00 | 2.00 | 2.80 | 0.00 | 0.00 | 3.28 | 0.0% | 7.4% | 60 |
| 0.00 | 0.00 | 1.18 | 8.30 | 0.00 | 1.10 | 1.00 | 0.00 | 3.00 | 0.90 | 2.80 | 0.00 | 0.00 | 3.28 | 0.0% | 7.4% | 60 |
| 0.00 | 1.00 | 0.00 | 5.04 | 0.00 | 1.16 | 0.74 | 4.00 | 0.00 | 0.76 | 3.00 | 0.00 | 0.00 | 1.9 | 0.0% | 7.5% | 50 |
| 0.00 | 0.00 | 1.00 | 0.50 | 0.00 | 0.75 | 0.50 | 0.00 | 0.00 | 0.50 | 3.00 | 0.50 | 0.00 | 2.25 | 0.0% | 7.5% | 45 |
| 0.00 | 0.00 | 0.80 | 5.04 | 0.00 | 1.16 | 0.74 | 1.00 | 0.00 | 0.76 | 3.00 | 0.00 | 0.00 | 2.7 | 0.0% | 7.5% | 50 |
| 0.00 | 0.00 | 1.50 | 0.00 | 0.00 | 1.16 | 24.00 | 0.00 | 0.00 | 0.76 | 3.00 | 0.50 | 0.00 | 26.66 | 0.0% | 7.5% | 50 |
| 0.00 | 0.00 | 1.18 | 8.30 | 0.00 | 1.10 | 1.00 | 0.00 | 0.00 | 4.00 | 2.80 | 0.00 | 0.00 | 3.28 | 1.0% | 7.5% | 70 |
| 0.00 | 0.00 | 1.30 | 8.30 | 0.00 | 1.10 | 1.00 | 0.00 | 0.00 | 0.90 | 2.80 | 0.00 | 0.00 | 3.4 | 0.3% | 7.5% | 65 |
| 0.00 | 0.00 | 1.18 | 8.30 | 0.00 | 1.10 | 1.00 | 0.00 | 4.00 | 0.90 | 2.80 | 0.00 | 0.00 | 3.28 | 0.0% | 7.5% | 60 |
| 0.00 | 0.00 | 1.18 | 8.30 | 0.00 | 1.10 | 1.00 | 0.00 | 0.00 | 3.00 | 2.80 | 0.00 | 0.00 | 3.28 | 0.2% | 7.5% | 65 |
| 0.00 | 1.00 | 0.00 | 5.04 | 0.00 | 1.16 | 0.74 | 6.00 | 0.00 | 0.76 | 3.00 | 0.00 | 0.00 | 1.9 | 0.0% | 7.5% | 50 |
| 0.00 | 1.00 | 0.00 | 0.00 | 0.00 | 1.16 | 1.00 | 6.00 | 0.00 | 0.76 | 3.00 | 0.50 | 0.00 | 2.16 | 0.0% | 7.5% | 50 |
| 0.00 | 0.00 | 1.18 | 8.30 | 0.00 | 1.10 | 1.00 | 0.00 | 5.00 | 0.90 | 2.80 | 0.00 | 0.00 | 3.28 | 0.1% | 7.6% | 65 |
| 4.00 | 0.00 | 1.18 | 8.30 | 0.00 | 1.10 | 1.00 | 0.00 | 0.00 | 0.90 | 2.80 | 0.00 | 0.00 | 3.28 | 2.3% | 7.6% | 55 |
| 0.00 | 0.00 | 0.80 | 5.04 | 0.00 | 1.16 | 0.74 | 3.00 | 0.00 | 0.76 | 2.00 | 0.00 | 0.00 | 2.7 | 0.0% | 7.6% | 50 |
| 0.00 | 1.00 | 0.00 | 0.00 | 0.00 | 1.16 | 1.00 | 0.00 | 0.00 | 0.76 | 3.00 | 0.50 | 5.00 | 2.16 | 0.0% | 7.6% | 50 |
| 0.00 | 0.00 | 0.80 | 5.04 | 0.00 | 1.16 | 0.74 | 5.00 | 0.00 | 0.76 | 1.00 | 0.00 | 0.00 | 2.7 | 0.0% | 7.7% | 50 |
| 5.00 | 0.00 | 1.18 | 8.30 | 0.00 | 1.10 | 1.00 | 0.00 | 0.00 | 0.90 | 2.80 | 0.00 | 0.00 | 3.28 | 3.5% | 7.7% | 60 |
| 0.00 | 0.00 | 0.80 | 5.04 | 0.00 | 1.16 | 0.74 | 0.00 | 0.00 | 0.76 | 4.00 | 0.00 | 0.00 | 2.7 | 0.0% | 7.8% | 50 |
| 0.00 | 0.00 | 0.80 | 5.04 | 0.00 | 1.16 | 0.74 | 2.00 | 0.00 | 0.76 | 3.00 | 0.00 | 0.00 | 2.7 | 0.0% | 7.8% | 50 |
| 0.00 | 1.00 | 0.00 | 0.00 | 0.00 | 1.16 | 1.00 | 6.00 | 0.00 | 0.76 | 3.00 | 0.50 | 5.00 | 2.16 | 0.0% | 7.8% | 50 |
| 0.00 | 0.00 | 0.80 | 5.04 | 0.00 | 1.16 | 0.74 | 1.00 | 0.00 | 0.76 | 4.00 | 0.00 | 0.00 | 2.7 | 0.0% | 7.8% | 50 |
| 0.00 | 0.00 | 0.80 | 5.04 | 0.00 | 1.16 | 0.74 | 4.00 | 0.00 | 0.76 | 2.00 | 0.00 | 0.00 | 2.7 | 0.0% | 7.8% | 50 |
| 0.00 | 0.00 | 0.80 | 11.04 | 1.84 | 0.46 | 0.46 | 7.19 | 7.36 | 0.46 | 0.00 | 0.00 | 0.00 | 1.7202 | 0.0% | 7.9% | 60 |
| 0.00 | 0.00 | 0.80 | 5.04 | 0.00 | 1.16 | 0.74 | 3.00 | 0.00 | 0.76 | 3.00 | 0.00 | 0.00 | 2.7 | 0.0% | 7.9% | 50 |
| 0.00 | 0.00 | 1.00 | 0.00 | 0.00 | 1.16 | 0.74 | 3.00 | 0.00 | 0.76 | 2.00 | 0.00 | 0.00 | 2.9 | 0.0% | 7.9% | 50 |
| 0.00 | 1.00 | 0.00 | 0.00 | 0.00 | 1.16 | 1.00 | 0.00 | 0.00 | 0.76 | 3.00 | 0.50 | 10.00 | 2.16 | 0.0% | 7.9% | 50 |
| 0.00 | 0.00 | 1.00 | 5.04 | 0.00 | 1.16 | 0.74 | 1.00 | 0.00 | 0.76 | 3.00 | 0.00 | 0.00 | 2.9 | 0.0% | 7.9% | 50 |
| 0.00 | 0.00 | 1.00 | 5.04 | 0.00 | 1.16 | 0.74 | 3.00 | 0.00 | 0.76 | 2.00 | 0.00 | 0.00 | 2.9 | 0.0% | 7.9% | 50 |
| 0.00 | 0.50 | 0.50 | 0.50 | 0.00 | 0.75 | 0.50 | 2.00 | 0.00 | 0.50 | 2.00 | 0.50 | 0.00 | 1.75 | 0.0% | 8.0% | 35 |
| 0.00 | 0.00 | 1.00 | 0.00 | 0.00 | 1.16 | 0.74 | 5.00 | 0.00 | 0.76 | 1.00 | 0.00 | 0.00 | 2.9 | 0.0% | 8.0% | 50 |
| 0.00 | 1.00 | 0.00 | 0.00 | 0.00 | 1.16 | 1.00 | 4.00 | 0.00 | 0.76 | 3.00 | 0.50 | 10.00 | 2.16 | 0.0% | 8.0% | 50 |
| 0.00 | 0.00 | 0.80 | 0.00 | 0.00 | 1.16 | 0.74 | 6.00 | 0.00 | 0.76 | 9.00 | 0.00 | 0.00 | 2.7 | 0.0% | 8.0% | 50 |
| 0.00 | 0.00 | 1.00 | 5.04 | 0.00 | 1.16 | 0.74 | 5.00 | 0.00 | 0.76 | 1.00 | 0.00 | 0.00 | 2.9 | 0.0% | 8.0% | 50 |
| 0.00 | 0.00 | 0.80 | 0.00 | 0.00 | 1.16 | 0.74 | 7.00 | 0.00 | 0.76 | 10.00 | 0.00 | 0.00 | 2.7 | 0.0% | 8.1% | 50 |
| 0.00 | 0.00 | 0.80 | 0.00 | 0.00 | 1.16 | 0.74 | 7.00 | 0.00 | 0.76 | 9.00 | 0.00 | 0.00 | 2.7 | 0.0% | 8.1% | 50 |
| 0.00 | 0.00 | 0.80 | 0.00 | 0.00 | 1.16 | 0.74 | 7.00 | 0.00 | 0.76 | 8.00 | 0.00 | 0.00 | 2.7 | 0.0% | 8.1% | 50 |
| 0.00 | 0.00 | 0.80 | 0.00 | 0.00 | 1.16 | 0.74 | 8.00 | 0.00 | 0.76 | 10.00 | 0.00 | 0.00 | 2.7 | 0.0% | 8.1% | 50 |
| 0.00 | 1.00 | 0.00 | 0.00 | 0.00 | 1.16 | 1.00 | 6.00 | 0.00 | 0.76 | 3.00 | 0.50 | 10.00 | 2.16 | 0.0% | 8.1% | 50 |
| 0.00 | 0.00 | 0.80 | 0.00 | 0.00 | 1.16 | 0.74 | 8.00 | 0.00 | 0.76 | 9.00 | 0.00 | 0.00 | 2.7 | 0.0% | 8.1% | 50 |
| 0.00 | 0.00 | 0.80 | 0.00 | 0.00 | 1.16 | 0.74 | 8.00 | 0.00 | 0.76 | 8.00 | 0.00 | 0.00 | 2.7 | 0.0% | 8.1% | 50 |
| 0.00 | 0.00 | 0.80 | 0.00 | 0.00 | 1.16 | 0.74 | 9.00 | 0.00 | 0.76 | 10.00 | 0.00 | 0.00 | 2.7 | 0.0% | 8.1% | 50 |
| 0.00 | 0.00 | 0.80 | 0.00 | 0.00 | 1.16 | 0.74 | 9.00 | 0.00 | 0.76 | 9.00 | 0.00 | 0.00 | 2.7 | 0.0% | 8.1% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 0.80 | 0.00 | 0.00 | 1.16 | 0.74 | 9.00 | 0.00 | 0.76 | 7.00 | 0.00 | 0.00 | 2.7 | 0.0% | 8.1% | 50 |
| 0.00 | 0.00 | 0.80 | 0.00 | 0.00 | 1.16 | 0.74 | 9.00 | 0.00 | 0.76 | 8.00 | 0.00 | 0.00 | 2.7 | 0.0% | 8.1% | 50 |
| 0.00 | 0.00 | 0.80 | 0.00 | 0.00 | 1.16 | 0.74 | 10.00 | 0.00 | 0.76 | 10.00 | 0.00 | 0.00 | 2.7 | 0.0% | 8.2% | 50 |
| 0.00 | 0.00 | 0.80 | 0.00 | 0.00 | 1.16 | 0.74 | 10.00 | 0.00 | 0.76 | 9.00 | 0.00 | 0.00 | 2.7 | 0.0% | 8.2% | 50 |
| 0.00 | 0.00 | 0.80 | 0.00 | 0.00 | 1.16 | 0.74 | 10.00 | 0.00 | 0.76 | 7.00 | 0.00 | 0.00 | 2.7 | 0.0% | 8.2% | 50 |
| 0.00 | 0.00 | 0.80 | 0.00 | 0.00 | 1.16 | 0.74 | 10.00 | 0.00 | 0.76 | 8.00 | 0.00 | 0.00 | 2.7 | 0.0% | 8.2% | 50 |
| 0.00 | 1.00 | 0.00 | 0.00 | 0.00 | 1.16 | 1.00 | 4.00 | 0.00 | 0.76 | 3.00 | 0.50 | 15.00 | 2.16 | 0.0% | 8.3% | 50 |
| 0.00 | 0.00 | 1.00 | 0.50 | 0.00 | 0.75 | 0.50 | 5.00 | 0.00 | 0.50 | 1.00 | 0.50 | 0.00 | 2.25 | 0.0% | 8.3% | 30 |
| 0.00 | 1.00 | 0.00 | 0.00 | 0.00 | 1.16 | 1.00 | 6.00 | 0.00 | 0.76 | 3.00 | 0.50 | 15.00 | 2.16 | 0.0% | 8.4% | 50 |
| 0.00 | 0.50 | 0.50 | 0.50 | 0.00 | 0.75 | 0.50 | 1.00 | 0.00 | 0.50 | 3.00 | 0.50 | 0.00 | 1.75 | 0.0% | 8.5% | 15 |
| 0.00 | 0.50 | 0.50 | 0.50 | 0.00 | 0.75 | 0.50 | 1.00 | 0.00 | 0.50 | 4.00 | 0.50 | 0.00 | 1.75 | 0.0% | 8.6% | 25 |
| 0.00 | 0.50 | 0.50 | 5.04 | 0.00 | 1.16 | 0.74 | 4.00 | 0.00 | 0.76 | 3.00 | 0.00 | 0.00 | 2.4 | 4.7% | 8.6% | 50 |
| 0.00 | 0.00 | 1.00 | 0.00 | 0.00 | 1.16 | 0.74 | 0.00 | 0.00 | 0.76 | 4.00 | 0.00 | 0.00 | 2.9 | 0.0% | 8.6% | 50 |
| 0.00 | 1.00 | 0.00 | 0.00 | 0.00 | 1.16 | 1.00 | 4.00 | 0.00 | 0.76 | 3.00 | 0.50 | 20.00 | 2.16 | 0.0% | 8.7% | 50 |
| 0.00 | 0.00 | 1.00 | 5.04 | 0.00 | 1.16 | 0.74 | 2.00 | 0.00 | 0.76 | 3.00 | 0.00 | 0.00 | 2.9 | 0.0% | 8.7% | 25 |
| 0.00 | 1.00 | 0.00 | 0.00 | 0.00 | 1.16 | 1.00 | 6.00 | 0.00 | 0.76 | 3.00 | 0.50 | 20.00 | 2.16 | 0.0% | 8.7% | 50 |
| 0.00 | 0.00 | 1.00 | 5.04 | 0.00 | 1.16 | 0.74 | 0.00 | 0.00 | 0.76 | 4.00 | 0.00 | 0.00 | 2.9 | 0.0% | 8.7% | 50 |
| 0.00 | 0.00 | 1.00 | 0.00 | 0.00 | 1.16 | 0.74 | 2.00 | 0.00 | 0.76 | 3.00 | 0.00 | 0.00 | 2.9 | 0.0% | 8.8% | 50 |
| 0.00 | 0.00 | 0.90 | 10.94 | 1.82 | 0.46 | 0.46 | 7.96 | 7.29 | 0.46 | 0.00 | 0.00 | 0.00 | 1.8114 | 0.0% | 8.8% | 60 |
| 0.00 | 0.00 | 1.07 | 5.04 | 0.00 | 1.16 | 0.74 | 0.00 | 0.00 | 0.76 | 4.00 | 0.00 | 0.00 | 2.97 | 0.0% | 8.9% | 50 |
| 0.00 | 0.00 | 1.50 | 0.00 | 0.00 | 1.16 | 24.00 | 2.00 | 0.00 | 0.76 | 3.00 | 0.50 | 0.00 | 26.66 | 0.0% | 9.0% | 50 |
| 0.00 | 1.00 | 0.00 | 0.00 | 0.00 | 1.16 | 1.00 | 4.00 | 0.00 | 0.76 | 3.00 | 0.50 | 25.00 | 2.16 | 0.0% | 9.0% | 50 |
| 0.00 | 0.00 | 1.50 | 0.00 | 0.00 | 1.16 | 26.00 | 2.00 | 0.00 | 0.76 | 3.00 | 0.50 | 0.00 | 28.66 | 0.0% | 9.0% | 50 |
| 0.00 | 0.00 | 1.07 | 5.04 | 0.00 | 1.16 | 0.74 | 4.00 | 0.00 | 0.76 | 2.00 | 0.00 | 0.00 | 2.97 | 0.0% | 9.0% | 50 |
| 0.00 | 0.00 | 1.00 | 0.00 | 0.00 | 1.16 | 0.74 | 2.00 | 0.00 | 0.76 | 3.00 | 0.50 | 0.00 | 2.9 | 0.0% | 9.0% | 50 |
| 0.00 | 0.00 | 1.00 | 0.00 | 0.00 | 1.16 | 1.00 | 2.00 | 0.00 | 0.76 | 3.00 | 0.50 | 0.00 | 3.16 | 0.0% | 9.1% | 50 |
| 0.00 | 0.00 | 1.50 | 0.00 | 0.00 | 1.16 | 28.00 | 2.00 | 0.00 | 0.76 | 3.00 | 0.50 | 0.00 | 30.66 | 0.0% | 9.1% | 50 |
| 0.00 | 1.00 | 0.00 | 0.00 | 0.00 | 1.16 | 1.00 | 6.00 | 0.00 | 0.76 | 3.00 | 0.50 | 25.00 | 2.16 | 0.0% | 9.1% | 50 |
| 0.00 | 0.00 | 1.50 | 0.00 | 0.00 | 1.16 | 22.00 | 2.00 | 0.00 | 0.76 | 3.00 | 0.50 | 0.00 | 24.66 | 0.0% | 9.1% | 50 |
| 0.00 | 0.00 | 1.50 | 0.00 | 0.00 | 1.16 | 30.00 | 2.00 | 0.00 | 0.76 | 3.00 | 0.50 | 0.00 | 32.66 | 0.0% | 9.2% | 50 |
| 0.00 | 0.00 | 1.50 | 5.04 | 0.00 | 1.16 | 0.74 | 2.00 | 0.00 | 0.76 | 3.00 | 0.00 | 0.00 | 3.4 | 0.0% | 9.2% | 60 |
| 0.00 | 0.00 | 1.00 | 0.00 | 0.00 | 1.16 | 22.00 | 2.00 | 0.00 | 0.76 | 3.00 | 0.50 | 0.00 | 24.16 | 3.8% | 9.2% | 50 |
| 0.00 | 0.00 | 1.50 | 0.00 | 0.00 | 1.16 | 20.00 | 2.00 | 0.00 | 0.76 | 3.00 | 0.50 | 0.00 | 22.66 | 0.0% | 9.3% | 50 |
| 0.00 | 0.00 | 1.40 | 5.04 | 0.00 | 1.16 | 0.74 | 4.00 | 0.00 | 0.76 | 2.00 | 0.00 | 0.00 | 3.3 | 0.0% | 9.3% | 50 |
| 0.00 | 0.00 | 1.00 | 0.00 | 0.00 | 1.16 | 24.00 | 2.00 | 0.00 | 0.76 | 3.00 | 0.50 | 0.00 | 26.16 | 3.8% | 9.3% | 50 |
| 0.00 | 0.20 | 1.00 | 0.50 | 0.00 | 0.75 | 0.00 | 2.00 | 0.00 | 0.00 | 3.00 | 0.00 | 0.00 | 1.75 | 0.0% | 9.3% | 30 |
| 0.00 | 1.00 | 0.00 | 0.00 | 0.00 | 1.16 | 1.00 | 4.00 | 0.00 | 0.76 | 3.00 | 0.50 | 30.00 | 2.16 | 0.0% | 9.4% | 50 |
| 0.00 | 0.00 | 1.00 | 0.00 | 0.00 | 1.16 | 26.00 | 2.00 | 0.00 | 0.76 | 3.00 | 0.50 | 0.00 | 28.16 | 8.4% | 9.4% | 50 |
| 0.00 | 0.00 | 1.50 | 5.04 | 0.00 | 1.16 | 0.74 | 4.00 | 0.00 | 0.76 | 2.00 | 0.00 | 0.00 | 3.4 | 0.0% | 9.4% | 65 |
| 0.00 | 0.00 | 1.00 | 5.04 | 0.00 | 1.16 | 0.74 | 1.00 | 0.00 | 0.76 | 4.00 | 0.00 | 0.00 | 2.9 | 0.0% | 9.4% | 50 |
| 0.00 | 0.00 | 1.00 | 0.00 | 0.00 | 1.16 | 0.74 | 1.00 | 0.00 | 0.76 | 4.00 | 0.00 | 0.00 | 2.9 | 0.0% | 9.4% | 50 |
| 0.00 | 0.00 | 2.00 | 0.00 | 0.00 | 1.16 | 30.00 | 2.00 | 0.00 | 0.76 | 3.00 | 0.50 | 0.00 | 33.16 | 0.0% | 9.4% | 50 |
| 0.00 | 0.00 | 1.50 | 0.00 | 0.00 | 1.16 | 18.00 | 2.00 | 0.00 | 0.76 | 3.00 | 0.50 | 0.00 | 20.66 | 0.0% | 9.5% | 50 |
| 0.00 | 0.20 | 0.80 | 0.00 | 0.00 | 1.16 | 0.74 | 6.00 | 0.00 | 0.76 | 8.00 | 0.00 | 0.00 | 2.7 | 0.0% | 9.5% | 50 |
| 0.00 | 1.00 | 0.00 | 0.00 | 0.00 | 1.16 | 1.00 | 6.00 | 0.00 | 0.76 | 3.00 | 0.50 | 30.00 | 2.16 | 0.0% | 9.5% | 50 |
| 0.00 | 0.20 | 0.80 | 0.00 | 0.00 | 1.16 | 0.74 | 7.00 | 0.00 | 0.76 | 8.00 | 0.00 | 0.00 | 2.7 | 0.0% | 9.5% | 50 |
| 0.00 | 0.00 | 1.00 | 5.04 | 0.00 | 1.16 | 0.74 | 3.00 | 0.00 | 0.76 | 3.00 | 0.00 | 0.00 | 2.9 | 0.0% | 9.5% | 50 |
| 0.00 | 0.00 | 1.00 | 0.00 | 0.00 | 1.16 | 0.74 | 3.00 | 0.00 | 0.76 | 3.00 | 0.00 | 0.00 | 2.9 | 0.0% | 9.5% | 50 |
| 0.00 | 0.20 | 0.80 | 0.00 | 0.00 | 1.16 | 0.74 | 8.00 | 0.00 | 0.76 | 9.00 | 0.00 | 0.00 | 2.7 | 0.0% | 9.5% | 50 |
| 0.00 | 0.20 | 0.80 | 0.00 | 0.00 | 1.16 | 0.74 | 8.00 | 0.00 | 0.76 | 7.00 | 0.00 | 0.00 | 2.7 | 0.0% | 9.5% | 50 |
| 0.00 | 0.20 | 0.80 | 0.00 | 0.00 | 1.16 | 0.74 | 8.00 | 0.00 | 0.76 | 8.00 | 0.00 | 0.00 | 2.7 | 0.0% | 9.5% | 50 |
| 0.00 | 0.20 | 0.80 | 0.00 | 0.00 | 1.16 | 0.74 | 9.00 | 0.00 | 0.76 | 9.00 | 0.00 | 0.00 | 2.7 | 0.0% | 9.6% | 50 |
| 0.00 | 0.20 | 0.80 | 0.00 | 0.00 | 1.16 | 0.74 | 9.00 | 0.00 | 0.76 | 7.00 | 0.00 | 0.00 | 2.7 | 0.0% | 9.6% | 50 |
| 0.00 | 0.20 | 0.80 | 0.00 | 0.00 | 1.16 | 0.74 | 9.00 | 0.00 | 0.76 | 8.00 | 0.00 | 0.00 | 2.7 | 0.0% | 9.6% | 50 |
| 0.00 | 0.20 | 0.80 | 0.00 | 0.00 | 1.16 | 0.74 | 10.00 | 0.00 | 0.76 | 9.00 | 0.00 | 0.00 | 2.7 | 0.0% | 9.6% | 50 |
| 0.00 | 0.20 | 0.80 | 0.00 | 0.00 | 1.16 | 0.74 | 10.00 | 0.00 | 0.76 | 8.00 | 0.00 | 0.00 | 2.7 | 0.0% | 9.6% | 50 |
| 0.00 | 0.00 | 2.00 | 0.00 | 0.00 | 1.16 | 28.00 | 2.00 | 0.00 | 0.76 | 3.00 | 0.50 | 0.00 | 31.16 | 0.0% | 9.6% | 50 |
| 0.00 | 0.20 | 0.80 | 0.00 | 0.00 | 1.16 | 0.74 | 10.00 | 0.00 | 0.76 | 7.00 | 0.00 | 0.00 | 2.7 | 0.0% | 9.6% | 50 |
| 0.00 | 0.00 | 1.00 | 5.04 | 0.00 | 1.16 | 0.74 | 5.00 | 0.00 | 0.76 | 2.00 | 0.00 | 0.00 | 2.9 | 0.0% | 9.6% | 50 |
| 0.00 | 0.00 | 1.00 | 5.04 | 0.00 | 1.16 | 0.74 | 0.00 | 0.00 | 0.76 | 5.00 | 0.00 | 0.00 | 2.9 | 0.0% | 9.6% | 50 |
| 0.00 | 0.00 | 1.00 | 0.00 | 0.00 | 1.16 | 0.74 | 5.00 | 0.00 | 0.76 | 2.00 | 0.00 | 0.00 | 2.9 | 0.0% | 9.6% | 50 |
| 0.00 | 0.00 | 1.00 | 0.00 | 0.00 | 1.16 | 0.74 | 2.00 | 0.00 | 0.76 | 4.00 | 0.00 | 0.00 | 2.9 | 0.0% | 9.7% | 50 |
| 0.00 | 0.00 | 1.00 | 5.04 | 0.00 | 1.16 | 0.74 | 1.00 | 0.00 | 0.76 | 5.00 | 0.00 | 0.00 | 2.9 | 0.0% | 9.7% | 50 |
| 0.00 | 0.00 | 1.00 | 5.04 | 0.00 | 1.16 | 0.74 | 2.00 | 0.00 | 0.76 | 4.00 | 0.00 | 0.00 | 2.9 | 0.0% | 9.7% | 50 |
| 0.00 | 0.00 | 1.00 | 0.00 | 0.00 | 1.16 | 0.74 | 1.00 | 0.00 | 0.76 | 5.00 | 0.00 | 0.00 | 2.9 | 0.0% | 9.7% | 50 |
| 0.00 | 0.00 | 1.00 | 0.00 | 0.00 | 1.16 | 0.00 | 4.00 | 0.00 | 0.76 | 3.00 | 0.50 | 0.00 | 2.16 | 0.0% | 9.7% | 50 |
| 0.00 | 0.00 | 1.00 | 0.00 | 0.00 | 1.16 | 0.74 | 4.00 | 0.00 | 0.76 | 3.00 | 0.50 | 0.00 | 2.9 | 0.0% | 9.7% | 50 |
| 0.00 | 0.00 | 1.00 | 5.04 | 0.00 | 1.16 | 0.74 | 6.00 | 0.00 | 0.76 | 2.00 | 0.00 | 0.00 | 2.9 | 0.0% | 9.7% | 50 |
| 0.00 | 0.00 | 1.00 | 0.00 | 0.00 | 1.16 | 1.00 | 4.00 | 0.00 | 0.76 | 3.00 | 0.50 | 0.00 | 3.16 | 0.0% | 9.7% | 50 |
| 0.00 | 0.00 | 1.00 | 10.83 | 1.81 | 0.45 | 0.45 | 8.74 | 7.22 | 0.45 | 0.00 | 0.00 | 0.00 | 1.9026 | 0.0% | 9.7% | 60 |
| 0.00 | 0.00 | 1.00 | 5.04 | 0.00 | 1.16 | 0.74 | 4.00 | 0.00 | 0.76 | 3.00 | 0.00 | 0.00 | 2.9 | 0.7% | 9.7% | 50 |
| 0.00 | 0.00 | 1.00 | 0.00 | 0.00 | 1.16 | 0.74 | 4.00 | 0.00 | 0.76 | 3.00 | 0.00 | 0.00 | 2.9 | 0.0% | 9.8% | 50 |
| 0.00 | 0.00 | 1.00 | 5.04 | 0.00 | 1.16 | 0.74 | 3.00 | 0.00 | 0.76 | 4.00 | 0.00 | 0.00 | 2.9 | 0.0% | 9.8% | 50 |
| 0.00 | 0.00 | 1.00 | 0.00 | 0.00 | 1.16 | 0.74 | 3.00 | 0.00 | 0.76 | 4.00 | 0.00 | 0.00 | 2.9 | 0.0% | 9.8% | 50 |
| 0.00 | 0.00 | 1.00 | 0.00 | 0.00 | 1.16 | 2.00 | 4.00 | 0.00 | 0.76 | 3.00 | 0.50 | 0.00 | 4.16 | 0.0% | 9.8% | 50 |
| 0.00 | 0.00 | 1.50 | 5.04 | 0.00 | 1.16 | 0.74 | 8.00 | 0.00 | 0.76 | 0.00 | 0.00 | 0.00 | 3.4 | 0.0% | 9.8% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 1.00 | 0.00 | 0.00 | 1.16 | 0.74 | 5.00 | 0.00 | 0.76 | 3.00 | 0.00 | 0.00 | 2.9 | 0.0% | 9.8% | 50 |
| 0.00 | 0.00 | 1.00 | 0.00 | 0.00 | 1.16 | 0.74 | 4.00 | 0.00 | 0.76 | 3.00 | 0.50 | 2.00 | 2.9 | 0.0% | 9.9% | 50 |
| 0.00 | 0.00 | 1.00 | 0.00 | 0.00 | 1.16 | 0.74 | 6.00 | 0.00 | 0.76 | 10.00 | 0.00 | 0.00 | 2.9 | 0.0% | 10.0% | 50 |
| 0.00 | 0.00 | 1.00 | 5.04 | 0.00 | 1.16 | 0.74 | 8.00 | 0.00 | 0.76 | 4.00 | 0.00 | 0.00 | 2.9 | 0.0% | 10.0% | 50 |
| 0.00 | 0.00 | 1.20 | 5.04 | 0.00 | 1.16 | 0.74 | 1.00 | 0.00 | 0.76 | 4.00 | 0.00 | 0.00 | 3.1 | 0.0% | 10.0% | 50 |
| 0.00 | 0.00 | 1.00 | 0.00 | 0.00 | 1.16 | 0.74 | 4.00 | 0.00 | 0.76 | 3.00 | 0.50 | 4.00 | 2.9 | 0.0% | 10.0% | 50 |
| 0.00 | 0.00 | 1.00 | 5.04 | 0.00 | 1.16 | 0.74 | 10.00 | 0.00 | 0.76 | 3.00 | 0.00 | 0.00 | 2.9 | 0.0% | 10.0% | 50 |
| 0.00 | 0.00 | 1.00 | 0.00 | 0.00 | 1.16 | 0.74 | 7.00 | 0.00 | 0.76 | 10.00 | 0.00 | 0.00 | 2.9 | 0.0% | 10.0% | 50 |
| 0.00 | 0.00 | 1.00 | 0.00 | 0.00 | 1.16 | 0.74 | 7.00 | 0.00 | 0.76 | 9.00 | 0.00 | 0.00 | 2.9 | 0.0% | 10.0% | 50 |
| 0.00 | 0.00 | 1.00 | 5.04 | 0.00 | 1.16 | 0.74 | 8.00 | 0.00 | 0.76 | 8.00 | 0.00 | 0.00 | 2.9 | 0.0% | 10.0% | 50 |
| 0.00 | 0.00 | 1.20 | 5.04 | 0.00 | 1.16 | 0.74 | 3.00 | 0.00 | 0.76 | 3.00 | 0.00 | 0.00 | 3.1 | 0.0% | 10.0% | 50 |
| 0.00 | 0.00 | 1.00 | 0.00 | 0.00 | 1.16 | 0.74 | 8.00 | 0.00 | 0.76 | 10.00 | 0.00 | 0.00 | 2.9 | 0.0% | 10.0% | 50 |
| 0.00 | 0.00 | 1.00 | 0.00 | 0.00 | 1.16 | 0.74 | 8.00 | 0.00 | 0.76 | 8.00 | 0.00 | 0.00 | 2.9 | 0.0% | 10.0% | 50 |
| 0.00 | 0.00 | 1.00 | 0.00 | 0.00 | 1.16 | 0.74 | 8.00 | 0.00 | 0.76 | 9.00 | 0.00 | 0.00 | 2.9 | 0.0% | 10.0% | 50 |
| 0.00 | 0.00 | 1.00 | 0.00 | 0.00 | 1.16 | 1.00 | 4.00 | 0.00 | 0.76 | 3.00 | 0.50 | 5.00 | 3.16 | 0.0% | 10.1% | 50 |
| 0.00 | 0.00 | 1.00 | 0.00 | 0.00 | 1.16 | 0.74 | 9.00 | 0.00 | 0.76 | 10.00 | 0.00 | 0.00 | 2.9 | 0.0% | 10.1% | 50 |
| 0.00 | 0.00 | 1.00 | 0.00 | 0.00 | 1.16 | 0.74 | 9.00 | 0.00 | 0.76 | 8.00 | 0.00 | 0.00 | 2.9 | 0.0% | 10.1% | 50 |
| 0.00 | 0.00 | 1.00 | 0.00 | 0.00 | 1.16 | 0.74 | 9.00 | 0.00 | 0.76 | 9.00 | 0.00 | 0.00 | 2.9 | 0.0% | 10.1% | 50 |
| 0.00 | 1.50 | 2.50 | 2.00 | 0.00 | 1.16 | 0.74 | 6.00 | 0.00 | 0.76 | 10.00 | 0.00 | 0.00 | 4.4 | 0.0% | 10.1% | 45 |
| 0.00 | 0.00 | 1.00 | 0.00 | 0.00 | 1.16 | 10.00 | 4.00 | 0.00 | 0.76 | 3.00 | 0.50 | 0.00 | 12.16 | 0.5% | 10.1% | 50 |
| 0.00 | 1.50 | 2.50 | 0.00 | 0.00 | 1.16 | 0.74 | 6.00 | 0.00 | 0.76 | 10.00 | 0.00 | 0.00 | 4.4 | 0.0% | 10.1% | 55 |
| 0.00 | 1.50 | 2.50 | 4.00 | 0.00 | 1.16 | 0.74 | 7.00 | 0.00 | 0.76 | 10.00 | 0.00 | 0.00 | 4.4 | 0.0% | 10.1% | 30 |
| 0.00 | 0.00 | 1.00 | 0.00 | 0.00 | 1.16 | 0.74 | 10.00 | 0.00 | 0.76 | 10.00 | 0.00 | 0.00 | 2.9 | 0.0% | 10.1% | 50 |
| 0.00 | 0.00 | 1.00 | 0.00 | 0.00 | 1.16 | 0.74 | 4.00 | 0.00 | 0.76 | 3.00 | 0.50 | 6.00 | 2.9 | 0.0% | 10.1% | 50 |
| 0.00 | 0.00 | 1.00 | 0.00 | 0.00 | 1.16 | 0.74 | 10.00 | 0.00 | 0.76 | 9.00 | 0.00 | 0.00 | 2.9 | 0.0% | 10.1% | 50 |
| 0.00 | 0.00 | 1.00 | 0.00 | 0.00 | 1.16 | 0.74 | 10.00 | 0.00 | 0.76 | 8.00 | 0.00 | 0.00 | 2.9 | 0.0% | 10.1% | 50 |
| 0.00 | 1.50 | 2.50 | 0.00 | 0.00 | 1.16 | 0.74 | 7.00 | 0.00 | 0.76 | 10.00 | 0.00 | 0.00 | 4.4 | 0.0% | 10.1% | 35 |
| 0.00 | 0.00 | 1.00 | 0.00 | 0.00 | 1.16 | 12.00 | 4.00 | 0.00 | 0.76 | 3.00 | 0.50 | 0.00 | 14.16 | 3.3% | 10.1% | 50 |
| 0.00 | 0.00 | 1.20 | 5.04 | 0.00 | 1.16 | 0.74 | 5.00 | 0.00 | 0.76 | 2.00 | 0.00 | 0.00 | 3.1 | 0.0% | 10.2% | 50 |
| 0.00 | 1.50 | 2.50 | 0.00 | 0.00 | 1.16 | 0.74 | 8.00 | 0.00 | 0.76 | 10.00 | 0.00 | 0.00 | 4.4 | 0.0% | 10.2% | 25 |
| 0.00 | 0.00 | 1.07 | 5.04 | 0.00 | 1.16 | 0.74 | 2.00 | 0.00 | 0.76 | 4.00 | 0.00 | 0.00 | 2.97 | 0.0% | 10.2% | 50 |
| 0.00 | 0.00 | 1.00 | 0.00 | 0.00 | 1.16 | 0.74 | 4.00 | 0.00 | 0.76 | 3.00 | 0.50 | 8.00 | 2.9 | 0.0% | 10.2% | 50 |
| 0.00 | 0.00 | 1.07 | 5.04 | 0.00 | 1.16 | 0.74 | 0.00 | 0.00 | 0.76 | 6.00 | 0.00 | 0.00 | 2.97 | 0.0% | 10.3% | 50 |
| 0.00 | 0.00 | 1.00 | 0.00 | 0.00 | 1.16 | 0.74 | 4.00 | 0.00 | 0.76 | 3.00 | 0.50 | 10.00 | 2.9 | 0.0% | 10.4% | 50 |
| 0.00 | 0.00 | 1.00 | 0.00 | 0.00 | 1.16 | 1.00 | 4.00 | 0.00 | 0.76 | 3.00 | 0.50 | 10.00 | 3.16 | 0.0% | 10.4% | 50 |
| 0.00 | 0.20 | 1.00 | 0.50 | 0.00 | 0.75 | 0.00 | 3.00 | 0.00 | 0.00 | 3.00 | 0.00 | 0.00 | 1.75 | 0.0% | 10.4% | 15 |
| 0.00 | 0.00 | 1.07 | 5.04 | 0.00 | 1.16 | 0.74 | 10.00 | 0.00 | 0.76 | 0.00 | 0.00 | 0.00 | 2.97 | 0.0% | 10.5% | 20 |
| 0.00 | 0.20 | 1.00 | 0.50 | 0.00 | 0.75 | 0.00 | 5.00 | 0.00 | 0.00 | 2.00 | 0.00 | 0.00 | 1.75 | 0.0% | 10.6% | 25 |
| 0.00 | 2.00 | 0.00 | 0.00 | 0.00 | 1.16 | 1.00 | 0.00 | 0.00 | 0.76 | 3.00 | 0.50 | 15.00 | 2.16 | 8.6% | 10.6% | 50 |
| 0.00 | 0.00 | 2.00 | 0.00 | 0.00 | 1.16 | 30.00 | 4.00 | 0.00 | 0.76 | 3.00 | 0.50 | 0.00 | 33.16 | 0.0% | 10.7% | 50 |
| 0.00 | 0.00 | 1.07 | 5.04 | 0.00 | 1.16 | 0.74 | 8.00 | 0.00 | 0.76 | 8.00 | 0.00 | 0.00 | 2.97 | 0.0% | 10.7% | 50 |
| 0.00 | 0.00 | 1.20 | 5.04 | 0.00 | 1.16 | 0.74 | 0.00 | 0.00 | 0.76 | 5.00 | 0.00 | 0.00 | 3.1 | 0.0% | 10.7% | 50 |
| 0.00 | 0.00 | 1.07 | 5.04 | 0.00 | 1.16 | 0.74 | 10.00 | 0.00 | 0.76 | 4.00 | 0.00 | 0.00 | 2.97 | 0.0% | 10.7% | 50 |
| 0.00 | 0.50 | 1.00 | 0.50 | 0.00 | 0.75 | 0.50 | 0.00 | 0.00 | 0.50 | 4.00 | 0.50 | 0.00 | 2.25 | 0.0% | 10.7% | 55 |
| 0.00 | 0.00 | 1.07 | 5.04 | 0.00 | 1.16 | 0.74 | 10.00 | 0.00 | 0.76 | 6.00 | 0.00 | 0.00 | 2.97 | 0.0% | 10.8% | 50 |
| 0.00 | 0.00 | 1.50 | 0.50 | 0.00 | 0.75 | 0.50 | 1.00 | 0.00 | 0.50 | 4.00 | 0.50 | 0.00 | 2.75 | 0.0% | 10.8% | 60 |
| 0.00 | 0.00 | 1.20 | 5.04 | 0.00 | 1.16 | 0.74 | 2.00 | 0.00 | 0.76 | 4.00 | 0.00 | 0.00 | 3.1 | 0.0% | 10.8% | 50 |
| 0.00 | 0.00 | 1.50 | 0.50 | 0.00 | 0.75 | 0.50 | 3.00 | 0.00 | 0.50 | 3.00 | 0.50 | 0.00 | 2.75 | 0.0% | 10.8% | 65 |
| 0.00 | 0.00 | 1.50 | 0.00 | 0.00 | 1.16 | 20.00 | 4.00 | 0.00 | 0.76 | 3.00 | 0.50 | 0.00 | 22.66 | 0.0% | 10.8% | 50 |
| 0.00 | 0.00 | 1.50 | 0.00 | 0.00 | 1.16 | 22.00 | 4.00 | 0.00 | 0.76 | 3.00 | 0.50 | 0.00 | 24.66 | 0.0% | 10.9% | 50 |
| 0.00 | 0.40 | 0.80 | 0.00 | 0.00 | 1.16 | 0.74 | 6.00 | 0.00 | 0.76 | 9.00 | 0.00 | 0.00 | 2.7 | 0.0% | 10.9% | 50 |
| 0.00 | 0.00 | 1.50 | 0.50 | 0.00 | 0.75 | 0.50 | 5.00 | 0.00 | 0.50 | 2.00 | 0.50 | 0.00 | 2.75 | 0.0% | 10.9% | 60 |
| 0.00 | 0.40 | 0.80 | 0.00 | 0.00 | 1.16 | 0.74 | 7.00 | 0.00 | 0.76 | 9.00 | 0.00 | 0.00 | 2.7 | 0.0% | 10.9% | 50 |
| 0.00 | 0.40 | 0.80 | 0.00 | 0.00 | 1.16 | 0.74 | 7.00 | 0.00 | 0.76 | 8.00 | 0.00 | 0.00 | 2.7 | 0.0% | 10.9% | 50 |
| 0.00 | 0.00 | 1.20 | 5.04 | 0.00 | 1.16 | 0.74 | 4.00 | 0.00 | 0.76 | 3.00 | 0.00 | 0.00 | 3.1 | 0.0% | 10.9% | 50 |
| 0.00 | 0.00 | 1.50 | 0.00 | 0.00 | 1.16 | 24.00 | 4.00 | 0.00 | 0.76 | 3.00 | 0.50 | 0.00 | 26.66 | 0.0% | 10.9% | 50 |
| 0.00 | 2.00 | 0.00 | 0.00 | 0.00 | 1.16 | 1.00 | 2.00 | 0.00 | 0.76 | 3.00 | 0.50 | 20.00 | 2.16 | 9.1% | 11.0% | 50 |
| 0.00 | 0.40 | 0.80 | 0.00 | 0.00 | 1.16 | 0.74 | 8.00 | 0.00 | 0.76 | 9.00 | 0.00 | 0.00 | 2.7 | 0.0% | 11.0% | 50 |
| 0.00 | 0.40 | 0.80 | 0.00 | 0.00 | 1.16 | 0.74 | 8.00 | 0.00 | 0.76 | 8.00 | 0.00 | 0.00 | 2.7 | 0.0% | 11.0% | 50 |
| 0.00 | 0.00 | 2.00 | 0.00 | 0.00 | 1.16 | 28.00 | 4.00 | 0.00 | 0.76 | 3.00 | 0.50 | 0.00 | 31.16 | 0.0% | 11.0% | 50 |
| 0.00 | 0.40 | 0.80 | 0.00 | 0.00 | 1.16 | 0.74 | 9.00 | 0.00 | 0.76 | 9.00 | 0.00 | 0.00 | 2.7 | 0.0% | 11.0% | 50 |
| 0.00 | 0.40 | 0.80 | 0.00 | 0.00 | 1.16 | 0.74 | 9.00 | 0.00 | 0.76 | 8.00 | 0.00 | 0.00 | 2.7 | 0.0% | 11.0% | 50 |
| 0.00 | 0.40 | 0.80 | 0.00 | 0.00 | 1.16 | 0.74 | 9.00 | 0.00 | 0.76 | 7.00 | 0.00 | 0.00 | 2.7 | 0.0% | 11.0% | 50 |
| 0.00 | 0.00 | 1.50 | 0.00 | 0.00 | 1.16 | 26.00 | 4.00 | 0.00 | 0.76 | 3.00 | 0.50 | 0.00 | 28.66 | 0.0% | 11.0% | 50 |
| 0.00 | 0.40 | 0.80 | 0.00 | 0.00 | 1.16 | 0.74 | 10.00 | 0.00 | 0.76 | 9.00 | 0.00 | 0.00 | 2.7 | 0.0% | 11.0% | 50 |
| 0.00 | 0.40 | 0.80 | 0.00 | 0.00 | 1.16 | 0.74 | 10.00 | 0.00 | 0.76 | 8.00 | 0.00 | 0.00 | 2.7 | 0.0% | 11.0% | 50 |
| 0.00 | 0.40 | 0.80 | 0.00 | 0.00 | 1.16 | 0.74 | 10.00 | 0.00 | 0.76 | 7.00 | 0.00 | 0.00 | 2.7 | 0.0% | 11.0% | 50 |
| 0.00 | 2.00 | 0.00 | 0.00 | 0.00 | 1.16 | 1.00 | 4.00 | 0.00 | 0.76 | 3.00 | 0.50 | 20.00 | 2.16 | 9.1% | 11.1% | 50 |
| 0.00 | 0.00 | 1.50 | 0.00 | 0.00 | 1.16 | 28.00 | 4.00 | 0.00 | 0.76 | 3.00 | 0.50 | 0.00 | 30.66 | 0.0% | 11.1% | 50 |
| 0.00 | 0.00 | 2.00 | 0.00 | 0.00 | 1.16 | 26.00 | 4.00 | 0.00 | 0.76 | 3.00 | 0.50 | 0.00 | 29.16 | 0.0% | 11.3% | 50 |
| 0.00 | 0.00 | 1.20 | 5.04 | 0.00 | 1.16 | 0.74 | 1.00 | 0.00 | 0.76 | 5.00 | 0.00 | 0.00 | 3.1 | 0.0% | 11.3% | 50 |
| 0.00 | 2.00 | 0.00 | 0.00 | 0.00 | 1.16 | 1.00 | 2.00 | 0.00 | 0.76 | 3.00 | 0.50 | 25.00 | 2.16 | 9.5% | 11.3% | 50 |
| 0.00 | 0.20 | 1.00 | 0.50 | 0.00 | 0.75 | 0.00 | 5.00 | 0.00 | 0.00 | 3.00 | 0.00 | 0.00 | 1.75 | 0.0% | 11.3% | 15 |
| 0.00 | 0.20 | 1.00 | 0.00 | 0.00 | 1.16 | 0.74 | 6.00 | 0.00 | 0.76 | 9.00 | 0.00 | 0.00 | 2.9 | 0.0% | 11.4% | 50 |
| 0.00 | 2.00 | 0.00 | 0.00 | 0.00 | 1.16 | 1.00 | 4.00 | 0.00 | 0.76 | 3.00 | 0.50 | 25.00 | 2.16 | 9.6% | 11.4% | 50 |
| 0.00 | 0.00 | 1.20 | 5.04 | 0.00 | 1.16 | 0.74 | 3.00 | 0.00 | 0.76 | 4.00 | 0.00 | 0.00 | 3.1 | 0.0% | 11.4% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.20 | 1.00 | 0.00 | 0.00 | 1.16 | 0.74 | 7.00 | 0.00 | 0.76 | 9.00 | 0.00 | 0.00 | 2.9 | 0.0% | 11.4% | 50 |
| 0.00 | 0.20 | 1.00 | 0.00 | 0.00 | 1.16 | 0.74 | 8.00 | 0.00 | 0.76 | 9.00 | 0.00 | 0.00 | 2.9 | 0.0% | 11.5% | 50 |
| 0.00 | 0.20 | 1.00 | 0.00 | 0.00 | 1.16 | 0.74 | 8.00 | 0.00 | 0.76 | 8.00 | 0.00 | 0.00 | 2.9 | 0.0% | 11.5% | 50 |
| 0.00 | 0.20 | 1.30 | 0.50 | 0.00 | 0.75 | 0.70 | 4.50 | 0.00 | 0.44 | 2.50 | 0.36 | 0.00 | 2.75 | 0.4% | 11.5% | 75 |
| 0.00 | 0.20 | 1.30 | 0.50 | 0.00 | 0.75 | 0.70 | 3.50 | 0.00 | 0.44 | 3.00 | 0.36 | 0.00 | 2.75 | 0.2% | 11.5% | 65 |
| 0.00 | 0.00 | 3.00 | 0.00 | 0.00 | 1.16 | 0.74 | 0.00 | 0.00 | 0.76 | 3.00 | 0.50 | 28.00 | 4.9 | 0.0% | 11.5% | 50 |
| 0.00 | 0.20 | 1.00 | 0.00 | 0.00 | 1.16 | 0.74 | 9.00 | 0.00 | 0.76 | 9.00 | 0.00 | 0.00 | 2.9 | 0.0% | 11.5% | 50 |
| 0.00 | 0.20 | 1.00 | 0.00 | 0.00 | 1.16 | 0.74 | 9.00 | 0.00 | 0.76 | 8.00 | 0.00 | 0.00 | 2.9 | 0.0% | 11.5% | 50 |
| 0.00 | 2.00 | 0.00 | 0.00 | 0.00 | 1.16 | 1.00 | 6.00 | 0.00 | 0.76 | 3.00 | 0.50 | 25.00 | 2.16 | 5.0% | 11.5% | 50 |
| 0.00 | 0.00 | 1.20 | 5.04 | 0.00 | 1.16 | 0.74 | 5.00 | 0.00 | 0.76 | 3.00 | 0.00 | 0.00 | 3.1 | 0.0% | 11.5% | 50 |
| 0.00 | 0.20 | 1.00 | 0.00 | 0.00 | 1.16 | 0.74 | 10.00 | 0.00 | 0.76 | 10.00 | 0.00 | 0.00 | 2.9 | 0.0% | 11.5% | 50 |
| 0.00 | 0.20 | 1.00 | 0.00 | 0.00 | 1.16 | 0.74 | 10.00 | 0.00 | 0.76 | 7.00 | 0.00 | 0.00 | 2.9 | 0.0% | 11.5% | 50 |
| 0.00 | 0.20 | 1.00 | 0.00 | 0.00 | 1.16 | 0.74 | 10.00 | 0.00 | 0.76 | 9.00 | 0.00 | 0.00 | 2.9 | 0.0% | 11.5% | 50 |
| 0.00 | 0.20 | 1.00 | 0.00 | 0.00 | 1.16 | 0.74 | 10.00 | 0.00 | 0.76 | 8.00 | 0.00 | 0.00 | 2.9 | 0.0% | 11.5% | 50 |
| 0.00 | 0.00 | 1.20 | 5.04 | 0.00 | 1.16 | 0.74 | 2.00 | 0.00 | 0.76 | 5.00 | 0.00 | 0.00 | 3.1 | 0.0% | 11.5% | 50 |
| 0.00 | 0.00 | 2.00 | 0.00 | 0.00 | 1.16 | 24.00 | 4.00 | 0.00 | 0.76 | 3.00 | 0.50 | 0.00 | 27.16 | 0.0% | 11.6% | 50 |
| 0.00 | 0.50 | 1.00 | 0.50 | 0.00 | 0.75 | 0.50 | 3.00 | 0.00 | 0.50 | 3.00 | 0.50 | 0.00 | 2.25 | 0.0% | 11.6% | 50 |
| 0.00 | 0.50 | 1.00 | 0.50 | 0.00 | 0.75 | 0.50 | 1.00 | 0.00 | 0.50 | 4.00 | 0.50 | 0.00 | 2.25 | 0.0% | 11.6% | 45 |
| 0.00 | 0.00 | 1.20 | 5.04 | 0.00 | 1.16 | 0.74 | 3.00 | 0.00 | 0.76 | 5.00 | 0.00 | 0.00 | 3.1 | 0.0% | 11.6% | 50 |
| 0.00 | 0.00 | 1.20 | 5.04 | 0.00 | 1.16 | 0.74 | 4.00 | 0.00 | 0.76 | 4.00 | 0.00 | 0.00 | 3.1 | 0.1% | 11.6% | 50 |
| 0.00 | 0.00 | 3.00 | 0.00 | 0.00 | 1.16 | 0.74 | 0.00 | 0.00 | 0.76 | 3.00 | 0.50 | 30.00 | 4.9 | 0.0% | 11.7% | 50 |
| 0.00 | 0.00 | 1.50 | 0.50 | 0.00 | 0.75 | 0.50 | 2.00 | 0.00 | 0.50 | 4.00 | 0.50 | 0.00 | 2.75 | 0.0% | 11.8% | 45 |
| 0.00 | 2.00 | 0.00 | 0.00 | 0.00 | 1.16 | 1.00 | 4.00 | 0.00 | 0.76 | 3.00 | 0.50 | 30.00 | 2.16 | 8.7% | 11.8% | 50 |
| 0.00 | 0.00 | 1.50 | 0.50 | 0.00 | 0.75 | 0.50 | 4.00 | 0.00 | 0.50 | 3.00 | 0.50 | 0.00 | 2.75 | 0.0% | 11.8% | 50 |
| 0.00 | 0.00 | 1.20 | 0.00 | 0.00 | 1.16 | 0.74 | 7.00 | 0.00 | 0.76 | 10.00 | 0.00 | 0.00 | 3.1 | 0.0% | 11.9% | 50 |
| 0.00 | 2.00 | 0.00 | 0.00 | 0.00 | 1.16 | 1.00 | 6.00 | 0.00 | 0.76 | 3.00 | 0.50 | 30.00 | 2.16 | 1.7% | 11.9% | 50 |
| 0.00 | 0.00 | 1.20 | 0.00 | 0.00 | 1.16 | 0.74 | 8.00 | 0.00 | 0.76 | 10.00 | 0.00 | 0.00 | 3.1 | 0.0% | 11.9% | 50 |
| 0.00 | 0.00 | 1.20 | 0.00 | 0.00 | 1.16 | 0.74 | 8.00 | 0.00 | 0.76 | 9.00 | 0.00 | 0.00 | 3.1 | 0.0% | 11.9% | 50 |
| 0.00 | 0.20 | 1.30 | 0.50 | 0.00 | 0.75 | 0.70 | 4.00 | 0.00 | 0.44 | 3.00 | 0.36 | 0.00 | 2.75 | 0.2% | 12.0% | 55 |
| 0.00 | 0.20 | 1.30 | 0.50 | 0.00 | 0.75 | 0.70 | 5.00 | 0.00 | 0.44 | 2.50 | 0.36 | 0.00 | 2.75 | 0.3% | 12.0% | 60 |
| 0.00 | 0.00 | 1.20 | 0.00 | 0.00 | 1.16 | 0.74 | 9.00 | 0.00 | 0.76 | 10.00 | 0.00 | 0.00 | 3.1 | 0.0% | 12.0% | 50 |
| 0.00 | 0.00 | 1.20 | 0.00 | 0.00 | 1.16 | 0.74 | 9.00 | 0.00 | 0.76 | 9.00 | 0.00 | 0.00 | 3.1 | 0.0% | 12.0% | 50 |
| 0.00 | 0.00 | 1.40 | 5.04 | 0.00 | 1.16 | 0.74 | 1.00 | 0.00 | 0.76 | 5.00 | 0.00 | 0.00 | 3.3 | 0.0% | 12.0% | 50 |
| 0.00 | 1.00 | 0.50 | 5.04 | 0.00 | 1.16 | 0.74 | 4.00 | 0.00 | 0.76 | 3.00 | 0.00 | 0.00 | 2.4 | 0.0% | 12.0% | 50 |
| 0.00 | 0.00 | 1.20 | 0.00 | 0.00 | 1.16 | 0.74 | 10.00 | 0.00 | 0.76 | 10.00 | 0.00 | 0.00 | 3.1 | 0.0% | 12.0% | 50 |
| 0.00 | 0.00 | 1.20 | 0.00 | 0.00 | 1.16 | 0.74 | 10.00 | 0.00 | 0.76 | 9.00 | 0.00 | 0.00 | 3.1 | 0.0% | 12.0% | 50 |
| 0.00 | 0.00 | 1.40 | 5.04 | 0.00 | 1.16 | 0.74 | 3.00 | 0.00 | 0.76 | 4.00 | 0.00 | 0.00 | 3.3 | 0.0% | 12.1% | 50 |
| 0.00 | 1.00 | 0.50 | 5.04 | 0.00 | 1.16 | 0.74 | 6.00 | 0.00 | 0.76 | 3.00 | 0.00 | 0.00 | 2.4 | 0.0% | 12.1% | 50 |
| 0.00 | 0.50 | 1.00 | 5.04 | 0.00 | 1.16 | 0.74 | 4.00 | 0.00 | 0.76 | 3.00 | 0.00 | 0.00 | 2.9 | 0.2% | 12.2% | 50 |
| 0.00 | 0.00 | 1.40 | 5.04 | 0.00 | 1.16 | 0.74 | 5.00 | 0.00 | 0.76 | 3.00 | 0.00 | 0.00 | 3.3 | 0.0% | 12.2% | 50 |
| 0.00 | 0.60 | 0.80 | 0.00 | 0.00 | 1.16 | 0.74 | 6.00 | 0.00 | 0.76 | 9.00 | 0.00 | 0.00 | 2.7 | 0.0% | 12.3% | 50 |
| 0.00 | 0.00 | 1.50 | 0.00 | 0.00 | 1.16 | 0.74 | 5.00 | 0.00 | 0.76 | 3.00 | 0.00 | 0.00 | 3.4 | 0.0% | 12.3% | 50 |
| 0.00 | 0.60 | 0.80 | 0.00 | 0.00 | 1.16 | 0.74 | 7.00 | 0.00 | 0.76 | 9.00 | 0.00 | 0.00 | 2.7 | 0.0% | 12.3% | 50 |
| 0.00 | 0.00 | 5.00 | 0.00 | 0.00 | 1.16 | 0.74 | 4.00 | 0.00 | 0.76 | 4.00 | 0.00 | 0.00 | 6.9 | 8.3% | 12.3% | 50 |
| 0.00 | 0.60 | 0.80 | 0.00 | 0.00 | 1.16 | 0.74 | 8.00 | 0.00 | 0.76 | 10.00 | 0.00 | 0.00 | 2.7 | 0.0% | 12.3% | 50 |
| 0.00 | 0.60 | 0.80 | 0.00 | 0.00 | 1.16 | 0.74 | 8.00 | 0.00 | 0.76 | 9.00 | 0.00 | 0.00 | 2.7 | 0.0% | 12.3% | 50 |
| 0.00 | 0.60 | 0.80 | 0.00 | 0.00 | 1.16 | 0.74 | 8.00 | 0.00 | 0.76 | 8.00 | 0.00 | 0.00 | 2.7 | 0.0% | 12.4% | 50 |
| 0.00 | 0.00 | 2.00 | 0.00 | 0.00 | 1.16 | 28.00 | 6.00 | 0.00 | 0.76 | 3.00 | 0.50 | 0.00 | 31.16 | 0.0% | 12.4% | 50 |
| 0.00 | 0.50 | 1.00 | 0.50 | 0.00 | 0.75 | 0.50 | 2.00 | 0.00 | 0.50 | 4.00 | 0.50 | 0.00 | 2.25 | 0.0% | 12.4% | 30 |
| 0.00 | 0.00 | 2.00 | 0.00 | 0.00 | 1.16 | 26.00 | 6.00 | 0.00 | 0.76 | 3.00 | 0.50 | 0.00 | 29.16 | 0.0% | 12.4% | 50 |
| 0.00 | 0.60 | 0.80 | 0.00 | 0.00 | 1.16 | 0.74 | 9.00 | 0.00 | 0.76 | 10.00 | 0.00 | 0.00 | 2.7 | 0.0% | 12.4% | 50 |
| 0.00 | 0.60 | 0.80 | 0.00 | 0.00 | 1.16 | 0.74 | 9.00 | 0.00 | 0.76 | 9.00 | 0.00 | 0.00 | 2.7 | 0.0% | 12.4% | 50 |
| 0.00 | 0.60 | 0.80 | 0.00 | 0.00 | 1.16 | 0.74 | 9.00 | 0.00 | 0.76 | 8.00 | 0.00 | 0.00 | 2.7 | 0.0% | 12.4% | 50 |
| 0.00 | 0.00 | 2.00 | 0.00 | 0.00 | 1.16 | 30.00 | 6.00 | 0.00 | 0.76 | 3.00 | 0.50 | 0.00 | 33.16 | 0.0% | 12.4% | 50 |
| 0.00 | 0.60 | 0.80 | 0.00 | 0.00 | 1.16 | 0.74 | 10.00 | 0.00 | 0.76 | 10.00 | 0.00 | 0.00 | 2.7 | 0.0% | 12.4% | 50 |
| 0.00 | 0.60 | 0.80 | 0.00 | 0.00 | 1.16 | 0.74 | 10.00 | 0.00 | 0.76 | 9.00 | 0.00 | 0.00 | 2.7 | 0.0% | 12.4% | 50 |
| 0.00 | 0.50 | 1.00 | 0.50 | 0.00 | 0.75 | 0.50 | 4.00 | 0.00 | 0.50 | 3.00 | 0.50 | 0.00 | 2.25 | 0.0% | 12.4% | 30 |
| 0.00 | 0.60 | 0.80 | 0.00 | 0.00 | 1.16 | 0.74 | 10.00 | 0.00 | 0.76 | 8.00 | 0.00 | 0.00 | 2.7 | 0.0% | 12.4% | 50 |
| 0.00 | 0.20 | 1.30 | 0.50 | 0.00 | 0.75 | 0.70 | 4.50 | 0.00 | 0.44 | 3.00 | 0.36 | 0.00 | 2.75 | 0.1% | 12.5% | 50 |
| 0.00 | 0.00 | 1.50 | 0.00 | 0.00 | 1.16 | 26.00 | 6.00 | 0.00 | 0.76 | 3.00 | 0.50 | 0.00 | 28.66 | 0.0% | 12.5% | 50 |
| 0.00 | 0.20 | 1.40 | 0.50 | 0.00 | 0.75 | 0.70 | 4.50 | 0.00 | 0.44 | 3.00 | 0.36 | 0.00 | 2.85 | 0.3% | 12.5% | 65 |
| 0.00 | 0.00 | 1.50 | 0.00 | 0.00 | 1.16 | 24.00 | 6.00 | 0.00 | 0.76 | 3.00 | 0.50 | 0.00 | 26.66 | 0.0% | 12.5% | 50 |
| 0.00 | 0.00 | 1.50 | 0.00 | 0.00 | 1.16 | 22.00 | 6.00 | 0.00 | 0.76 | 3.00 | 0.50 | 0.00 | 24.66 | 0.0% | 12.6% | 50 |
| 0.00 | 0.00 | 1.40 | 5.04 | 0.00 | 1.16 | 0.74 | 2.00 | 0.00 | 0.76 | 5.00 | 0.00 | 0.00 | 3.3 | 0.0% | 12.7% | 50 |
| 0.00 | 0.20 | 1.50 | 0.50 | 0.00 | 0.75 | 0.00 | 5.00 | 0.00 | 0.00 | 3.00 | 0.00 | 0.00 | 2.25 | 0.0% | 12.7% | 65 |
| 0.00 | 0.40 | 1.00 | 0.00 | 0.00 | 1.16 | 0.74 | 7.00 | 0.00 | 0.76 | 9.00 | 0.00 | 0.00 | 2.9 | 0.0% | 12.8% | 50 |
| 0.00 | 0.00 | 2.00 | 0.00 | 0.00 | 1.16 | 24.00 | 6.00 | 0.00 | 0.76 | 3.00 | 0.50 | 0.00 | 27.16 | 0.0% | 12.8% | 50 |
| 0.00 | 0.40 | 1.00 | 0.00 | 0.00 | 1.16 | 0.74 | 8.00 | 0.00 | 0.76 | 10.00 | 0.00 | 0.00 | 2.9 | 0.0% | 12.8% | 50 |
| 0.00 | 0.40 | 1.00 | 0.00 | 0.00 | 1.16 | 0.74 | 8.00 | 0.00 | 0.76 | 9.00 | 0.00 | 0.00 | 2.9 | 0.0% | 12.8% | 50 |
| 0.00 | 0.00 | 1.40 | 5.04 | 0.00 | 1.16 | 0.74 | 4.00 | 0.00 | 0.76 | 4.00 | 0.00 | 0.00 | 3.3 | 0.0% | 12.9% | 50 |
| 0.00 | 0.40 | 1.00 | 0.00 | 0.00 | 1.16 | 0.74 | 9.00 | 0.00 | 0.76 | 10.00 | 0.00 | 0.00 | 2.9 | 0.0% | 12.9% | 50 |
| 0.00 | 0.40 | 1.00 | 0.00 | 0.00 | 1.16 | 0.74 | 9.00 | 0.00 | 0.76 | 9.00 | 0.00 | 0.00 | 2.9 | 0.0% | 12.9% | 50 |
| 0.00 | 0.40 | 1.00 | 0.00 | 0.00 | 1.16 | 0.74 | 9.00 | 0.00 | 0.76 | 8.00 | 0.00 | 0.00 | 2.9 | 0.0% | 12.9% | 50 |
| 0.00 | 0.20 | 1.30 | 0.50 | 0.00 | 0.75 | 0.70 | 5.00 | 0.00 | 0.44 | 3.00 | 0.36 | 0.00 | 2.75 | 0.0% | 12.9% | 40 |
| 0.00 | 0.00 | 1.50 | 0.00 | 0.00 | 1.16 | 0.74 | 2.00 | 0.00 | 0.76 | 5.00 | 0.00 | 0.00 | 3.4 | 0.0% | 12.9% | 50 |
| 0.00 | 0.40 | 1.00 | 0.00 | 0.00 | 1.16 | 0.74 | 10.00 | 0.00 | 0.76 | 10.00 | 0.00 | 0.00 | 2.9 | 0.0% | 12.9% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 1.00 | 3.00 | 0.00 | 0.00 | 1.16 | 1.00 | 4.00 | 0.00 | 0.76 | 3.00 | 0.50 | 10.00 | 5.16 | 0.0% | 12.9% | 0 |
| 0.00 | 0.40 | 1.00 | 0.00 | 0.00 | 1.16 | 0.74 | 10.00 | 0.00 | 0.76 | 9.00 | 0.00 | 0.00 | 2.9 | 0.0% | 12.9% | 50 |
| 0.00 | 0.40 | 1.00 | 0.00 | 0.00 | 1.16 | 0.74 | 10.00 | 0.00 | 0.76 | 8.00 | 0.00 | 0.00 | 2.9 | 0.0% | 12.9% | 50 |
| 0.00 | 0.00 | 1.50 | 5.04 | 0.00 | 1.16 | 0.74 | 0.00 | 0.00 | 0.76 | 6.00 | 0.00 | 0.00 | 3.4 | 0.0% | 13.0% | 50 |
| 0.00 | 0.20 | 1.40 | 0.50 | 0.00 | 0.75 | 0.70 | 5.00 | 0.00 | 0.44 | 3.00 | 0.36 | 0.00 | 2.85 | 0.2% | 13.0% | 55 |
| 0.00 | 0.00 | 1.50 | 0.00 | 0.00 | 1.16 | 0.74 | 4.00 | 0.00 | 0.76 | 4.00 | 0.00 | 0.00 | 3.4 | 0.0% | 13.1% | 50 |
| 0.00 | 0.20 | 1.50 | 0.50 | 0.00 | 0.75 | 0.70 | 5.00 | 0.00 | 0.44 | 3.00 | 0.36 | 0.00 | 2.95 | 0.3% | 13.1% | 75 |
| 0.00 | 0.00 | 1.50 | 5.04 | 0.00 | 1.16 | 0.74 | 4.00 | 0.00 | 0.76 | 4.00 | 0.00 | 0.00 | 3.4 | 0.0% | 13.1% | 50 |
| 0.00 | 0.00 | 2.00 | 0.00 | 0.00 | 1.16 | 22.00 | 6.00 | 0.00 | 0.76 | 3.00 | 0.50 | 0.00 | 25.16 | 0.0% | 13.2% | 50 |
| 0.00 | 0.00 | 1.50 | 5.04 | 0.00 | 1.16 | 0.74 | 6.00 | 0.00 | 0.76 | 3.00 | 0.00 | 0.00 | 3.4 | 0.0% | 13.2% | 20 |
| 0.00 | 0.50 | 1.00 | 5.04 | 0.00 | 1.16 | 0.74 | 6.00 | 0.00 | 0.76 | 3.00 | 0.00 | 0.00 | 2.9 | 0.0% | 13.2% | 50 |
| 0.00 | 0.50 | 1.00 | 0.00 | 0.00 | 1.16 | 0.74 | 4.00 | 0.00 | 0.76 | 4.00 | 0.00 | 0.00 | 2.9 | 0.3% | 13.2% | 50 |
| 0.00 | 0.00 | 1.40 | 5.04 | 0.00 | 1.16 | 0.74 | 3.00 | 0.00 | 0.76 | 5.00 | 0.00 | 0.00 | 3.3 | 0.0% | 13.3% | 50 |
| 0.00 | 0.20 | 1.20 | 0.00 | 0.00 | 1.16 | 0.74 | 7.00 | 0.00 | 0.76 | 10.00 | 0.00 | 0.00 | 3.1 | 0.0% | 13.3% | 50 |
| 0.00 | 0.50 | 1.00 | 5.04 | 0.00 | 1.16 | 0.74 | 8.00 | 0.00 | 0.76 | 3.00 | 0.00 | 0.00 | 2.9 | 0.0% | 13.3% | 50 |
| 0.00 | 0.20 | 1.20 | 0.00 | 0.00 | 1.16 | 0.74 | 8.00 | 0.00 | 0.76 | 10.00 | 0.00 | 0.00 | 3.1 | 0.0% | 13.3% | 50 |
| 0.00 | 0.20 | 1.20 | 0.00 | 0.00 | 1.16 | 0.74 | 8.00 | 0.00 | 0.76 | 9.00 | 0.00 | 0.00 | 3.1 | 0.0% | 13.3% | 50 |
| 0.00 | 0.00 | 3.00 | 0.00 | 0.00 | 1.16 | 0.74 | 2.00 | 0.00 | 0.76 | 3.00 | 0.50 | 24.00 | 4.9 | 9.2% | 13.3% | 50 |
| 0.00 | 0.20 | 1.20 | 0.00 | 0.00 | 1.16 | 0.74 | 9.00 | 0.00 | 0.76 | 8.00 | 0.00 | 0.00 | 3.1 | 0.0% | 13.4% | 50 |
| 0.00 | 0.20 | 1.20 | 0.00 | 0.00 | 1.16 | 0.74 | 9.00 | 0.00 | 0.76 | 10.00 | 0.00 | 0.00 | 3.1 | 0.0% | 13.4% | 50 |
| 0.00 | 0.20 | 1.20 | 0.00 | 0.00 | 1.16 | 0.74 | 9.00 | 0.00 | 0.76 | 9.00 | 0.00 | 0.00 | 3.1 | 0.0% | 13.4% | 50 |
| 0.00 | 0.50 | 1.07 | 5.04 | 0.00 | 1.16 | 0.74 | 0.00 | 0.00 | 0.76 | 6.00 | 0.00 | 0.00 | 2.97 | 0.0% | 13.4% | 20 |
| 0.00 | 0.00 | 1.40 | 5.04 | 0.00 | 1.16 | 0.74 | 5.00 | 0.00 | 0.76 | 4.00 | 0.00 | 0.00 | 3.3 | 0.0% | 13.4% | 50 |
| 0.00 | 2.00 | 2.50 | 0.00 | 0.00 | 1.16 | 0.74 | 10.00 | 0.00 | 0.76 | 10.00 | 0.00 | 0.00 | 4.4 | 0.0% | 13.4% | 25 |
| 0.00 | 0.20 | 1.20 | 0.00 | 0.00 | 1.16 | 0.74 | 10.00 | 0.00 | 0.76 | 8.00 | 0.00 | 0.00 | 3.1 | 0.0% | 13.4% | 50 |
| 0.00 | 0.20 | 1.20 | 0.00 | 0.00 | 1.16 | 0.74 | 10.00 | 0.00 | 0.76 | 10.00 | 0.00 | 0.00 | 3.1 | 0.0% | 13.4% | 50 |
| 0.00 | 0.20 | 1.20 | 0.00 | 0.00 | 1.16 | 0.74 | 10.00 | 0.00 | 0.76 | 9.00 | 0.00 | 0.00 | 3.1 | 0.0% | 13.4% | 50 |
| 0.00 | 0.00 | 1.50 | 5.04 | 0.00 | 1.16 | 0.74 | 8.00 | 0.00 | 0.76 | 2.00 | 0.00 | 0.00 | 3.4 | 0.0% | 13.4% | 50 |
| 0.00 | 0.50 | 1.00 | 5.04 | 0.00 | 1.16 | 0.74 | 10.00 | 0.00 | 0.76 | 3.00 | 0.00 | 0.00 | 2.9 | 0.0% | 13.5% | 50 |
| 0.00 | 0.00 | 1.40 | 5.04 | 0.00 | 1.16 | 0.74 | 4.00 | 0.00 | 0.76 | 5.00 | 0.00 | 0.00 | 3.3 | 0.0% | 13.5% | 50 |
| 0.00 | 0.00 | 1.50 | 0.00 | 0.00 | 1.16 | 0.00 | 6.00 | 0.00 | 0.76 | 3.00 | 0.50 | 0.00 | 2.66 | 0.0% | 13.5% | 50 |
| 0.00 | 0.00 | 3.00 | 0.00 | 0.00 | 1.16 | 1.00 | 2.00 | 0.00 | 0.76 | 3.00 | 0.50 | 25.00 | 5.16 | 0.0% | 13.5% | 50 |
| 0.00 | 0.00 | 2.00 | 0.00 | 0.00 | 1.16 | 20.00 | 6.00 | 0.00 | 0.76 | 3.00 | 0.50 | 0.00 | 23.16 | 0.0% | 13.5% | 50 |
| 0.00 | 0.00 | 1.50 | 0.00 | 0.00 | 1.16 | 0.74 | 6.00 | 0.00 | 0.76 | 3.00 | 0.50 | 0.00 | 3.4 | 0.0% | 13.6% | 50 |
| 0.00 | 0.00 | 3.00 | 0.00 | 0.00 | 1.16 | 0.74 | 2.00 | 0.00 | 0.76 | 3.00 | 0.50 | 26.00 | 4.9 | 0.0% | 13.6% | 50 |
| 0.00 | 0.00 | 2.00 | 4.00 | 0.00 | 1.16 | 0.74 | 6.00 | 0.00 | 0.76 | 3.00 | 0.00 | 0.00 | 3.9 | 0.0% | 13.6% | 65 |
| 0.00 | 0.80 | 0.80 | 0.00 | 0.00 | 1.16 | 0.74 | 7.00 | 0.00 | 0.76 | 10.00 | 0.00 | 0.00 | 2.7 | 0.0% | 13.7% | 50 |
| 0.00 | 0.00 | 2.00 | 5.04 | 0.00 | 1.16 | 0.74 | 6.00 | 0.00 | 0.76 | 3.00 | 0.00 | 0.00 | 3.9 | 0.0% | 13.7% | 65 |
| 0.00 | 0.80 | 0.80 | 0.00 | 0.00 | 1.16 | 0.74 | 7.00 | 0.00 | 0.76 | 9.00 | 0.00 | 0.00 | 2.7 | 0.0% | 13.7% | 50 |
| 0.00 | 0.00 | 2.00 | 6.00 | 0.00 | 1.16 | 0.74 | 6.00 | 0.00 | 0.76 | 3.00 | 0.00 | 0.00 | 3.9 | 0.0% | 13.7% | 60 |
| 0.00 | 0.00 | 3.00 | 0.00 | 0.00 | 1.16 | 0.74 | 2.00 | 0.00 | 0.76 | 3.00 | 0.50 | 28.00 | 4.9 | 5.6% | 13.7% | 50 |
| 0.00 | 0.80 | 0.80 | 0.00 | 0.00 | 1.16 | 0.74 | 8.00 | 0.00 | 0.76 | 10.00 | 0.00 | 0.00 | 2.7 | 0.0% | 13.7% | 50 |
| 0.00 | 0.80 | 0.80 | 0.00 | 0.00 | 1.16 | 0.74 | 8.00 | 0.00 | 0.76 | 9.00 | 0.00 | 0.00 | 2.7 | 0.0% | 13.7% | 50 |
| 0.00 | 0.80 | 0.80 | 0.00 | 0.00 | 1.16 | 0.74 | 8.00 | 0.00 | 0.76 | 8.00 | 0.00 | 0.00 | 2.7 | 0.0% | 13.7% | 50 |
| 0.00 | 0.80 | 0.80 | 0.00 | 0.00 | 1.16 | 0.74 | 9.00 | 0.00 | 0.76 | 10.00 | 0.00 | 0.00 | 2.7 | 0.0% | 13.8% | 50 |
| 0.00 | 0.50 | 1.07 | 5.04 | 0.00 | 1.16 | 0.74 | 0.00 | 0.00 | 0.76 | 8.00 | 0.00 | 0.00 | 2.97 | 0.0% | 13.8% | 50 |
| 0.00 | 0.80 | 0.80 | 0.00 | 0.00 | 1.16 | 0.74 | 9.00 | 0.00 | 0.76 | 9.00 | 0.00 | 0.00 | 2.7 | 0.0% | 13.8% | 50 |
| 0.00 | 0.80 | 0.80 | 0.00 | 0.00 | 1.16 | 0.74 | 9.00 | 0.00 | 0.76 | 8.00 | 0.00 | 0.00 | 2.7 | 0.0% | 13.8% | 50 |
| 0.00 | 0.80 | 0.80 | 0.00 | 0.00 | 1.16 | 0.74 | 10.00 | 0.00 | 0.76 | 10.00 | 0.00 | 0.00 | 2.7 | 0.0% | 13.8% | 50 |
| 0.00 | 0.80 | 0.80 | 0.00 | 0.00 | 1.16 | 0.74 | 10.00 | 0.00 | 0.76 | 9.00 | 0.00 | 0.00 | 2.7 | 0.0% | 13.8% | 50 |
| 0.00 | 0.00 | 1.40 | 0.00 | 0.00 | 1.16 | 0.74 | 9.00 | 0.00 | 0.76 | 6.00 | 0.00 | 0.00 | 3.3 | 0.0% | 13.8% | 50 |
| 0.00 | 0.00 | 1.40 | 0.00 | 0.00 | 1.16 | 0.74 | 8.00 | 0.00 | 0.76 | 10.00 | 0.00 | 0.00 | 3.3 | 0.0% | 13.8% | 50 |
| 0.00 | 1.00 | 1.00 | 0.50 | 0.00 | 0.75 | 0.50 | 2.00 | 0.00 | 0.50 | 4.00 | 0.50 | 0.00 | 2.25 | 0.0% | 13.8% | 75 |
| 0.00 | 0.80 | 0.80 | 0.00 | 0.00 | 1.16 | 0.74 | 10.00 | 0.00 | 0.76 | 8.00 | 0.00 | 0.00 | 2.7 | 0.0% | 13.8% | 50 |
| 0.00 | 0.00 | 2.00 | 0.00 | 0.00 | 1.16 | 18.00 | 6.00 | 0.00 | 0.76 | 3.00 | 0.50 | 0.00 | 21.16 | 0.0% | 13.8% | 50 |
| 0.00 | 0.00 | 3.00 | 0.00 | 0.00 | 1.16 | 0.74 | 2.00 | 0.00 | 0.76 | 3.00 | 0.50 | 30.00 | 4.9 | 3.0% | 13.8% | 50 |
| 0.00 | 0.00 | 3.00 | 0.00 | 0.00 | 1.16 | 1.00 | 2.00 | 0.00 | 0.76 | 3.00 | 0.50 | 30.00 | 5.16 | 2.4% | 13.9% | 50 |
| 0.00 | 0.00 | 1.40 | 0.00 | 0.00 | 1.16 | 0.74 | 9.00 | 0.00 | 0.76 | 10.00 | 0.00 | 0.00 | 3.3 | 0.0% | 13.9% | 50 |
| 0.00 | 0.00 | 1.40 | 0.00 | 0.00 | 1.16 | 0.74 | 10.00 | 0.00 | 0.76 | 6.00 | 0.00 | 0.00 | 3.3 | 0.0% | 13.9% | 50 |
| 0.00 | 0.50 | 1.07 | 5.04 | 0.00 | 1.16 | 0.74 | 8.00 | 0.00 | 0.76 | 2.00 | 0.00 | 0.00 | 2.97 | 0.4% | 13.9% | 50 |
| 0.00 | 1.50 | 0.50 | 5.04 | 0.00 | 1.16 | 0.74 | 10.00 | 0.00 | 0.76 | 3.00 | 0.00 | 0.00 | 2.4 | 3.6% | 13.9% | 50 |
| 0.00 | 0.50 | 1.07 | 5.04 | 0.00 | 1.16 | 0.74 | 6.00 | 0.00 | 0.76 | 4.00 | 0.00 | 0.00 | 2.97 | 0.0% | 13.9% | 50 |
| 0.00 | 0.00 | 1.40 | 0.00 | 0.00 | 1.16 | 0.74 | 10.00 | 0.00 | 0.76 | 9.00 | 0.00 | 0.00 | 3.3 | 0.0% | 13.9% | 50 |
| 0.00 | 0.00 | 1.40 | 0.00 | 0.00 | 1.16 | 0.74 | 10.00 | 0.00 | 0.76 | 10.00 | 0.00 | 0.00 | 3.3 | 0.0% | 13.9% | 50 |
| 0.00 | 0.00 | 1.50 | 0.00 | 0.00 | 1.16 | 0.74 | 5.00 | 0.00 | 0.76 | 4.00 | 0.00 | 0.00 | 3.4 | 0.0% | 13.9% | 50 |
| 0.00 | 0.50 | 1.07 | 5.04 | 0.00 | 1.16 | 0.74 | 8.00 | 0.00 | 0.76 | 4.00 | 0.00 | 0.00 | 2.97 | 6.5% | 14.0% | 50 |
| 0.00 | 0.00 | 1.60 | 5.04 | 0.00 | 1.16 | 0.74 | 3.00 | 0.00 | 0.76 | 5.00 | 0.00 | 0.00 | 3.5 | 0.0% | 14.0% | 50 |
| 0.00 | 0.60 | 1.00 | 0.00 | 0.00 | 1.16 | 0.74 | 6.00 | 0.00 | 0.76 | 10.00 | 0.00 | 0.00 | 2.9 | 0.0% | 14.1% | 50 |
| 0.00 | 0.00 | 1.50 | 5.04 | 0.00 | 1.16 | 0.74 | 2.00 | 0.00 | 0.76 | 6.00 | 0.00 | 0.00 | 3.4 | 0.0% | 14.1% | 50 |
| 0.00 | 0.60 | 1.00 | 0.00 | 0.00 | 1.16 | 0.74 | 7.00 | 0.00 | 0.76 | 10.00 | 0.00 | 0.00 | 2.9 | 0.0% | 14.2% | 50 |
| 0.00 | 0.00 | 1.60 | 5.04 | 0.00 | 1.16 | 0.74 | 5.00 | 0.00 | 0.76 | 4.00 | 0.00 | 0.00 | 3.5 | 0.0% | 14.2% | 50 |
| 0.00 | 0.60 | 1.00 | 0.00 | 0.00 | 1.16 | 0.74 | 8.00 | 0.00 | 0.76 | 10.00 | 0.00 | 0.00 | 2.9 | 0.0% | 14.2% | 50 |
| 0.00 | 0.60 | 1.00 | 0.00 | 0.00 | 1.16 | 0.74 | 8.00 | 0.00 | 0.76 | 9.00 | 0.00 | 0.00 | 2.9 | 0.0% | 14.2% | 50 |
| 0.00 | 0.00 | 1.50 | 5.04 | 0.00 | 1.16 | 0.74 | 0.00 | 0.00 | 0.76 | 8.00 | 0.00 | 0.00 | 3.4 | 0.0% | 14.2% | 50 |
| 0.00 | 0.60 | 1.00 | 0.00 | 0.00 | 1.16 | 0.74 | 9.00 | 0.00 | 0.76 | 10.00 | 0.00 | 0.00 | 2.9 | 0.0% | 14.3% | 50 |
| 0.00 | 0.50 | 1.07 | 5.04 | 0.00 | 1.16 | 0.74 | 10.00 | 0.00 | 0.76 | 8.00 | 0.00 | 0.00 | 2.97 | 0.0% | 14.3% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.60 | 1.00 | 0.00 | 0.00 | 1.16 | 0.74 | 9.00 | 0.00 | 0.76 | 9.00 | 0.00 | 0.00 | 2.9 | 0.0% | 14.3% | 50 |
| 0.00 | 0.60 | 1.00 | 0.00 | 0.00 | 1.16 | 0.74 | 9.00 | 0.00 | 0.76 | 8.00 | 0.00 | 0.00 | 2.9 | 0.0% | 14.3% | 50 |
| 0.00 | 0.00 | 1.50 | 0.00 | 0.00 | 1.16 | 0.74 | 4.00 | 0.00 | 0.76 | 5.00 | 0.00 | 0.00 | 3.4 | 0.0% | 14.3% | 50 |
| 0.00 | 0.60 | 1.00 | 0.00 | 0.00 | 1.16 | 0.74 | 10.00 | 0.00 | 0.76 | 10.00 | 0.00 | 0.00 | 2.9 | 0.0% | 14.3% | 50 |
| 0.00 | 0.60 | 1.00 | 0.00 | 0.00 | 1.16 | 0.74 | 10.00 | 0.00 | 0.76 | 9.00 | 0.00 | 0.00 | 2.9 | 0.0% | 14.3% | 50 |
| 0.00 | 0.60 | 1.00 | 0.00 | 0.00 | 1.16 | 0.74 | 10.00 | 0.00 | 0.76 | 8.00 | 0.00 | 0.00 | 2.9 | 0.0% | 14.3% | 50 |
| 0.00 | 0.00 | 1.50 | 12.00 | 2.00 | 0.50 | 0.50 | 12.60 | 8.00 | 0.50 | 0.00 | 0.00 | 0.00 | 2.5 | 0.0% | 14.3% | 30 |
| 0.00 | 0.00 | 1.50 | 10.31 | 1.72 | 0.43 | 0.43 | 12.60 | 6.87 | 0.43 | 0.00 | 0.00 | 0.00 | 2.359 | 0.0% | 14.3% | 60 |
| 0.00 | 0.00 | 1.50 | 5.04 | 0.00 | 1.16 | 0.74 | 6.00 | 0.00 | 0.76 | 4.00 | 0.00 | 0.00 | 3.4 | 0.0% | 14.4% | 50 |
| 0.00 | 0.00 | 1.50 | 5.04 | 0.00 | 1.16 | 0.74 | 8.00 | 0.00 | 0.76 | 3.00 | 0.00 | 0.00 | 3.4 | 0.0% | 14.4% | 50 |
| 0.00 | 0.00 | 1.50 | 5.04 | 0.00 | 1.16 | 0.74 | 10.00 | 0.00 | 0.76 | 2.00 | 0.00 | 0.00 | 3.4 | 1.0% | 14.5% | 50 |
| 0.00 | 0.40 | 1.20 | 0.00 | 0.00 | 1.16 | 0.74 | 7.00 | 0.00 | 0.76 | 10.00 | 0.00 | 0.00 | 3.1 | 0.0% | 14.6% | 50 |
| 0.00 | 0.40 | 1.20 | 0.00 | 0.00 | 1.16 | 0.74 | 8.00 | 0.00 | 0.76 | 10.00 | 0.00 | 0.00 | 3.1 | 0.0% | 14.7% | 50 |
| 0.00 | 0.40 | 1.20 | 0.00 | 0.00 | 1.16 | 0.74 | 8.00 | 0.00 | 0.76 | 9.00 | 0.00 | 0.00 | 3.1 | 0.0% | 14.7% | 50 |
| 0.00 | 0.00 | 1.50 | 5.04 | 0.00 | 1.16 | 0.74 | 8.00 | 0.00 | 0.76 | 10.00 | 0.00 | 0.00 | 3.4 | 0.0% | 14.7% | 50 |
| 0.00 | 0.40 | 1.20 | 0.00 | 0.00 | 1.16 | 0.74 | 9.00 | 0.00 | 0.76 | 10.00 | 0.00 | 0.00 | 3.1 | 0.0% | 14.7% | 50 |
| 0.00 | 0.40 | 1.20 | 0.00 | 0.00 | 1.16 | 0.74 | 9.00 | 0.00 | 0.76 | 9.00 | 0.00 | 0.00 | 3.1 | 0.0% | 14.7% | 50 |
| 0.00 | 0.00 | 1.60 | 5.04 | 0.00 | 1.16 | 0.74 | 4.00 | 0.00 | 0.76 | 5.00 | 0.00 | 0.00 | 3.5 | 0.0% | 14.8% | 50 |
| 0.00 | 1.00 | 1.00 | 0.50 | 0.00 | 0.75 | 0.50 | 1.00 | 0.00 | 0.50 | 5.00 | 0.50 | 0.00 | 2.25 | 0.0% | 14.8% | 50 |
| 0.00 | 1.00 | 1.00 | 0.50 | 0.00 | 0.75 | 0.50 | 3.00 | 0.00 | 0.50 | 4.00 | 0.50 | 0.00 | 2.25 | 0.0% | 14.8% | 55 |
| 0.00 | 0.40 | 1.20 | 0.00 | 0.00 | 1.16 | 0.74 | 10.00 | 0.00 | 0.76 | 10.00 | 0.00 | 0.00 | 3.1 | 0.0% | 14.8% | 50 |
| 0.00 | 0.40 | 1.20 | 0.00 | 0.00 | 1.16 | 0.74 | 10.00 | 0.00 | 0.76 | 8.00 | 0.00 | 0.00 | 3.1 | 0.0% | 14.8% | 50 |
| 0.00 | 0.40 | 1.20 | 0.00 | 0.00 | 1.16 | 0.74 | 10.00 | 0.00 | 0.76 | 9.00 | 0.00 | 0.00 | 3.1 | 0.0% | 14.8% | 50 |
| 0.00 | 0.00 | 1.50 | 5.04 | 0.00 | 1.16 | 0.74 | 10.00 | 0.00 | 0.76 | 8.00 | 0.00 | 0.00 | 3.4 | 0.0% | 14.8% | 50 |
| 0.00 | 0.00 | 1.50 | 5.04 | 0.00 | 1.16 | 0.74 | 10.00 | 0.00 | 0.76 | 10.00 | 0.00 | 0.00 | 3.4 | 0.0% | 14.8% | 50 |
| 0.00 | 1.00 | 1.00 | 0.00 | 0.00 | 1.16 | 1.00 | 6.00 | 0.00 | 0.76 | 3.00 | 0.50 | 20.00 | 3.16 | 6.9% | 14.9% | 50 |
| 0.00 | 1.00 | 1.07 | 5.04 | 0.00 | 1.16 | 0.74 | 4.00 | 0.00 | 0.76 | 4.00 | 0.00 | 0.00 | 2.97 | 0.0% | 14.9% | 50 |
| 0.00 | 1.00 | 0.80 | 0.00 | 0.00 | 1.16 | 0.74 | 6.00 | 0.00 | 0.76 | 10.00 | 0.00 | 0.00 | 2.7 | 0.0% | 15.0% | 50 |
| 0.00 | 1.00 | 0.80 | 0.00 | 0.00 | 1.16 | 0.74 | 7.00 | 0.00 | 0.76 | 10.00 | 0.00 | 0.00 | 2.7 | 0.0% | 15.0% | 50 |
| 0.00 | 1.00 | 0.80 | 0.00 | 0.00 | 1.16 | 0.74 | 7.00 | 0.00 | 0.76 | 9.00 | 0.00 | 0.00 | 2.7 | 0.0% | 15.0% | 50 |
| 0.00 | 1.00 | 1.00 | 0.00 | 0.00 | 1.16 | 1.00 | 6.00 | 0.00 | 0.76 | 3.00 | 0.50 | 25.00 | 3.16 | 7.9% | 15.0% | 50 |
| 0.00 | 1.00 | 0.80 | 0.00 | 0.00 | 1.16 | 0.74 | 8.00 | 0.00 | 0.76 | 10.00 | 0.00 | 0.00 | 2.7 | 0.0% | 15.1% | 50 |
| 0.00 | 1.00 | 0.80 | 0.00 | 0.00 | 1.16 | 0.74 | 8.00 | 0.00 | 0.76 | 6.00 | 0.00 | 0.00 | 2.7 | 0.0% | 15.1% | 50 |
| 0.00 | 1.00 | 0.80 | 0.00 | 0.00 | 1.16 | 0.74 | 8.00 | 0.00 | 0.76 | 9.00 | 0.00 | 0.00 | 2.7 | 0.0% | 15.1% | 50 |
| 0.00 | 1.00 | 0.80 | 0.00 | 0.00 | 1.16 | 0.74 | 9.00 | 0.00 | 0.76 | 10.00 | 0.00 | 0.00 | 2.7 | 0.0% | 15.1% | 50 |
| 0.00 | 1.00 | 0.80 | 0.00 | 0.00 | 1.16 | 0.74 | 9.00 | 0.00 | 0.76 | 6.00 | 0.00 | 0.00 | 2.7 | 0.0% | 15.1% | 50 |
| 0.00 | 1.00 | 0.80 | 0.00 | 0.00 | 1.16 | 0.74 | 9.00 | 0.00 | 0.76 | 9.00 | 0.00 | 0.00 | 2.7 | 0.0% | 15.1% | 50 |
| 0.00 | 0.00 | 2.00 | 0.50 | 0.00 | 0.75 | 0.50 | 5.00 | 0.00 | 0.50 | 4.00 | 0.50 | 0.00 | 3.25 | 0.0% | 15.2% | 60 |
| 0.00 | 1.00 | 0.80 | 0.00 | 0.00 | 1.16 | 0.74 | 10.00 | 0.00 | 0.76 | 10.00 | 0.00 | 0.00 | 2.7 | 0.0% | 15.2% | 50 |
| 0.00 | 1.00 | 0.80 | 0.00 | 0.00 | 1.16 | 0.74 | 10.00 | 0.00 | 0.76 | 9.00 | 0.00 | 0.00 | 2.7 | 0.0% | 15.2% | 50 |
| 0.00 | 0.20 | 1.40 | 0.00 | 0.00 | 1.16 | 0.74 | 8.00 | 0.00 | 0.76 | 10.00 | 0.00 | 0.00 | 3.3 | 0.0% | 15.2% | 50 |
| 0.00 | 1.00 | 0.80 | 0.00 | 0.00 | 1.16 | 0.74 | 10.00 | 0.00 | 0.76 | 8.00 | 0.00 | 0.00 | 2.7 | 0.0% | 15.2% | 50 |
| 0.00 | 0.00 | 1.80 | 0.00 | 0.00 | 1.16 | 0.74 | 4.00 | 0.00 | 0.76 | 5.00 | 0.00 | 0.00 | 3.7 | 0.0% | 15.2% | 50 |
| 0.00 | 0.20 | 1.40 | 0.00 | 0.00 | 1.16 | 0.74 | 9.00 | 0.00 | 0.76 | 9.00 | 0.00 | 0.00 | 3.3 | 0.0% | 15.2% | 50 |
| 0.00 | 1.00 | 1.00 | 0.00 | 0.00 | 1.16 | 1.00 | 6.00 | 0.00 | 0.76 | 3.00 | 0.50 | 30.00 | 3.16 | 8.9% | 15.2% | 50 |
| 0.00 | 0.20 | 1.40 | 0.00 | 0.00 | 1.16 | 0.74 | 9.00 | 0.00 | 0.76 | 10.00 | 0.00 | 0.00 | 3.3 | 0.0% | 15.2% | 50 |
| 0.00 | 0.00 | 1.60 | 5.04 | 0.00 | 1.16 | 0.74 | 5.00 | 0.00 | 0.76 | 5.00 | 0.00 | 0.00 | 3.5 | 0.0% | 15.2% | 50 |
| 0.00 | 0.20 | 1.40 | 0.00 | 0.00 | 1.16 | 0.74 | 10.00 | 0.00 | 0.76 | 9.00 | 0.00 | 0.00 | 3.3 | 0.0% | 15.3% | 50 |
| 0.00 | 0.20 | 1.40 | 0.00 | 0.00 | 1.16 | 0.74 | 10.00 | 0.00 | 0.76 | 10.00 | 0.00 | 0.00 | 3.3 | 0.0% | 15.3% | 50 |
| 0.00 | 1.00 | 1.07 | 5.04 | 0.00 | 1.16 | 0.74 | 0.00 | 0.00 | 0.76 | 6.00 | 0.00 | 0.00 | 2.97 | 0.0% | 15.3% | 50 |
| 0.00 | 0.80 | 1.00 | 0.00 | 0.00 | 1.16 | 0.74 | 7.00 | 0.00 | 0.76 | 6.00 | 0.00 | 0.00 | 2.9 | 0.0% | 15.5% | 50 |
| 0.00 | 0.80 | 1.00 | 0.00 | 0.00 | 1.16 | 0.74 | 7.00 | 0.00 | 0.76 | 10.00 | 0.00 | 0.00 | 2.9 | 0.0% | 15.5% | 50 |
| 0.00 | 0.80 | 1.00 | 0.00 | 0.00 | 1.16 | 0.74 | 8.00 | 0.00 | 0.76 | 6.00 | 0.00 | 0.00 | 2.9 | 0.0% | 15.5% | 50 |
| 0.00 | 0.80 | 1.00 | 0.00 | 0.00 | 1.16 | 0.74 | 8.00 | 0.00 | 0.76 | 10.00 | 0.00 | 0.00 | 2.9 | 0.0% | 15.5% | 50 |
| 0.00 | 0.80 | 1.00 | 0.00 | 0.00 | 1.16 | 0.74 | 8.00 | 0.00 | 0.76 | 9.00 | 0.00 | 0.00 | 2.9 | 0.0% | 15.6% | 50 |
| 0.00 | 1.00 | 1.00 | 0.50 | 0.00 | 0.75 | 0.50 | 2.00 | 0.00 | 0.50 | 5.00 | 0.50 | 0.00 | 2.25 | 0.0% | 15.6% | 35 |
| 0.00 | 0.80 | 1.00 | 0.00 | 0.00 | 1.16 | 0.74 | 9.00 | 0.00 | 0.76 | 6.00 | 0.00 | 0.00 | 2.9 | 0.0% | 15.6% | 50 |
| 0.00 | 0.80 | 1.00 | 0.00 | 0.00 | 1.16 | 0.74 | 9.00 | 0.00 | 0.76 | 10.00 | 0.00 | 0.00 | 2.9 | 0.0% | 15.6% | 50 |
| 0.00 | 0.80 | 1.00 | 0.00 | 0.00 | 1.16 | 0.74 | 9.00 | 0.00 | 0.76 | 9.00 | 0.00 | 0.00 | 2.9 | 0.0% | 15.6% | 50 |
| 0.00 | 1.00 | 1.00 | 0.50 | 0.00 | 0.75 | 0.50 | 4.00 | 0.00 | 0.50 | 4.00 | 0.50 | 0.00 | 2.25 | 0.0% | 15.6% | 35 |
| 0.00 | 0.80 | 1.00 | 0.00 | 0.00 | 1.16 | 0.74 | 10.00 | 0.00 | 0.76 | 6.00 | 0.00 | 0.00 | 2.9 | 0.0% | 15.7% | 50 |
| 0.00 | 0.80 | 1.00 | 0.00 | 0.00 | 1.16 | 0.74 | 10.00 | 0.00 | 0.76 | 10.00 | 0.00 | 0.00 | 2.9 | 0.0% | 15.7% | 50 |
| 0.00 | 0.80 | 1.00 | 0.00 | 0.00 | 1.16 | 0.74 | 10.00 | 0.00 | 0.76 | 9.00 | 0.00 | 0.00 | 2.9 | 0.0% | 15.7% | 50 |
| 0.00 | 0.00 | 2.00 | 2.00 | 0.00 | 1.16 | 0.74 | 8.00 | 0.00 | 0.76 | 3.00 | 0.00 | 0.00 | 3.9 | 0.0% | 15.7% | 45 |
| 0.00 | 0.00 | 2.00 | 4.00 | 0.00 | 1.16 | 0.74 | 8.00 | 0.00 | 0.76 | 3.00 | 0.00 | 0.00 | 3.9 | 0.0% | 15.7% | 40 |
| 0.00 | 0.00 | 1.60 | 0.00 | 0.00 | 1.16 | 0.74 | 10.00 | 0.00 | 0.76 | 10.00 | 0.00 | 0.00 | 3.5 | 0.0% | 15.8% | 50 |
| 0.00 | 0.60 | 1.20 | 0.00 | 0.00 | 1.16 | 0.74 | 7.00 | 0.00 | 0.76 | 10.00 | 0.00 | 0.00 | 3.1 | 0.0% | 16.0% | 50 |
| 0.00 | 0.60 | 1.20 | 0.00 | 0.00 | 1.16 | 0.74 | 8.00 | 0.00 | 0.76 | 6.00 | 0.00 | 0.00 | 3.1 | 0.0% | 16.0% | 50 |
| 0.00 | 0.60 | 1.20 | 0.00 | 0.00 | 1.16 | 0.74 | 8.00 | 0.00 | 0.76 | 10.00 | 0.00 | 0.00 | 3.1 | 0.0% | 16.0% | 50 |
| 0.00 | 0.60 | 1.20 | 0.00 | 0.00 | 1.16 | 0.74 | 9.00 | 0.00 | 0.76 | 6.00 | 0.00 | 0.00 | 3.1 | 0.0% | 16.1% | 50 |
| 0.00 | 0.60 | 1.20 | 0.00 | 0.00 | 1.16 | 0.74 | 9.00 | 0.00 | 0.76 | 10.00 | 0.00 | 0.00 | 3.1 | 0.0% | 16.1% | 50 |
| 0.00 | 0.60 | 1.20 | 0.00 | 0.00 | 1.16 | 0.74 | 9.00 | 0.00 | 0.76 | 9.00 | 0.00 | 0.00 | 3.1 | 0.0% | 16.1% | 50 |
| 0.00 | 0.60 | 1.20 | 0.00 | 0.00 | 1.16 | 0.74 | 10.00 | 0.00 | 0.76 | 6.00 | 0.00 | 0.00 | 3.1 | 0.0% | 16.1% | 50 |
| 0.00 | 0.00 | 1.80 | 0.00 | 0.00 | 1.16 | 0.74 | 5.00 | 0.00 | 0.76 | 5.00 | 0.00 | 0.00 | 3.7 | 0.0% | 16.1% | 50 |
| 0.00 | 0.50 | 1.50 | 5.04 | 0.00 | 1.16 | 0.74 | 8.00 | 0.00 | 0.76 | 3.00 | 0.00 | 0.00 | 3.4 | 1.9% | 16.1% | 50 |
| 0.00 | 0.60 | 1.20 | 0.00 | 0.00 | 1.16 | 0.74 | 10.00 | 0.00 | 0.76 | 10.00 | 0.00 | 0.00 | 3.1 | 0.0% | 16.2% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.60 | 1.20 | 0.00 | 0.00 | 1.16 | 0.74 | 10.00 | 0.00 | 0.76 | 9.00 | 0.00 | 0.00 | 3.1 | 0.0% | 16.2% | 50 |
| 0.00 | 0.20 | 3.00 | 0.50 | 0.00 | 0.75 | 0.70 | 6.00 | 0.00 | 0.44 | 4.00 | 0.36 | 0.00 | 4.45 | 0.0% | 16.3% | 0 |
| 0.00 | 0.40 | 1.40 | 0.00 | 0.00 | 1.16 | 0.74 | 9.00 | 0.00 | 0.76 | 6.00 | 0.00 | 0.00 | 3.3 | 0.0% | 16.5% | 50 |
| 0.00 | 0.40 | 1.40 | 0.00 | 0.00 | 1.16 | 0.74 | 8.00 | 0.00 | 0.76 | 10.00 | 0.00 | 0.00 | 3.3 | 0.0% | 16.5% | 50 |
| 0.00 | 1.00 | 1.00 | 0.00 | 0.00 | 1.16 | 0.74 | 4.00 | 0.00 | 0.76 | 5.00 | 0.00 | 0.00 | 2.9 | 0.1% | 16.5% | 50 |
| 0.00 | 2.00 | 1.00 | 0.00 | 0.00 | 1.16 | 1.00 | 6.00 | 0.00 | 0.76 | 3.00 | 0.50 | 20.00 | 3.16 | 2.5% | 16.6% | 50 |
| 0.00 | 0.40 | 1.40 | 0.00 | 0.00 | 1.16 | 0.74 | 10.00 | 0.00 | 0.76 | 6.00 | 0.00 | 0.00 | 3.3 | 0.0% | 16.6% | 50 |
| 0.00 | 0.40 | 1.40 | 0.00 | 0.00 | 1.16 | 0.74 | 9.00 | 0.00 | 0.76 | 10.00 | 0.00 | 0.00 | 3.3 | 0.0% | 16.6% | 50 |
| 0.00 | 0.40 | 1.40 | 0.00 | 0.00 | 1.16 | 0.74 | 10.00 | 0.00 | 0.76 | 9.00 | 0.00 | 0.00 | 3.3 | 0.0% | 16.6% | 50 |
| 0.00 | 0.40 | 1.40 | 0.00 | 0.00 | 1.16 | 0.74 | 10.00 | 0.00 | 0.76 | 10.00 | 0.00 | 0.00 | 3.3 | 0.0% | 16.6% | 50 |
| 0.00 | 1.00 | 1.00 | 5.04 | 0.00 | 1.16 | 0.74 | 8.00 | 0.00 | 0.76 | 3.00 | 0.00 | 0.00 | 2.9 | 1.1% | 16.6% | 50 |
| 0.00 | 1.00 | 1.07 | 5.04 | 0.00 | 1.16 | 0.74 | 2.00 | 0.00 | 0.76 | 6.00 | 0.00 | 0.00 | 2.97 | 0.0% | 16.7% | 20 |
| 0.00 | 1.00 | 1.00 | 0.00 | 0.00 | 1.16 | 0.74 | 7.00 | 0.00 | 0.76 | 6.00 | 0.00 | 0.00 | 2.9 | 0.0% | 16.8% | 50 |
| 0.00 | 1.00 | 1.00 | 0.00 | 0.00 | 1.16 | 0.74 | 7.00 | 0.00 | 0.76 | 10.00 | 0.00 | 0.00 | 2.9 | 0.0% | 16.8% | 50 |
| 0.00 | 1.00 | 1.00 | 0.00 | 0.00 | 1.16 | 0.74 | 8.00 | 0.00 | 0.76 | 6.00 | 0.00 | 0.00 | 2.9 | 0.0% | 16.8% | 50 |
| 0.00 | 1.00 | 1.00 | 0.00 | 0.00 | 1.16 | 0.74 | 8.00 | 0.00 | 0.76 | 10.00 | 0.00 | 0.00 | 2.9 | 0.0% | 16.9% | 50 |
| 0.00 | 1.00 | 1.00 | 0.00 | 0.00 | 1.16 | 0.74 | 9.00 | 0.00 | 0.76 | 6.00 | 0.00 | 0.00 | 2.9 | 0.0% | 16.9% | 50 |
| 0.00 | 1.00 | 1.00 | 0.00 | 0.00 | 1.16 | 0.74 | 9.00 | 0.00 | 0.76 | 10.00 | 0.00 | 0.00 | 2.9 | 0.0% | 16.9% | 50 |
| 0.00 | 1.00 | 1.00 | 0.00 | 0.00 | 1.16 | 0.74 | 9.00 | 0.00 | 0.76 | 9.00 | 0.00 | 0.00 | 2.9 | 0.0% | 16.9% | 50 |
| 0.00 | 0.20 | 1.60 | 0.00 | 0.00 | 1.16 | 0.74 | 9.00 | 0.00 | 0.76 | 6.00 | 0.00 | 0.00 | 3.5 | 0.0% | 17.0% | 50 |
| 0.00 | 1.00 | 1.00 | 0.00 | 0.00 | 1.16 | 0.74 | 10.00 | 0.00 | 0.76 | 6.00 | 0.00 | 0.00 | 2.9 | 0.0% | 17.0% | 50 |
| 0.00 | 1.00 | 1.00 | 0.00 | 0.00 | 1.16 | 0.74 | 10.00 | 0.00 | 0.76 | 10.00 | 0.00 | 0.00 | 2.9 | 0.0% | 17.0% | 50 |
| 0.00 | 1.00 | 1.00 | 0.00 | 0.00 | 1.16 | 0.74 | 10.00 | 0.00 | 0.76 | 9.00 | 0.00 | 0.00 | 2.9 | 0.0% | 17.0% | 50 |
| 0.00 | 0.20 | 1.60 | 0.00 | 0.00 | 1.16 | 0.74 | 10.00 | 0.00 | 0.76 | 6.00 | 0.00 | 0.00 | 3.5 | 0.0% | 17.0% | 50 |
| 0.00 | 0.20 | 1.60 | 0.00 | 0.00 | 1.16 | 0.74 | 9.00 | 0.00 | 0.76 | 10.00 | 0.00 | 0.00 | 3.5 | 0.0% | 17.1% | 50 |
| 0.00 | 1.00 | 1.07 | 5.04 | 0.00 | 1.16 | 0.74 | 6.00 | 0.00 | 0.76 | 4.00 | 0.00 | 0.00 | 2.97 | 0.0% | 17.1% | 50 |
| 0.00 | 1.00 | 1.07 | 5.04 | 0.00 | 1.16 | 0.74 | 2.00 | 0.00 | 0.76 | 8.00 | 0.00 | 0.00 | 2.97 | 0.1% | 17.1% | 50 |
| 0.00 | 0.20 | 1.60 | 0.00 | 0.00 | 1.16 | 0.74 | 10.00 | 0.00 | 0.76 | 10.00 | 0.00 | 0.00 | 3.5 | 0.0% | 17.1% | 50 |
| 0.00 | 0.00 | 2.00 | 5.04 | 0.00 | 1.16 | 0.74 | 4.00 | 0.00 | 0.76 | 6.00 | 0.00 | 0.00 | 3.9 | 0.0% | 17.2% | 50 |
| 0.00 | 1.00 | 1.07 | 5.04 | 0.00 | 1.16 | 0.74 | 8.00 | 0.00 | 0.76 | 4.00 | 0.00 | 0.00 | 2.97 | 3.2% | 17.3% | 50 |
| 0.00 | 0.80 | 1.20 | 0.00 | 0.00 | 1.16 | 0.74 | 8.00 | 0.00 | 0.76 | 6.00 | 0.00 | 0.00 | 3.1 | 0.0% | 17.3% | 50 |
| 0.00 | 0.80 | 1.20 | 0.00 | 0.00 | 1.16 | 0.74 | 8.00 | 0.00 | 0.76 | 10.00 | 0.00 | 0.00 | 3.1 | 0.0% | 17.4% | 50 |
| 0.00 | 0.80 | 1.20 | 0.00 | 0.00 | 1.16 | 0.74 | 9.00 | 0.00 | 0.76 | 6.00 | 0.00 | 0.00 | 3.1 | 0.0% | 17.4% | 50 |
| 0.00 | 0.80 | 1.20 | 0.00 | 0.00 | 1.16 | 0.74 | 9.00 | 0.00 | 0.76 | 10.00 | 0.00 | 0.00 | 3.1 | 0.0% | 17.4% | 50 |
| 0.00 | 0.80 | 1.20 | 0.00 | 0.00 | 1.16 | 0.74 | 10.00 | 0.00 | 0.76 | 6.00 | 0.00 | 0.00 | 3.1 | 0.0% | 17.4% | 50 |
| 0.00 | 1.00 | 1.07 | 5.04 | 0.00 | 1.16 | 0.74 | 10.00 | 0.00 | 0.76 | 4.00 | 0.00 | 0.00 | 2.97 | 0.0% | 17.4% | 50 |
| 0.00 | 0.80 | 1.20 | 0.00 | 0.00 | 1.16 | 0.74 | 10.00 | 0.00 | 0.76 | 10.00 | 0.00 | 0.00 | 3.1 | 0.0% | 17.5% | 50 |
| 0.00 | 0.80 | 1.20 | 0.00 | 0.00 | 1.16 | 0.74 | 10.00 | 0.00 | 0.76 | 9.00 | 0.00 | 0.00 | 3.1 | 0.0% | 17.5% | 50 |
| 0.00 | 0.00 | 2.00 | 5.04 | 0.00 | 1.16 | 0.74 | 8.00 | 0.00 | 0.76 | 4.00 | 0.00 | 0.00 | 3.9 | 0.0% | 17.6% | 50 |
| 0.00 | 1.00 | 1.07 | 5.04 | 0.00 | 1.16 | 0.74 | 10.00 | 0.00 | 0.76 | 8.00 | 0.00 | 0.00 | 2.97 | 0.0% | 17.6% | 50 |
| 0.00 | 0.00 | 2.00 | 5.04 | 0.00 | 1.16 | 0.74 | 10.00 | 0.00 | 0.76 | 3.00 | 0.00 | 0.00 | 3.9 | 0.0% | 17.7% | 20 |
| 0.00 | 0.00 | 2.00 | 0.00 | 0.00 | 1.16 | 0.74 | 10.00 | 0.00 | 0.76 | 3.00 | 0.00 | 0.00 | 3.9 | 0.0% | 17.7% | 20 |
| 0.00 | 0.00 | 2.50 | 4.00 | 0.00 | 1.16 | 0.74 | 4.00 | 0.00 | 0.76 | 6.00 | 0.00 | 0.00 | 4.4 | 0.0% | 17.8% | 70 |
| 0.00 | 0.00 | 2.00 | 4.00 | 0.00 | 1.16 | 0.74 | 10.00 | 0.00 | 0.76 | 3.00 | 0.00 | 0.00 | 3.9 | 0.0% | 17.8% | 50 |
| 0.00 | 0.00 | 2.00 | 2.00 | 0.00 | 1.16 | 0.74 | 10.00 | 0.00 | 0.76 | 3.00 | 0.00 | 0.00 | 3.9 | 0.0% | 17.8% | 50 |
| 0.00 | 0.60 | 1.40 | 0.00 | 0.00 | 1.16 | 0.74 | 9.00 | 0.00 | 0.76 | 6.00 | 0.00 | 0.00 | 3.3 | 0.0% | 17.8% | 50 |
| 0.00 | 0.50 | 1.50 | 5.04 | 0.00 | 1.16 | 0.74 | 10.00 | 0.00 | 0.76 | 3.00 | 0.00 | 0.00 | 3.4 | 0.0% | 17.9% | 50 |
| 0.00 | 0.60 | 1.40 | 0.00 | 0.00 | 1.16 | 0.74 | 10.00 | 0.00 | 0.76 | 6.00 | 0.00 | 0.00 | 3.3 | 0.0% | 17.9% | 50 |
| 0.00 | 0.60 | 1.40 | 0.00 | 0.00 | 1.16 | 0.74 | 9.00 | 0.00 | 0.76 | 10.00 | 0.00 | 0.00 | 3.3 | 0.0% | 17.9% | 50 |
| 0.00 | 0.60 | 1.40 | 0.00 | 0.00 | 1.16 | 0.74 | 10.00 | 0.00 | 0.76 | 9.00 | 0.00 | 0.00 | 3.3 | 0.0% | 18.0% | 50 |
| 0.00 | 0.60 | 1.40 | 0.00 | 0.00 | 1.16 | 0.74 | 10.00 | 0.00 | 0.76 | 10.00 | 0.00 | 0.00 | 3.3 | 0.0% | 18.0% | 50 |
| 0.00 | 0.00 | 2.50 | 4.00 | 0.00 | 1.16 | 0.74 | 8.00 | 0.00 | 0.76 | 4.00 | 0.00 | 0.00 | 4.4 | 0.0% | 18.0% | 70 |
| 0.00 | 1.50 | 1.07 | 5.04 | 0.00 | 1.16 | 0.74 | 2.00 | 0.00 | 0.76 | 6.00 | 0.00 | 0.00 | 2.97 | 0.0% | 18.1% | 50 |
| 0.00 | 0.20 | 1.80 | 0.50 | 0.00 | 0.75 | 0.70 | 5.00 | 0.00 | 0.44 | 6.00 | 0.36 | 0.00 | 3.25 | 0.0% | 18.2% | 50 |
| 0.00 | 0.00 | 2.50 | 4.00 | 0.00 | 1.16 | 0.74 | 10.00 | 0.00 | 0.76 | 3.00 | 0.00 | 0.00 | 4.4 | 0.0% | 18.2% | 65 |
| 0.00 | 0.00 | 2.00 | 5.04 | 0.00 | 1.16 | 0.74 | 2.00 | 0.00 | 0.76 | 8.00 | 0.00 | 0.00 | 3.9 | 0.0% | 18.2% | 50 |
| 0.00 | 0.00 | 2.50 | 5.04 | 0.00 | 1.16 | 0.74 | 10.00 | 0.00 | 0.76 | 3.00 | 0.00 | 0.00 | 4.4 | 0.0% | 18.2% | 65 |
| 0.00 | 0.00 | 2.50 | 6.00 | 0.00 | 1.16 | 0.74 | 10.00 | 0.00 | 0.76 | 3.00 | 0.00 | 0.00 | 4.4 | 0.0% | 18.2% | 60 |
| 0.00 | 0.20 | 1.80 | 0.50 | 0.00 | 0.75 | 0.70 | 4.00 | 0.00 | 0.44 | 7.00 | 0.36 | 0.00 | 3.25 | 0.0% | 18.3% | 50 |
| 0.00 | 0.00 | 2.50 | 0.00 | 0.00 | 1.16 | 0.74 | 5.00 | 0.00 | 0.76 | 6.00 | 0.00 | 0.00 | 4.4 | 0.0% | 18.3% | 75 |
| 0.00 | 0.20 | 1.80 | 0.50 | 0.00 | 0.75 | 0.70 | 7.00 | 0.00 | 0.44 | 5.00 | 0.36 | 0.00 | 3.25 | 0.0% | 18.3% | 50 |
| 0.00 | 0.40 | 1.60 | 0.00 | 0.00 | 1.16 | 0.74 | 10.00 | 0.00 | 0.76 | 6.00 | 0.00 | 0.00 | 3.5 | 0.0% | 18.3% | 50 |
| 0.00 | 0.40 | 1.60 | 0.00 | 0.00 | 1.16 | 0.74 | 10.00 | 0.00 | 0.76 | 10.00 | 0.00 | 0.00 | 3.5 | 0.0% | 18.4% | 50 |
| 0.00 | 0.20 | 1.80 | 0.00 | 0.00 | 1.16 | 0.74 | 6.00 | 0.00 | 0.76 | 6.00 | 0.00 | 0.00 | 3.7 | 0.0% | 18.4% | 50 |
| 0.00 | 0.20 | 1.80 | 0.50 | 0.00 | 0.75 | 0.70 | 6.00 | 0.00 | 0.44 | 6.00 | 0.36 | 0.00 | 3.25 | 0.0% | 18.5% | 50 |
| 0.00 | 0.20 | 1.80 | 0.50 | 0.00 | 0.75 | 0.70 | 5.00 | 0.00 | 0.44 | 7.00 | 0.36 | 0.00 | 3.25 | 0.0% | 18.5% | 50 |
| 0.00 | 0.00 | 2.00 | 5.04 | 0.00 | 1.16 | 0.74 | 0.00 | 0.00 | 0.76 | 10.00 | 0.00 | 0.00 | 3.9 | 0.0% | 18.5% | 50 |
| 0.00 | 0.00 | 2.00 | 5.04 | 0.00 | 1.16 | 0.74 | 6.00 | 0.00 | 0.76 | 6.00 | 0.00 | 0.00 | 3.9 | 0.0% | 18.6% | 50 |
| 0.00 | 1.00 | 1.20 | 0.00 | 0.00 | 1.16 | 0.74 | 8.00 | 0.00 | 0.76 | 7.00 | 0.00 | 0.00 | 3.1 | 0.0% | 18.6% | 50 |
| 0.00 | 0.00 | 2.00 | 0.00 | 0.00 | 1.16 | 0.74 | 6.00 | 0.00 | 0.76 | 6.00 | 0.00 | 0.00 | 3.9 | 0.0% | 18.6% | 50 |
| 0.00 | 0.20 | 1.80 | 0.50 | 0.00 | 0.75 | 0.70 | 8.00 | 0.00 | 0.44 | 5.00 | 0.36 | 0.00 | 3.25 | 0.0% | 18.6% | 50 |
| 0.00 | 1.00 | 1.20 | 0.00 | 0.00 | 1.16 | 0.74 | 9.00 | 0.00 | 0.76 | 6.00 | 0.00 | 0.00 | 3.1 | 0.0% | 18.6% | 50 |
| 0.00 | 1.00 | 1.20 | 0.00 | 0.00 | 1.16 | 0.74 | 9.00 | 0.00 | 0.76 | 7.00 | 0.00 | 0.00 | 3.1 | 0.0% | 18.7% | 50 |
| 0.00 | 0.00 | 2.50 | 4.00 | 0.00 | 1.16 | 0.74 | 5.00 | 0.00 | 0.76 | 6.00 | 0.00 | 0.00 | 4.4 | 0.0% | 18.7% | 60 |
| 0.00 | 1.00 | 1.20 | 0.00 | 0.00 | 1.16 | 0.74 | 9.00 | 0.00 | 0.76 | 10.00 | 0.00 | 0.00 | 3.1 | 0.0% | 18.7% | 50 |
| 0.00 | 1.00 | 1.20 | 0.00 | 0.00 | 1.16 | 0.74 | 10.00 | 0.00 | 0.76 | 6.00 | 0.00 | 0.00 | 3.1 | 0.0% | 18.7% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 1.00 | 1.20 | 0.00 | 0.00 | 1.16 | 0.74 | 10.00 | 0.00 | 0.76 | 7.00 | 0.00 | 0.00 | 3.1 | 0.0% | 18.8% | 50 |
| 0.00 | 1.00 | 1.20 | 0.00 | 0.00 | 1.16 | 0.74 | 10.00 | 0.00 | 0.76 | 10.00 | 0.00 | 0.00 | 3.1 | 0.0% | 18.8% | 50 |
| 0.00 | 0.00 | 2.00 | 5.04 | 0.00 | 1.16 | 0.74 | 4.00 | 0.00 | 0.76 | 8.00 | 0.00 | 0.00 | 3.9 | 0.0% | 18.8% | 50 |
| 0.00 | 0.00 | 2.50 | 0.00 | 0.00 | 1.16 | 0.74 | 9.00 | 0.00 | 0.76 | 4.00 | 0.00 | 0.00 | 4.4 | 0.0% | 18.8% | 70 |
| 0.00 | 0.00 | 2.00 | 12.00 | 2.00 | 0.50 | 0.50 | 16.47 | 8.00 | 0.50 | 0.00 | 0.00 | 0.00 | 3 | 0.0% | 18.9% | 0 |
| 0.00 | 0.00 | 2.00 | 9.78 | 1.63 | 0.41 | 0.41 | 16.47 | 6.52 | 0.41 | 0.00 | 0.00 | 0.00 | 2.8152 | 0.0% | 18.9% | 60 |
| 0.00 | 0.00 | 2.50 | 2.00 | 0.00 | 1.16 | 0.74 | 9.00 | 0.00 | 0.76 | 4.00 | 0.00 | 0.00 | 4.4 | 0.0% | 18.9% | 60 |
| 0.00 | 0.00 | 2.00 | 5.04 | 0.00 | 1.16 | 0.74 | 10.00 | 0.00 | 0.76 | 4.00 | 0.00 | 0.00 | 3.9 | 0.0% | 19.0% | 50 |
| 0.00 | 0.00 | 2.00 | 0.00 | 0.00 | 1.16 | 0.74 | 7.00 | 0.00 | 0.76 | 6.00 | 0.00 | 0.00 | 3.9 | 0.0% | 19.0% | 50 |
| 0.00 | 0.00 | 2.50 | 4.00 | 0.00 | 1.16 | 0.74 | 9.00 | 0.00 | 0.76 | 4.00 | 0.00 | 0.00 | 4.4 | 0.0% | 19.0% | 55 |
| 0.00 | 0.00 | 2.00 | 0.00 | 0.00 | 1.16 | 0.74 | 8.00 | 0.00 | 0.76 | 6.00 | 0.00 | 0.00 | 3.9 | 0.0% | 19.1% | 50 |
| 0.00 | 0.80 | 1.40 | 0.00 | 0.00 | 1.16 | 0.74 | 8.00 | 0.00 | 0.76 | 7.00 | 0.00 | 0.00 | 3.3 | 0.0% | 19.1% | 50 |
| 0.00 | 0.80 | 1.40 | 0.00 | 0.00 | 1.16 | 0.74 | 9.00 | 0.00 | 0.76 | 7.00 | 0.00 | 0.00 | 3.3 | 0.0% | 19.1% | 50 |
| 0.00 | 0.80 | 1.40 | 0.00 | 0.00 | 1.16 | 0.74 | 10.00 | 0.00 | 0.76 | 6.00 | 0.00 | 0.00 | 3.3 | 0.0% | 19.2% | 50 |
| 0.00 | 0.80 | 1.40 | 0.00 | 0.00 | 1.16 | 0.74 | 9.00 | 0.00 | 0.76 | 10.00 | 0.00 | 0.00 | 3.3 | 0.0% | 19.2% | 50 |
| 0.00 | 0.80 | 1.40 | 0.00 | 0.00 | 1.16 | 0.74 | 10.00 | 0.00 | 0.76 | 7.00 | 0.00 | 0.00 | 3.3 | 0.0% | 19.2% | 50 |
| 0.00 | 0.80 | 1.40 | 0.00 | 0.00 | 1.16 | 0.74 | 10.00 | 0.00 | 0.76 | 10.00 | 0.00 | 0.00 | 3.3 | 0.0% | 19.3% | 50 |
| 0.00 | 0.60 | 1.60 | 0.00 | 0.00 | 1.16 | 0.74 | 6.00 | 0.00 | 0.76 | 6.00 | 0.00 | 0.00 | 3.5 | 0.0% | 19.3% | 50 |
| 0.00 | 0.00 | 2.50 | 0.00 | 0.00 | 1.16 | 0.74 | 6.00 | 0.00 | 0.76 | 6.00 | 0.00 | 0.00 | 4.4 | 0.0% | 19.4% | 60 |
| 0.00 | 0.40 | 1.80 | 0.00 | 0.00 | 1.16 | 0.74 | 6.00 | 0.00 | 0.76 | 6.00 | 0.00 | 0.00 | 3.7 | 0.0% | 19.5% | 50 |
| 0.00 | 1.50 | 1.07 | 5.04 | 0.00 | 1.16 | 0.74 | 0.00 | 0.00 | 0.76 | 8.00 | 0.00 | 0.00 | 2.97 | 0.0% | 19.5% | 20 |
| 0.00 | 0.60 | 1.60 | 0.00 | 0.00 | 1.16 | 0.74 | 9.00 | 0.00 | 0.76 | 7.00 | 0.00 | 0.00 | 3.5 | 0.0% | 19.6% | 50 |
| 0.00 | 0.00 | 2.50 | 4.00 | 0.00 | 1.16 | 0.74 | 6.00 | 0.00 | 0.76 | 6.00 | 0.00 | 0.00 | 4.4 | 0.0% | 19.6% | 45 |
| 0.00 | 0.60 | 1.60 | 0.00 | 0.00 | 1.16 | 0.74 | 10.00 | 0.00 | 0.76 | 7.00 | 0.00 | 0.00 | 3.5 | 0.0% | 19.7% | 50 |
| 0.00 | 0.60 | 1.60 | 0.00 | 0.00 | 1.16 | 0.74 | 10.00 | 0.00 | 0.76 | 10.00 | 0.00 | 0.00 | 3.5 | 0.0% | 19.7% | 50 |
| 0.00 | 0.20 | 2.00 | 0.50 | 0.00 | 0.75 | 0.70 | 5.00 | 0.00 | 0.44 | 7.00 | 0.36 | 0.00 | 3.45 | 0.0% | 19.9% | 50 |
| 0.00 | 0.00 | 2.50 | 2.00 | 0.00 | 1.16 | 0.74 | 10.00 | 0.00 | 0.76 | 4.00 | 0.00 | 0.00 | 4.4 | 0.0% | 20.0% | 45 |
| 0.00 | 0.00 | 2.50 | 4.00 | 0.00 | 1.16 | 0.74 | 10.00 | 0.00 | 0.76 | 4.00 | 0.00 | 0.00 | 4.4 | 0.0% | 20.0% | 40 |
| 0.00 | 0.20 | 2.00 | 0.50 | 0.00 | 0.75 | 0.70 | 4.00 | 0.00 | 0.44 | 8.00 | 0.36 | 0.00 | 3.45 | 0.0% | 20.0% | 50 |
| 0.00 | 0.00 | 2.20 | 0.00 | 0.00 | 1.16 | 0.74 | 7.00 | 0.00 | 0.76 | 6.00 | 0.00 | 0.00 | 4.1 | 0.0% | 20.0% | 50 |
| 0.00 | 0.20 | 2.00 | 0.00 | 0.00 | 1.16 | 0.74 | 7.00 | 0.00 | 0.76 | 6.00 | 0.00 | 0.00 | 3.9 | 0.0% | 20.1% | 50 |
| 0.00 | 1.50 | 1.07 | 5.04 | 0.00 | 1.16 | 0.74 | 0.00 | 0.00 | 0.76 | 10.00 | 0.00 | 0.00 | 2.97 | 0.0% | 20.1% | 50 |
| 0.00 | 0.20 | 2.00 | 0.50 | 0.00 | 0.75 | 0.70 | 7.00 | 0.00 | 0.44 | 6.00 | 0.36 | 0.00 | 3.45 | 0.0% | 20.1% | 50 |
| 0.00 | 0.40 | 1.80 | 0.00 | 0.00 | 1.16 | 0.74 | 10.00 | 0.00 | 0.76 | 7.00 | 0.00 | 0.00 | 3.7 | 0.0% | 20.1% | 50 |
| 0.00 | 1.50 | 1.07 | 5.04 | 0.00 | 1.16 | 0.74 | 2.00 | 0.00 | 0.76 | 8.00 | 0.00 | 0.00 | 2.97 | 0.0% | 20.1% | 15 |
| 0.00 | 0.20 | 5.75 | 0.00 | 0.00 | 0.75 | 0.00 | 5.00 | 0.00 | 0.44 | 8.00 | 0.00 | 0.00 | 6.5 | 0.0% | 20.2% | 0 |
| 0.00 | 0.20 | 2.00 | 0.50 | 0.00 | 0.75 | 0.70 | 6.00 | 0.00 | 0.44 | 7.00 | 0.36 | 0.00 | 3.45 | 0.0% | 20.2% | 50 |
| 0.00 | 0.20 | 2.00 | 0.50 | 0.00 | 0.75 | 0.70 | 5.00 | 0.00 | 0.44 | 8.00 | 0.36 | 0.00 | 3.45 | 0.0% | 20.2% | 50 |
| 0.00 | 1.50 | 1.07 | 5.04 | 0.00 | 1.16 | 0.74 | 4.00 | 0.00 | 0.76 | 8.00 | 0.00 | 0.00 | 2.97 | 2.1% | 20.3% | 50 |
| 0.00 | 0.80 | 1.60 | 0.00 | 0.00 | 1.16 | 0.74 | 6.00 | 0.00 | 0.76 | 6.00 | 0.00 | 0.00 | 3.5 | 0.0% | 20.4% | 50 |
| 0.00 | 1.50 | 1.07 | 5.04 | 0.00 | 1.16 | 0.74 | 6.00 | 0.00 | 0.76 | 6.00 | 0.00 | 0.00 | 2.97 | 0.0% | 20.4% | 50 |
| 0.00 | 0.20 | 2.00 | 0.50 | 0.00 | 0.75 | 0.70 | 8.00 | 0.00 | 0.44 | 6.00 | 0.36 | 0.00 | 3.45 | 0.0% | 20.4% | 50 |
| 0.00 | 0.00 | 2.20 | 0.00 | 0.00 | 1.16 | 0.74 | 6.00 | 0.00 | 0.76 | 7.00 | 0.00 | 0.00 | 4.1 | 0.0% | 20.4% | 50 |
| 0.00 | 1.00 | 1.40 | 0.00 | 0.00 | 1.16 | 0.74 | 9.00 | 0.00 | 0.76 | 7.00 | 0.00 | 0.00 | 3.3 | 0.0% | 20.4% | 50 |
| 0.00 | 1.00 | 1.40 | 0.00 | 0.00 | 1.16 | 0.74 | 10.00 | 0.00 | 0.76 | 6.00 | 0.00 | 0.00 | 3.3 | 0.0% | 20.4% | 50 |
| 0.00 | 0.00 | 2.50 | 0.00 | 0.00 | 1.16 | 0.74 | 7.00 | 0.00 | 0.76 | 6.00 | 0.00 | 0.00 | 4.4 | 0.0% | 20.4% | 45 |
| 0.00 | 0.00 | 2.40 | 0.00 | 0.00 | 1.16 | 0.74 | 7.00 | 0.00 | 0.76 | 6.00 | 0.00 | 0.00 | 4.3 | 0.0% | 20.4% | 50 |
| 0.00 | 5.00 | 6.00 | 0.50 | 0.00 | 0.75 | 0.50 | 6.00 | 0.00 | 0.50 | 6.00 | 0.50 | 0.00 | 7.25 | 0.0% | 20.5% | 25 |
| 0.00 | 1.00 | 1.40 | 0.00 | 0.00 | 1.16 | 0.74 | 10.00 | 0.00 | 0.76 | 7.00 | 0.00 | 0.00 | 3.3 | 0.0% | 20.5% | 50 |
| 0.00 | 1.00 | 1.40 | 0.00 | 0.00 | 1.16 | 0.74 | 10.00 | 0.00 | 0.76 | 10.00 | 0.00 | 0.00 | 3.3 | 0.0% | 20.5% | 50 |
| 0.00 | 1.50 | 1.07 | 5.04 | 0.00 | 1.16 | 0.74 | 8.00 | 0.00 | 0.76 | 6.00 | 0.00 | 0.00 | 2.97 | 0.0% | 20.6% | 50 |
| 0.00 | 0.00 | 2.50 | 4.00 | 0.00 | 1.16 | 0.74 | 7.00 | 0.00 | 0.76 | 6.00 | 0.00 | 0.00 | 4.4 | 0.0% | 20.6% | 35 |
| 0.00 | 0.00 | 2.20 | 0.00 | 0.00 | 1.16 | 0.74 | 8.00 | 0.00 | 0.76 | 6.00 | 0.00 | 0.00 | 4.1 | 0.0% | 20.6% | 50 |
| 0.00 | 4.00 | 6.00 | 0.50 | 0.00 | 0.75 | 0.50 | 6.00 | 0.00 | 0.50 | 6.00 | 0.50 | 0.00 | 7.25 | 4.0% | 20.6% | 10 |
| 0.00 | 1.50 | 1.07 | 5.04 | 0.00 | 1.16 | 0.74 | 8.00 | 0.00 | 0.76 | 10.00 | 0.00 | 0.00 | 2.97 | 0.0% | 20.6% | 50 |
| 0.00 | 0.00 | 2.20 | 0.00 | 0.00 | 1.16 | 0.74 | 6.00 | 0.00 | 0.76 | 8.00 | 0.00 | 0.00 | 4.1 | 4.7% | 20.7% | 50 |
| 0.00 | 1.50 | 1.07 | 5.04 | 0.00 | 1.16 | 0.74 | 10.00 | 0.00 | 0.76 | 10.00 | 0.00 | 0.00 | 2.97 | 0.0% | 20.8% | 50 |
| 0.00 | 0.00 | 2.20 | 0.00 | 0.00 | 1.16 | 0.74 | 9.00 | 0.00 | 0.76 | 6.00 | 0.00 | 0.00 | 4.1 | 0.0% | 20.8% | 50 |
| 0.00 | 0.00 | 2.50 | 0.00 | 0.00 | 1.16 | 0.74 | 4.00 | 0.00 | 0.76 | 8.00 | 0.00 | 0.00 | 4.4 | 0.0% | 20.9% | 35 |
| 0.00 | 0.60 | 1.80 | 0.00 | 0.00 | 1.16 | 0.74 | 7.00 | 0.00 | 0.76 | 6.00 | 0.00 | 0.00 | 3.7 | 0.0% | 20.9% | 50 |
| 0.00 | 0.80 | 1.60 | 0.00 | 0.00 | 1.16 | 0.74 | 10.00 | 0.00 | 0.76 | 7.00 | 0.00 | 0.00 | 3.5 | 0.0% | 20.9% | 50 |
| 0.00 | 0.00 | 2.50 | 2.00 | 0.00 | 1.16 | 0.74 | 4.00 | 0.00 | 0.76 | 8.00 | 0.00 | 0.00 | 4.4 | 0.0% | 21.0% | 30 |
| 0.00 | 5.00 | 5.00 | 0.50 | 0.00 | 0.75 | 0.50 | 6.00 | 0.00 | 0.50 | 6.00 | 0.50 | 0.00 | 6.25 | 0.5% | 21.0% | 5 |
| 0.00 | 0.00 | 2.50 | 4.00 | 0.00 | 1.16 | 0.74 | 4.00 | 0.00 | 0.76 | 8.00 | 0.00 | 0.00 | 4.4 | 0.0% | 21.0% | 25 |
| 0.00 | 0.00 | 2.40 | 0.00 | 0.00 | 1.16 | 0.74 | 6.00 | 0.00 | 0.76 | 7.00 | 0.00 | 0.00 | 4.3 | 0.0% | 21.1% | 50 |
| 0.00 | 2.00 | 1.07 | 5.04 | 0.00 | 1.16 | 0.74 | 0.00 | 0.00 | 0.76 | 8.00 | 0.00 | 0.00 | 2.97 | 0.0% | 21.2% | 50 |
| 0.00 | 4.00 | 5.00 | 0.50 | 0.00 | 0.75 | 0.50 | 6.00 | 0.00 | 0.50 | 6.00 | 0.50 | 0.00 | 6.25 | 7.7% | 21.2% | 10 |
| 0.00 | 5.00 | 6.00 | 0.50 | 0.00 | 0.75 | 0.50 | 7.00 | 0.00 | 0.50 | 6.00 | 0.50 | 0.00 | 7.25 | 0.0% | 21.4% | 5 |
| 0.00 | 0.00 | 2.50 | 4.00 | 0.00 | 1.16 | 0.74 | 8.00 | 0.00 | 0.76 | 6.00 | 0.00 | 0.00 | 4.4 | 0.0% | 21.4% | 25 |
| 0.00 | 0.00 | 2.50 | 2.00 | 0.00 | 1.16 | 0.74 | 8.00 | 0.00 | 0.76 | 6.00 | 0.00 | 0.00 | 4.4 | 0.0% | 21.5% | 30 |
| 0.00 | 4.00 | 6.00 | 0.50 | 0.00 | 0.75 | 0.50 | 7.00 | 0.00 | 0.50 | 6.00 | 0.50 | 0.00 | 7.25 | 4.1% | 21.5% | 10 |
| 0.00 | 0.00 | 2.50 | 5.04 | 0.00 | 1.16 | 0.74 | 8.00 | 0.00 | 0.76 | 6.00 | 0.00 | 0.00 | 4.4 | 0.0% | 21.6% | 50 |
| 0.00 | 5.00 | 4.00 | 0.50 | 0.00 | 0.75 | 0.50 | 6.00 | 0.00 | 0.50 | 6.00 | 0.50 | 0.00 | 5.25 | 4.5% | 21.6% | 5 |
| 0.00 | 0.00 | 2.50 | 4.00 | 0.00 | 1.16 | 0.74 | 5.00 | 0.00 | 0.76 | 8.00 | 0.00 | 0.00 | 4.4 | 0.0% | 21.8% | 20 |
| 0.00 | 0.20 | 2.20 | 0.00 | 0.00 | 1.16 | 0.74 | 7.00 | 0.00 | 0.76 | 7.00 | 0.00 | 0.00 | 4.1 | 0.0% | 21.8% | 50 |
| 0.00 | 0.00 | 2.50 | 0.00 | 0.00 | 1.16 | 0.74 | 5.00 | 0.00 | 0.76 | 8.00 | 0.00 | 0.00 | 4.4 | 0.0% | 21.8% | 30 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 2.50 | 2.00 | 0.00 | 1.16 | 0.74 | 5.00 | 0.00 | 0.76 | 8.00 | 0.00 | 0.00 | 4.4 | 0.0% | 21.8% | 25 |
| 0.00 | 0.20 | 2.20 | 0.50 | 0.00 | 0.75 | 0.70 | 7.00 | 0.00 | 0.44 | 7.00 | 0.36 | 0.00 | 3.65 | 0.0% | 21.8% | 50 |
| 0.00 | 5.00 | 5.00 | 0.50 | 0.00 | 0.75 | 0.50 | 7.00 | 0.00 | 0.50 | 6.00 | 0.50 | 0.00 | 6.25 | 0.0% | 21.9% | 5 |
| 0.00 | 0.20 | 2.20 | 0.50 | 0.00 | 0.75 | 0.70 | 6.00 | 0.00 | 0.44 | 8.00 | 0.36 | 0.00 | 3.65 | 0.0% | 21.9% | 50 |
| 0.00 | 4.00 | 5.00 | 0.50 | 0.00 | 0.75 | 0.50 | 7.00 | 0.00 | 0.50 | 6.00 | 0.50 | 0.00 | 6.25 | 7.8% | 22.1% | 10 |
| 0.00 | 0.00 | 2.50 | 5.04 | 0.00 | 1.16 | 0.74 | 2.00 | 0.00 | 0.76 | 10.00 | 0.00 | 0.00 | 4.4 | 0.0% | 22.1% | 50 |
| 0.00 | 0.80 | 1.80 | 0.00 | 0.00 | 1.16 | 0.74 | 6.00 | 0.00 | 0.76 | 7.00 | 0.00 | 0.00 | 3.7 | 0.0% | 22.1% | 50 |
| 0.00 | 0.20 | 2.20 | 0.50 | 0.00 | 0.75 | 0.70 | 8.00 | 0.00 | 0.44 | 7.00 | 0.36 | 0.00 | 3.65 | 0.0% | 22.1% | 50 |
| 0.00 | 1.00 | 1.60 | 0.00 | 0.00 | 1.16 | 0.74 | 9.00 | 0.00 | 0.76 | 8.00 | 0.00 | 0.00 | 3.5 | 0.0% | 22.1% | 50 |
| 0.00 | 1.00 | 1.60 | 0.00 | 0.00 | 1.16 | 0.74 | 10.00 | 0.00 | 0.76 | 7.00 | 0.00 | 0.00 | 3.5 | 0.0% | 22.2% | 50 |
| 0.00 | 1.00 | 1.60 | 0.00 | 0.00 | 1.16 | 0.74 | 10.00 | 0.00 | 0.76 | 8.00 | 0.00 | 0.00 | 3.5 | 0.0% | 22.2% | 50 |
| 0.00 | 5.00 | 6.00 | 0.50 | 0.00 | 0.75 | 0.50 | 8.00 | 0.00 | 0.50 | 6.00 | 0.50 | 0.00 | 7.25 | 0.0% | 22.2% | 5 |
| 0.00 | 0.50 | 2.50 | 2.00 | 0.00 | 1.16 | 0.74 | 4.00 | 0.00 | 0.76 | 8.00 | 0.00 | 0.00 | 4.4 | 0.0% | 22.3% | 70 |
| 0.00 | 0.00 | 2.50 | 4.00 | 0.00 | 1.16 | 0.74 | 9.00 | 0.00 | 0.76 | 6.00 | 0.00 | 0.00 | 4.4 | 0.0% | 22.3% | 25 |
| 0.00 | 0.00 | 2.50 | 2.00 | 0.00 | 1.16 | 0.74 | 9.00 | 0.00 | 0.76 | 6.00 | 0.00 | 0.00 | 4.4 | 0.0% | 22.3% | 20 |
| 0.00 | 0.00 | 2.50 | 0.00 | 0.00 | 1.16 | 0.74 | 9.00 | 0.00 | 0.76 | 6.00 | 0.00 | 0.00 | 4.4 | 0.0% | 22.3% | 25 |
| 0.00 | 0.00 | 2.40 | 0.00 | 0.00 | 1.16 | 0.74 | 8.00 | 0.00 | 0.76 | 7.00 | 0.00 | 0.00 | 4.3 | 0.0% | 22.4% | 50 |
| 0.00 | 0.00 | 2.50 | 0.00 | 0.00 | 1.16 | 0.74 | 4.00 | 0.00 | 0.76 | 7.00 | 6.00 | 0.00 | 4.4 | 0.0% | 22.4% | 50 |
| 0.00 | 0.00 | 2.40 | 0.00 | 0.00 | 1.16 | 0.74 | 6.00 | 0.00 | 0.76 | 9.00 | 0.00 | 0.00 | 4.3 | 0.0% | 22.4% | 50 |
| 0.00 | 4.00 | 6.00 | 0.50 | 0.00 | 0.75 | 0.50 | 8.00 | 0.00 | 0.50 | 6.00 | 0.50 | 0.00 | 7.25 | 4.2% | 22.4% | 10 |
| 0.00 | 0.20 | 3.00 | 0.00 | 0.00 | 0.75 | 2.00 | 5.00 | 0.00 | 0.44 | 8.00 | 0.00 | 0.00 | 5.75 | 0.0% | 22.5% | 0 |
| 0.00 | 0.00 | 2.50 | 4.00 | 0.00 | 1.16 | 0.74 | 6.00 | 0.00 | 0.76 | 8.00 | 0.00 | 0.00 | 4.4 | 0.0% | 22.5% | 20 |
| 0.00 | 5.00 | 4.00 | 0.50 | 0.00 | 0.75 | 0.50 | 7.00 | 0.00 | 0.50 | 6.00 | 0.50 | 0.00 | 5.25 | 3.4% | 22.5% | 5 |
| 0.00 | 0.00 | 2.50 | 2.00 | 0.00 | 1.16 | 0.74 | 6.00 | 0.00 | 0.76 | 8.00 | 0.00 | 0.00 | 4.4 | 0.0% | 22.5% | 20 |
| 0.00 | 0.00 | 2.50 | 5.04 | 0.00 | 1.16 | 0.74 | 6.00 | 0.00 | 0.76 | 8.00 | 0.00 | 0.00 | 4.4 | 0.0% | 22.5% | 50 |
| 0.00 | 0.00 | 2.50 | 0.00 | 0.00 | 1.16 | 0.74 | 6.00 | 0.00 | 0.76 | 6.00 | 6.00 | 0.00 | 4.4 | 0.0% | 22.5% | 50 |
| 0.00 | 0.00 | 2.50 | 0.00 | 0.00 | 1.16 | 0.74 | 6.00 | 0.00 | 0.76 | 8.00 | 0.00 | 0.00 | 4.4 | 0.0% | 22.5% | 25 |
| 0.00 | 0.00 | 2.50 | 0.00 | 0.00 | 1.16 | 0.74 | 16.00 | 0.00 | 0.76 | 2.00 | 0.00 | 0.00 | 4.4 | 0.0% | 22.6% | 50 |
| 0.00 | 0.00 | 2.50 | 0.00 | 0.00 | 1.16 | 0.74 | 4.00 | 0.00 | 0.76 | 9.00 | 2.00 | 0.00 | 4.4 | 0.0% | 22.6% | 50 |
| 0.00 | 0.00 | 2.60 | 0.00 | 0.00 | 1.16 | 0.74 | 9.00 | 0.00 | 0.76 | 6.00 | 0.00 | 0.00 | 4.5 | 0.0% | 22.6% | 50 |
| 0.00 | 0.00 | 2.40 | 0.00 | 0.00 | 1.16 | 0.74 | 9.00 | 0.00 | 0.76 | 7.00 | 0.00 | 0.00 | 4.3 | 0.0% | 22.6% | 50 |
| 0.00 | 0.50 | 2.50 | 4.00 | 0.00 | 1.16 | 0.74 | 8.00 | 0.00 | 0.76 | 6.00 | 0.00 | 0.00 | 4.4 | 0.7% | 22.6% | 75 |
| 0.00 | 2.00 | 1.07 | 5.04 | 0.00 | 1.16 | 0.74 | 2.00 | 0.00 | 0.76 | 8.00 | 0.00 | 0.00 | 2.97 | 0.0% | 22.6% | 25 |
| 0.00 | 0.60 | 2.00 | 0.00 | 0.00 | 1.16 | 0.74 | 7.00 | 0.00 | 0.76 | 7.00 | 0.00 | 0.00 | 3.9 | 0.0% | 22.7% | 50 |
| 0.00 | 0.80 | 1.80 | 0.00 | 0.00 | 1.16 | 0.74 | 10.00 | 0.00 | 0.76 | 8.00 | 0.00 | 0.00 | 3.7 | 0.0% | 22.7% | 50 |
| 0.00 | 0.50 | 2.50 | 2.00 | 0.00 | 1.16 | 0.74 | 8.00 | 0.00 | 0.76 | 6.00 | 0.00 | 0.00 | 4.4 | 0.0% | 22.7% | 75 |
| 0.00 | 0.00 | 2.50 | 0.00 | 0.00 | 1.16 | 0.74 | 6.00 | 0.00 | 0.76 | 8.00 | 2.00 | 0.00 | 4.4 | 0.0% | 22.7% | 50 |
| 0.00 | 5.00 | 6.00 | 0.50 | 0.00 | 0.75 | 0.50 | 6.00 | 0.00 | 0.50 | 7.00 | 0.50 | 0.00 | 7.25 | 2.1% | 22.8% | 10 |
| 0.00 | 0.00 | 2.50 | 0.00 | 0.00 | 1.16 | 0.74 | 8.00 | 0.00 | 0.76 | 7.00 | 0.00 | 0.00 | 4.4 | 0.0% | 22.8% | 50 |
| 0.00 | 5.00 | 5.00 | 0.50 | 0.00 | 0.75 | 0.50 | 8.00 | 0.00 | 0.50 | 6.00 | 0.50 | 0.00 | 6.25 | 0.0% | 22.8% | 5 |
| 0.00 | 4.00 | 6.00 | 0.50 | 0.00 | 0.75 | 0.50 | 6.00 | 0.00 | 0.50 | 7.00 | 0.50 | 0.00 | 7.25 | 5.6% | 22.9% | 10 |
| 0.00 | 0.00 | 2.50 | 0.00 | 0.00 | 1.16 | 0.74 | 8.00 | 0.00 | 0.76 | 7.00 | 2.00 | 0.00 | 4.4 | 0.0% | 22.9% | 50 |
| 0.00 | 0.00 | 2.50 | 0.00 | 0.00 | 1.16 | 0.74 | 10.00 | 0.00 | 0.76 | 5.00 | 6.00 | 0.00 | 4.4 | 0.0% | 22.9% | 50 |
| 0.00 | 0.00 | 2.50 | 0.00 | 0.00 | 1.16 | 0.74 | 4.00 | 0.00 | 0.76 | 10.00 | 2.00 | 0.00 | 4.4 | 0.0% | 22.9% | 50 |
| 0.00 | 0.00 | 2.50 | 4.00 | 0.00 | 1.16 | 0.74 | 10.00 | 0.00 | 0.76 | 6.00 | 0.00 | 0.00 | 4.4 | 0.0% | 23.0% | 15 |
| 0.00 | 0.00 | 2.50 | 4.00 | 0.00 | 1.16 | 0.74 | 4.00 | 0.00 | 0.76 | 10.00 | 0.00 | 0.00 | 4.4 | 0.0% | 23.0% | 20 |
| 0.00 | 0.00 | 2.50 | 0.00 | 0.00 | 1.16 | 0.74 | 4.00 | 0.00 | 0.76 | 10.00 | 0.00 | 0.00 | 4.4 | 0.0% | 23.0% | 25 |
| 0.00 | 0.00 | 2.50 | 5.04 | 0.00 | 1.16 | 0.74 | 10.00 | 0.00 | 0.76 | 6.00 | 0.00 | 0.00 | 4.4 | 0.0% | 23.0% | 50 |
| 0.00 | 0.00 | 2.50 | 2.00 | 0.00 | 1.16 | 0.74 | 10.00 | 0.00 | 0.76 | 6.00 | 0.00 | 0.00 | 4.4 | 0.0% | 23.0% | 15 |
| 0.00 | 2.00 | 1.07 | 5.04 | 0.00 | 1.16 | 0.74 | 0.00 | 0.00 | 0.76 | 10.00 | 0.00 | 0.00 | 2.97 | 0.0% | 23.0% | 50 |
| 0.00 | 0.00 | 2.50 | 5.04 | 0.00 | 1.16 | 0.74 | 4.00 | 0.00 | 0.76 | 10.00 | 0.00 | 0.00 | 4.4 | 0.0% | 23.0% | 50 |
| 0.00 | 0.00 | 2.50 | 2.00 | 0.00 | 1.16 | 0.74 | 4.00 | 0.00 | 0.76 | 10.00 | 0.00 | 0.00 | 4.4 | 0.0% | 23.0% | 20 |
| 0.00 | 0.00 | 2.50 | 0.00 | 0.00 | 1.16 | 0.74 | 10.00 | 0.00 | 0.76 | 6.00 | 0.00 | 0.00 | 4.4 | 0.0% | 23.0% | 20 |
| 0.00 | 4.00 | 5.00 | 0.50 | 0.00 | 0.75 | 0.50 | 8.00 | 0.00 | 0.50 | 6.00 | 0.50 | 0.00 | 6.25 | 8.0% | 23.0% | 10 |
| 0.00 | 0.00 | 2.50 | 4.00 | 0.00 | 1.16 | 0.74 | 7.00 | 0.00 | 0.76 | 8.00 | 0.00 | 0.00 | 4.4 | 0.0% | 23.0% | 15 |
| 0.00 | 0.00 | 2.50 | 2.00 | 0.00 | 1.16 | 0.74 | 7.00 | 0.00 | 0.76 | 8.00 | 0.00 | 0.00 | 4.4 | 0.0% | 23.1% | 20 |
| 0.00 | 0.50 | 2.50 | 0.00 | 0.00 | 1.16 | 0.74 | 5.00 | 0.00 | 0.76 | 8.00 | 0.00 | 0.00 | 4.4 | 0.0% | 23.1% | 60 |
| 0.00 | 0.00 | 2.50 | 0.00 | 0.00 | 1.16 | 0.74 | 7.00 | 0.00 | 0.76 | 8.00 | 0.00 | 0.00 | 4.4 | 0.0% | 23.1% | 20 |
| 0.00 | 0.00 | 2.50 | 0.00 | 0.00 | 1.16 | 0.74 | 10.00 | 0.00 | 0.76 | 6.00 | 2.00 | 0.00 | 4.4 | 0.0% | 23.1% | 50 |
| 0.00 | 0.60 | 2.00 | 0.00 | 0.00 | 1.16 | 0.74 | 10.00 | 0.00 | 0.76 | 8.00 | 0.00 | 0.00 | 3.9 | 0.0% | 23.1% | 50 |
| 0.00 | 0.20 | 3.00 | 10.00 | 0.00 | 0.75 | 0.00 | 5.00 | 0.00 | 0.44 | 8.00 | 0.00 | 0.00 | 3.75 | 0.0% | 23.1% | 0 |
| 0.00 | 0.20 | 2.40 | 0.50 | 0.00 | 0.75 | 0.70 | 6.00 | 0.00 | 0.44 | 8.00 | 0.36 | 0.00 | 3.85 | 0.0% | 23.1% | 50 |
| 0.00 | 5.00 | 6.00 | 0.50 | 0.00 | 0.75 | 0.50 | 9.00 | 0.00 | 0.50 | 6.00 | 0.50 | 0.00 | 7.25 | 0.0% | 23.1% | 5 |
| 0.00 | 0.00 | 2.50 | 0.00 | 0.00 | 1.16 | 0.74 | 20.00 | 0.00 | 0.76 | 0.00 | 0.00 | 0.00 | 4.4 | 0.0% | 23.1% | 50 |
| 0.00 | 0.00 | 2.50 | 0.00 | 0.00 | 1.16 | 0.74 | 6.00 | 0.00 | 0.76 | 9.00 | 2.00 | 0.00 | 4.4 | 0.0% | 23.1% | 50 |
| 0.00 | 2.00 | 1.07 | 5.04 | 0.00 | 1.16 | 0.74 | 6.00 | 0.00 | 0.76 | 6.00 | 0.00 | 0.00 | 2.97 | 0.0% | 23.1% | 50 |
| 0.00 | 0.00 | 2.60 | 0.00 | 0.00 | 1.16 | 0.74 | 8.00 | 0.00 | 0.76 | 7.00 | 0.00 | 0.00 | 4.5 | 0.0% | 23.2% | 50 |
| 0.00 | 0.00 | 2.50 | 0.00 | 0.00 | 1.16 | 0.74 | 5.00 | 0.00 | 0.76 | 10.00 | 0.00 | 0.00 | 4.4 | 0.0% | 23.2% | 35 |
| 0.00 | 0.00 | 2.50 | 2.00 | 0.00 | 1.16 | 0.74 | 5.00 | 0.00 | 0.76 | 10.00 | 0.00 | 0.00 | 4.4 | 0.0% | 23.2% | 30 |
| 0.00 | 0.00 | 2.50 | 4.00 | 0.00 | 1.16 | 0.74 | 5.00 | 0.00 | 0.76 | 10.00 | 0.00 | 0.00 | 4.4 | 0.0% | 23.2% | 40 |
| 0.00 | 0.50 | 2.50 | 2.00 | 0.00 | 1.16 | 0.74 | 5.00 | 0.00 | 0.76 | 8.00 | 0.00 | 0.00 | 4.4 | 0.0% | 23.2% | 55 |
| 0.00 | 0.40 | 2.20 | 0.00 | 0.00 | 1.16 | 0.74 | 8.00 | 0.00 | 0.76 | 7.00 | 0.00 | 0.00 | 4.1 | 0.0% | 23.2% | 50 |
| 0.00 | 2.00 | 1.07 | 5.04 | 0.00 | 1.16 | 0.74 | 2.00 | 0.00 | 0.76 | 10.00 | 0.00 | 0.00 | 2.97 | 0.0% | 23.2% | 50 |
| 0.00 | 0.20 | 2.40 | 0.50 | 0.00 | 0.75 | 0.70 | 8.00 | 0.00 | 0.44 | 7.00 | 0.36 | 0.00 | 3.85 | 0.0% | 23.3% | 50 |
| 0.00 | 0.00 | 2.50 | 0.00 | 0.00 | 1.16 | 0.74 | 6.00 | 0.00 | 0.76 | 10.00 | 6.00 | 0.00 | 4.4 | 0.9% | 23.3% | 50 |
| 0.00 | 4.00 | 6.00 | 0.50 | 0.00 | 0.75 | 0.50 | 9.00 | 0.00 | 0.50 | 6.00 | 0.50 | 0.00 | 7.25 | 4.4% | 23.4% | 10 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.00 | 2.50 | 0.00 | 0.00 | 1.16 | 0.74 | 8.00 | 0.00 | 0.76 | 8.00 | 0.00 | 0.00 | 4.4 | 0.0% | 23.4% | 25 |
| 0.00 | 0.00 | 2.50 | 0.00 | 0.00 | 1.16 | 0.74 | 6.00 | 0.00 | 0.76 | 10.00 | 0.00 | 0.00 | 4.4 | 0.0% | 23.4% | 45 |
| 0.00 | 0.00 | 2.50 | 2.00 | 0.00 | 1.16 | 0.74 | 8.00 | 0.00 | 0.76 | 8.00 | 0.00 | 0.00 | 4.4 | 0.0% | 23.4% | 25 |
| 0.00 | 0.00 | 2.50 | 5.04 | 0.00 | 1.16 | 0.74 | 8.00 | 0.00 | 0.76 | 8.00 | 0.00 | 0.00 | 4.4 | 0.0% | 23.4% | 50 |
| 0.00 | 5.00 | 5.00 | 0.50 | 0.00 | 0.75 | 0.50 | 6.00 | 0.00 | 0.50 | 7.00 | 0.50 | 0.00 | 6.25 | 5.6% | 23.4% | 10 |
| 0.00 | 0.00 | 2.50 | 4.00 | 0.00 | 1.16 | 0.74 | 8.00 | 0.00 | 0.76 | 8.00 | 0.00 | 0.00 | 4.4 | 0.0% | 23.4% | 40 |
| 0.00 | 5.00 | 4.00 | 0.50 | 0.00 | 0.75 | 0.50 | 8.00 | 0.00 | 0.50 | 6.00 | 0.50 | 0.00 | 5.25 | 2.5% | 23.4% | 5 |
| 0.00 | 0.00 | 2.50 | 0.00 | 0.00 | 1.16 | 0.74 | 8.00 | 0.00 | 0.76 | 9.00 | 6.00 | 0.00 | 4.4 | 0.0% | 23.4% | 50 |
| 0.00 | 0.00 | 2.50 | 0.00 | 0.00 | 1.16 | 0.74 | 10.00 | 0.00 | 0.76 | 7.00 | 6.00 | 0.00 | 4.4 | 0.0% | 23.5% | 50 |
| 0.00 | 4.00 | 5.00 | 0.50 | 0.00 | 0.75 | 0.50 | 6.00 | 0.00 | 0.50 | 7.00 | 0.50 | 0.00 | 6.25 | 9.3% | 23.5% | 10 |
| 0.00 | 0.00 | 2.50 | 9.26 | 1.54 | 0.39 | 0.39 | 20.34 | 6.17 | 0.39 | 0.00 | 0.00 | 0.00 | 3.2716 | 0.0% | 23.5% | 60 |
| 0.00 | 0.00 | 2.50 | 12.00 | 2.00 | 0.50 | 0.50 | 20.34 | 8.00 | 0.50 | 0.00 | 0.00 | 0.00 | 3.5 | 0.0% | 23.5% | 30 |
| 0.00 | 1.00 | 1.80 | 0.00 | 0.00 | 1.16 | 0.74 | 7.00 | 0.00 | 0.76 | 7.00 | 0.00 | 0.00 | 3.7 | 0.0% | 23.5% | 50 |
| 0.00 | 0.00 | 2.50 | 0.00 | 0.00 | 1.16 | 0.74 | 10.00 | 0.00 | 0.76 | 7.00 | 0.00 | 0.00 | 4.4 | 1.4% | 23.5% | 50 |
| 0.00 | 0.00 | 2.50 | 0.00 | 0.00 | 1.16 | 0.74 | 14.00 | 0.00 | 0.76 | 4.00 | 0.00 | 0.00 | 4.4 | 0.0% | 23.5% | 50 |
| 0.00 | 0.00 | 2.50 | 0.00 | 0.00 | 1.16 | 0.74 | 7.00 | 0.00 | 0.76 | 10.00 | 0.00 | 0.00 | 4.4 | 0.0% | 23.5% | 60 |
| 0.00 | 0.20 | 2.40 | 0.50 | 0.00 | 0.75 | 0.70 | 7.00 | 0.00 | 0.44 | 8.00 | 0.36 | 0.00 | 3.85 | 0.0% | 23.6% | 50 |
| 0.00 | 2.00 | 1.07 | 5.04 | 0.00 | 1.16 | 0.74 | 8.00 | 0.00 | 0.76 | 6.00 | 0.00 | 0.00 | 2.97 | 2.4% | 23.6% | 50 |
| 0.00 | 0.00 | 2.50 | 0.00 | 0.00 | 1.16 | 0.74 | 10.00 | 0.00 | 0.76 | 8.00 | 6.00 | 0.00 | 4.4 | 0.0% | 23.6% | 50 |
| 0.00 | 0.00 | 2.50 | 2.00 | 0.00 | 1.16 | 0.74 | 9.00 | 0.00 | 0.76 | 8.00 | 0.00 | 0.00 | 4.4 | 0.0% | 23.6% | 40 |
| 0.00 | 0.00 | 2.60 | 0.00 | 0.00 | 1.16 | 0.74 | 7.00 | 0.00 | 0.76 | 8.00 | 0.00 | 0.00 | 4.5 | 0.0% | 23.6% | 50 |
| 0.00 | 0.50 | 2.50 | 0.00 | 0.00 | 1.16 | 0.74 | 9.00 | 0.00 | 0.76 | 6.00 | 0.00 | 0.00 | 4.4 | 0.0% | 23.6% | 60 |
| 0.00 | 0.50 | 2.50 | 2.00 | 0.00 | 1.16 | 0.74 | 9.00 | 0.00 | 0.76 | 6.00 | 0.00 | 0.00 | 4.4 | 0.0% | 23.7% | 60 |
| 0.00 | 5.00 | 6.00 | 0.50 | 0.00 | 0.75 | 0.50 | 7.00 | 0.00 | 0.50 | 7.00 | 0.50 | 0.00 | 7.25 | 0.6% | 23.7% | 5 |
| 0.00 | 0.50 | 2.50 | 4.00 | 0.00 | 1.16 | 0.74 | 9.00 | 0.00 | 0.76 | 6.00 | 0.00 | 0.00 | 4.4 | 0.0% | 23.7% | 55 |
| 0.00 | 5.00 | 5.00 | 0.50 | 0.00 | 0.75 | 0.50 | 9.00 | 0.00 | 0.50 | 6.00 | 0.50 | 0.00 | 6.25 | 0.0% | 23.7% | 5 |
| 0.00 | 2.00 | 1.07 | 5.04 | 0.00 | 1.16 | 0.74 | 10.00 | 0.00 | 0.76 | 6.00 | 0.00 | 0.00 | 2.97 | 0.0% | 23.7% | 50 |
| 0.00 | 4.00 | 6.00 | 0.50 | 0.00 | 0.75 | 0.50 | 7.00 | 0.00 | 0.50 | 7.00 | 0.50 | 0.00 | 7.25 | 5.8% | 23.8% | 10 |
| 0.00 | 0.20 | 2.40 | 0.00 | 0.00 | 1.16 | 0.74 | 9.00 | 0.00 | 0.76 | 7.00 | 0.00 | 0.00 | 4.3 | 0.0% | 23.8% | 50 |
| 0.00 | 0.00 | 2.60 | 0.00 | 0.00 | 1.16 | 0.74 | 9.00 | 0.00 | 0.76 | 7.00 | 0.00 | 0.00 | 4.5 | 0.0% | 23.8% | 50 |
| 0.00 | 0.20 | 3.00 | 6.00 | 0.00 | 0.75 | 4.00 | 5.00 | 0.00 | 0.44 | 8.00 | 0.00 | 0.00 | 7.75 | 0.2% | 23.8% | 0 |
| 0.00 | 0.20 | 2.40 | 0.50 | 0.00 | 0.75 | 0.70 | 8.00 | 0.00 | 0.44 | 8.00 | 0.36 | 0.00 | 3.85 | 0.0% | 23.8% | 50 |
| 0.00 | 2.00 | 1.07 | 5.04 | 0.00 | 1.16 | 0.74 | 10.00 | 0.00 | 0.76 | 10.00 | 0.00 | 0.00 | 2.97 | 0.0% | 23.9% | 50 |
| 0.00 | 1.00 | 1.80 | 0.00 | 0.00 | 1.16 | 0.74 | 10.00 | 0.00 | 0.76 | 8.00 | 0.00 | 0.00 | 3.7 | 0.0% | 23.9% | 50 |
| 0.00 | 4.00 | 5.00 | 0.50 | 0.00 | 0.75 | 0.50 | 9.00 | 0.00 | 0.50 | 6.00 | 0.50 | 0.00 | 6.25 | 8.2% | 24.0% | 10 |
| 0.00 | 0.00 | 2.50 | 0.00 | 0.00 | 1.16 | 0.74 | 14.00 | 0.00 | 0.76 | 8.00 | 0.00 | 0.00 | 4.4 | 0.0% | 24.0% | 50 |
| 0.00 | 0.00 | 2.50 | 0.00 | 0.00 | 1.16 | 0.74 | 18.00 | 0.00 | 0.76 | 2.00 | 0.00 | 0.00 | 4.4 | 0.0% | 24.0% | 50 |
| 0.00 | 5.00 | 4.00 | 0.50 | 0.00 | 0.75 | 0.50 | 6.00 | 0.00 | 0.50 | 7.00 | 0.50 | 0.00 | 5.25 | 9.3% | 24.0% | 10 |
| 0.00 | 5.00 | 6.00 | 0.50 | 0.00 | 0.75 | 0.50 | 10.00 | 0.00 | 0.50 | 6.00 | 0.50 | 0.00 | 7.25 | 0.0% | 24.0% | 5 |
| 0.00 | 0.80 | 2.00 | 0.00 | 0.00 | 1.16 | 0.74 | 8.00 | 0.00 | 0.76 | 7.00 | 0.00 | 0.00 | 3.9 | 0.0% | 24.0% | 50 |
| 0.00 | 0.50 | 2.50 | 0.00 | 0.00 | 1.16 | 0.74 | 6.00 | 0.00 | 0.76 | 8.00 | 0.00 | 0.00 | 4.4 | 0.0% | 24.1% | 45 |
| 0.00 | 0.20 | 3.00 | 4.00 | 0.00 | 0.75 | 6.00 | 5.00 | 0.00 | 0.44 | 8.00 | 0.00 | 0.00 | 9.75 | 0.0% | 24.1% | 0 |
| 0.00 | 0.50 | 2.50 | 2.00 | 0.00 | 1.16 | 0.74 | 6.00 | 0.00 | 0.76 | 8.00 | 0.00 | 0.00 | 4.4 | 0.0% | 24.1% | 40 |
| 0.00 | 0.50 | 2.50 | 4.00 | 0.00 | 1.16 | 0.74 | 6.00 | 0.00 | 0.76 | 8.00 | 0.00 | 0.00 | 4.4 | 0.0% | 24.1% | 40 |
| 0.00 | 0.00 | 2.50 | 0.00 | 0.00 | 1.16 | 0.74 | 16.00 | 0.00 | 0.76 | 8.00 | 0.00 | 0.00 | 4.4 | 0.0% | 24.2% | 50 |
| 0.00 | 4.00 | 6.00 | 0.50 | 0.00 | 0.75 | 0.50 | 10.00 | 0.00 | 0.50 | 6.00 | 0.50 | 0.00 | 7.25 | 4.7% | 24.3% | 10 |
| 0.00 | 0.00 | 2.60 | 0.00 | 0.00 | 1.16 | 0.74 | 10.00 | 0.00 | 0.76 | 7.00 | 0.00 | 0.00 | 4.5 | 0.0% | 24.3% | 50 |
| 0.00 | 5.00 | 5.00 | 0.50 | 0.00 | 0.75 | 0.50 | 7.00 | 0.00 | 0.50 | 7.00 | 0.50 | 0.00 | 6.25 | 5.8% | 24.3% | 10 |
| 0.00 | 4.00 | 5.00 | 0.50 | 0.00 | 0.75 | 0.50 | 7.00 | 0.00 | 0.50 | 7.00 | 0.50 | 0.00 | 6.25 | 9.6% | 24.4% | 10 |
| 0.00 | 0.00 | 2.50 | 0.00 | 0.00 | 1.16 | 0.74 | 18.00 | 0.00 | 0.76 | 8.00 | 0.00 | 0.00 | 4.4 | 0.0% | 24.4% | 50 |
| 0.00 | 0.60 | 2.20 | 0.00 | 0.00 | 1.16 | 0.74 | 9.00 | 0.00 | 0.76 | 7.00 | 0.00 | 0.00 | 4.1 | 0.0% | 24.6% | 50 |
| 0.00 | 5.00 | 6.00 | 0.50 | 0.00 | 0.75 | 0.50 | 8.00 | 0.00 | 0.50 | 7.00 | 0.50 | 0.00 | 7.25 | 0.3% | 24.6% | 5 |
| 0.00 | 0.00 | 2.50 | 0.00 | 0.00 | 1.16 | 0.74 | 20.00 | 0.00 | 0.76 | 8.00 | 0.00 | 0.00 | 4.4 | 0.0% | 24.6% | 50 |
| 0.00 | 0.50 | 2.50 | 0.00 | 0.00 | 1.16 | 0.74 | 10.00 | 0.00 | 0.76 | 6.00 | 0.00 | 0.00 | 4.4 | 0.0% | 24.6% | 45 |
| 0.00 | 0.50 | 2.50 | 2.00 | 0.00 | 1.16 | 0.74 | 10.00 | 0.00 | 0.76 | 6.00 | 0.00 | 0.00 | 4.4 | 0.0% | 24.6% | 35 |
| 0.00 | 4.00 | 6.00 | 0.50 | 0.00 | 0.75 | 0.50 | 8.00 | 0.00 | 0.50 | 7.00 | 0.50 | 0.00 | 7.25 | 6.0% | 24.6% | 10 |
| 0.00 | 5.00 | 5.00 | 0.50 | 0.00 | 0.75 | 0.50 | 10.00 | 0.00 | 0.50 | 6.00 | 0.50 | 0.00 | 6.25 | 0.0% | 24.7% | 5 |
| 0.00 | 0.20 | 3.00 | 0.50 | 0.00 | 10.00 | 0.00 | 5.00 | 0.00 | 0.44 | 8.00 | 2.00 | 0.00 | 13 | 0.0% | 24.7% | 70 |
| 0.00 | 0.20 | 3.00 | 6.00 | 0.00 | 0.75 | 0.00 | 5.00 | 0.00 | 0.44 | 8.00 | 2.00 | 0.00 | 3.75 | 0.0% | 24.9% | 0 |
| 0.00 | 0.40 | 2.40 | 0.00 | 0.00 | 1.16 | 0.74 | 8.00 | 0.00 | 0.76 | 8.00 | 0.00 | 0.00 | 4.3 | 0.0% | 24.9% | 50 |
| 0.00 | 5.00 | 6.00 | 0.50 | 0.00 | 0.75 | 0.50 | 11.00 | 0.00 | 0.50 | 6.00 | 0.50 | 0.00 | 7.25 | 0.0% | 24.9% | 5 |
| 0.00 | 4.00 | 5.00 | 0.50 | 0.00 | 0.75 | 0.50 | 10.00 | 0.00 | 0.50 | 6.00 | 0.50 | 0.00 | 6.25 | 8.5% | 24.9% | 10 |
| 0.00 | 5.00 | 4.00 | 0.50 | 0.00 | 0.75 | 0.50 | 7.00 | 0.00 | 0.50 | 7.00 | 0.50 | 0.00 | 5.25 | 9.5% | 25.0% | 10 |
| 0.00 | 0.50 | 2.50 | 2.00 | 0.00 | 1.16 | 0.74 | 7.00 | 0.00 | 0.76 | 8.00 | 0.00 | 0.00 | 4.4 | 0.0% | 25.0% | 30 |
| 0.00 | 0.50 | 2.50 | 0.00 | 0.00 | 1.16 | 0.74 | 7.00 | 0.00 | 0.76 | 8.00 | 0.00 | 0.00 | 4.4 | 0.0% | 25.0% | 30 |
| 0.00 | 5.00 | 6.00 | 0.50 | 0.00 | 0.75 | 0.50 | 6.00 | 0.00 | 0.50 | 8.00 | 0.50 | 0.00 | 7.25 | 3.4% | 25.0% | 10 |
| 0.00 | 0.50 | 2.50 | 4.00 | 0.00 | 1.16 | 0.74 | 7.00 | 0.00 | 0.76 | 8.00 | 0.00 | 0.00 | 4.4 | 0.0% | 25.0% | 40 |
| 0.00 | 0.20 | 2.60 | 0.50 | 0.00 | 0.75 | 0.70 | 8.00 | 0.00 | 0.44 | 8.00 | 0.36 | 0.00 | 4.05 | 0.0% | 25.1% | 50 |
| 0.00 | 3.00 | 6.00 | 0.50 | 0.00 | 0.75 | 0.50 | 11.00 | 0.00 | 0.50 | 6.00 | 0.50 | 0.00 | 7.25 | 7.5% | 25.1% | 5 |
| 0.00 | 0.20 | 3.00 | 0.50 | 0.00 | 10.00 | 2.00 | 5.00 | 0.00 | 0.44 | 8.00 | 2.00 | 0.00 | 15 | 2.6% | 25.1% | 75 |
| 0.00 | 1.00 | 2.00 | 0.00 | 0.00 | 1.16 | 0.74 | 7.00 | 0.00 | 0.76 | 8.00 | 0.00 | 0.00 | 3.9 | 0.0% | 25.2% | 50 |
| 0.00 | 0.50 | 2.50 | 4.00 | 0.00 | 1.16 | 0.74 | 4.00 | 0.00 | 0.76 | 10.00 | 0.00 | 0.00 | 4.4 | 0.0% | 25.2% | 20 |
| 0.00 | 0.50 | 2.50 | 2.00 | 0.00 | 1.16 | 0.74 | 4.00 | 0.00 | 0.76 | 10.00 | 0.00 | 0.00 | 4.4 | 0.0% | 25.2% | 20 |
| 0.00 | 0.50 | 2.50 | 0.00 | 0.00 | 1.16 | 0.74 | 4.00 | 0.00 | 0.76 | 10.00 | 0.00 | 0.00 | 4.4 | 0.0% | 25.2% | 25 |
| 0.00 | 0.20 | 3.00 | 0.50 | 0.00 | 6.00 | 10.00 | 5.00 | 0.00 | 0.44 | 8.00 | 2.00 | 0.00 | 19 | 2.4% | 25.2% | 75 |
| 0.00 | 4.00 | 6.00 | 0.50 | 0.00 | 0.75 | 0.50 | 11.00 | 0.00 | 0.50 | 6.00 | 0.50 | 0.00 | 7.25 | 3.4% | 25.2% | 5 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 5.00 | 5.00 | 0.50 | 0.00 | 0.75 | 0.50 | 8.00 | 0.00 | 0.50 | 7.00 | 0.50 | 0.00 | 6.25 | 4.2% | 25.2% | 5 |
| 0.00 | 0.20 | 3.00 | 0.50 | 0.00 | 8.00 | 10.00 | 5.00 | 0.00 | 0.44 | 8.00 | 2.00 | 0.00 | 21 | 2.4% | 25.3% | 65 |
| 0.00 | 0.20 | 3.00 | 0.50 | 0.00 | 10.00 | 10.00 | 5.00 | 0.00 | 0.44 | 8.00 | 2.00 | 0.00 | 23 | 2.4% | 25.3% | 65 |
| 0.00 | 4.00 | 5.00 | 0.50 | 0.00 | 0.75 | 0.50 | 8.00 | 0.00 | 0.50 | 7.00 | 0.50 | 0.00 | 6.25 | 9.8% | 25.3% | 10 |
| 0.00 | 0.20 | 2.60 | 0.00 | 0.00 | 1.16 | 0.74 | 9.00 | 0.00 | 0.76 | 8.00 | 0.00 | 0.00 | 4.5 | 0.0% | 25.5% | 50 |
| 0.00 | 5.00 | 6.00 | 0.50 | 0.00 | 0.75 | 0.50 | 9.00 | 0.00 | 0.50 | 7.00 | 0.50 | 0.00 | 7.25 | 0.0% | 25.5% | 5 |
| 0.00 | 0.20 | 3.00 | 2.00 | 0.00 | 0.75 | 2.00 | 5.00 | 0.00 | 0.44 | 8.00 | 2.00 | 0.00 | 5.75 | 0.0% | 25.5% | 0 |
| 0.00 | 4.00 | 6.00 | 0.50 | 0.00 | 0.75 | 0.50 | 9.00 | 0.00 | 0.50 | 7.00 | 0.50 | 0.00 | 7.25 | 4.5% | 25.6% | 5 |
| 0.00 | 1.00 | 2.00 | 0.00 | 0.00 | 1.16 | 0.74 | 10.00 | 0.00 | 0.76 | 9.00 | 0.00 | 0.00 | 3.9 | 0.0% | 25.6% | 50 |
| 0.00 | 5.00 | 5.00 | 0.50 | 0.00 | 0.75 | 0.50 | 11.00 | 0.00 | 0.50 | 6.00 | 0.50 | 0.00 | 6.25 | 0.0% | 25.6% | 5 |
| 0.00 | 4.00 | 5.00 | 0.50 | 0.00 | 0.75 | 0.50 | 6.00 | 0.00 | 0.50 | 8.00 | 0.50 | 0.00 | 6.25 | 9.0% | 25.6% | 5 |
| 0.00 | 0.50 | 2.50 | 0.00 | 0.00 | 1.16 | 0.74 | 4.00 | 0.00 | 0.76 | 10.00 | 4.00 | 0.00 | 4.4 | 0.0% | 25.6% | 50 |
| 0.00 | 0.20 | 3.00 | 0.50 | 0.00 | 8.00 | 10.00 | 5.00 | 0.00 | 0.44 | 8.00 | 4.00 | 0.00 | 21 | 2.4% | 25.7% | 65 |
| 0.00 | 5.00 | 5.00 | 0.50 | 0.00 | 0.75 | 0.50 | 6.00 | 0.00 | 0.50 | 8.00 | 0.50 | 0.00 | 6.25 | 7.0% | 25.7% | 10 |
| 0.00 | 0.20 | 3.00 | 0.50 | 0.00 | 4.00 | 8.00 | 5.00 | 0.00 | 0.44 | 8.00 | 2.00 | 0.00 | 15 | 2.4% | 25.7% | 75 |
| 0.00 | 0.20 | 3.00 | 2.00 | 0.00 | 0.75 | 0.00 | 5.00 | 0.00 | 0.44 | 8.00 | 2.00 | 0.00 | 3.75 | 0.0% | 25.7% | 0 |
| 0.00 | 0.50 | 2.50 | 0.00 | 0.00 | 1.16 | 0.74 | 4.00 | 0.00 | 0.76 | 10.00 | 6.00 | 0.00 | 4.4 | 0.0% | 25.7% | 50 |
| 0.00 | 0.20 | 3.00 | 0.50 | 0.00 | 6.00 | 8.00 | 5.00 | 0.00 | 0.44 | 8.00 | 2.00 | 0.00 | 17 | 2.4% | 25.7% | 75 |
| 0.00 | 0.20 | 3.00 | 0.50 | 0.00 | 10.00 | 10.00 | 5.00 | 0.00 | 0.44 | 8.00 | 4.00 | 0.00 | 23 | 2.4% | 25.7% | 60 |
| 0.00 | 0.80 | 2.20 | 0.00 | 0.00 | 1.16 | 0.74 | 8.00 | 0.00 | 0.76 | 8.00 | 0.00 | 0.00 | 4.1 | 0.0% | 25.7% | 50 |
| 0.00 | 0.50 | 2.50 | 2.00 | 0.00 | 1.16 | 0.74 | 8.00 | 0.00 | 0.76 | 8.00 | 0.00 | 0.00 | 4.4 | 0.0% | 25.7% | 20 |
| 0.00 | 0.20 | 3.00 | 0.50 | 0.00 | 8.00 | 8.00 | 5.00 | 0.00 | 0.44 | 8.00 | 2.00 | 0.00 | 19 | 2.4% | 25.7% | 70 |
| 0.00 | 0.20 | 3.00 | 0.50 | 0.00 | 10.00 | 8.00 | 5.00 | 0.00 | 0.44 | 8.00 | 2.00 | 0.00 | 21 | 2.4% | 25.7% | 65 |
| 0.00 | 0.50 | 2.50 | 4.00 | 0.00 | 1.16 | 0.74 | 5.00 | 0.00 | 0.76 | 10.00 | 0.00 | 0.00 | 4.4 | 0.0% | 25.8% | 15 |
| 0.00 | 0.20 | 3.00 | 4.00 | 0.00 | 0.75 | 0.00 | 5.00 | 0.00 | 0.44 | 8.00 | 2.00 | 0.00 | 3.75 | 0.0% | 25.8% | 0 |
| 0.00 | 0.50 | 2.50 | 2.00 | 0.00 | 1.16 | 0.74 | 5.00 | 0.00 | 0.76 | 10.00 | 0.00 | 0.00 | 4.4 | 0.0% | 25.8% | 15 |
| 0.00 | 0.50 | 2.50 | 0.00 | 0.00 | 1.16 | 0.74 | 5.00 | 0.00 | 0.76 | 10.00 | 0.00 | 0.00 | 4.4 | 0.0% | 25.8% | 15 |
| 0.00 | 0.20 | 3.00 | 0.50 | 0.00 | 10.00 | 10.00 | 5.00 | 0.00 | 0.44 | 8.00 | 10.00 | 0.00 | 23 | 7.2% | 25.8% | 40 |
| 0.00 | 0.20 | 3.00 | 0.50 | 0.00 | 6.00 | 10.00 | 5.00 | 0.00 | 0.44 | 8.00 | 4.00 | 0.00 | 19 | 2.4% | 25.8% | 75 |
| 0.00 | 0.20 | 3.00 | 0.50 | 0.00 | 10.00 | 6.00 | 5.00 | 0.00 | 0.44 | 8.00 | 2.00 | 0.00 | 19 | 2.4% | 25.9% | 75 |
| 0.00 | 5.00 | 6.00 | 0.50 | 0.00 | 0.75 | 0.50 | 7.00 | 0.00 | 0.50 | 8.00 | 0.50 | 0.00 | 7.25 | 2.1% | 25.9% | 5 |
| 0.00 | 4.00 | 6.00 | 0.50 | 0.00 | 0.75 | 0.50 | 7.00 | 0.00 | 0.50 | 8.00 | 0.50 | 0.00 | 7.25 | 7.1% | 25.9% | 10 |
| 0.00 | 4.00 | 5.00 | 0.50 | 0.00 | 0.75 | 0.50 | 11.00 | 0.00 | 0.50 | 6.00 | 0.50 | 0.00 | 6.25 | 7.2% | 25.9% | 5 |
| 0.00 | 0.50 | 2.50 | 0.00 | 0.00 | 1.16 | 0.74 | 8.00 | 0.00 | 0.76 | 8.00 | 4.00 | 0.00 | 4.4 | 0.0% | 26.0% | 50 |
| 0.00 | 0.50 | 2.50 | 0.00 | 0.00 | 1.16 | 0.74 | 8.00 | 0.00 | 0.76 | 8.00 | 6.00 | 0.00 | 4.4 | 0.0% | 26.0% | 50 |
| 0.00 | 0.20 | 3.00 | 0.50 | 0.00 | 10.00 | 8.00 | 5.00 | 0.00 | 0.44 | 8.00 | 10.00 | 0.00 | 21 | 4.3% | 26.0% | 55 |
| 0.00 | 0.20 | 3.00 | 4.00 | 0.00 | 0.75 | 10.00 | 5.00 | 0.00 | 0.44 | 8.00 | 10.00 | 0.00 | 13.75 | 0.0% | 26.0% | 75 |
| 0.00 | 0.20 | 3.00 | 6.00 | 0.00 | 0.75 | 10.00 | 5.00 | 0.00 | 0.44 | 8.00 | 8.00 | 0.00 | 13.75 | 0.0% | 26.0% | 75 |
| 0.00 | 0.20 | 3.00 | 0.50 | 0.00 | 10.00 | 10.00 | 5.00 | 0.00 | 0.44 | 8.00 | 6.00 | 0.00 | 23 | 0.0% | 26.1% | 55 |
| 0.00 | 0.20 | 3.00 | 2.00 | 0.00 | 0.75 | 10.00 | 5.00 | 0.00 | 0.44 | 8.00 | 10.00 | 0.00 | 13.75 | 0.0% | 26.1% | 70 |
| 0.00 | 0.20 | 3.00 | 4.00 | 0.00 | 0.75 | 10.00 | 5.00 | 0.00 | 0.44 | 8.00 | 8.00 | 0.00 | 13.75 | 0.0% | 26.1% | 75 |
| 0.00 | 0.50 | 2.50 | 0.00 | 0.00 | 1.16 | 0.74 | 6.00 | 0.00 | 0.76 | 10.00 | 4.00 | 0.00 | 4.4 | 0.0% | 26.1% | 50 |
| 0.00 | 0.50 | 2.50 | 0.00 | 0.00 | 1.16 | 0.74 | 6.00 | 0.00 | 0.76 | 10.00 | 6.00 | 0.00 | 4.4 | 0.0% | 26.1% | 50 |
| 0.00 | 0.20 | 3.00 | 0.50 | 0.00 | 8.00 | 10.00 | 5.00 | 0.00 | 0.44 | 8.00 | 10.00 | 0.00 | 21 | 7.1% | 26.1% | 45 |
| 0.00 | 0.20 | 3.00 | 0.50 | 0.00 | 6.00 | 10.00 | 5.00 | 0.00 | 0.44 | 8.00 | 10.00 | 0.00 | 19 | 7.1% | 26.1% | 55 |
| 0.00 | 0.20 | 3.00 | 0.50 | 0.00 | 4.00 | 10.00 | 5.00 | 0.00 | 0.44 | 8.00 | 10.00 | 0.00 | 17 | 7.1% | 26.2% | 60 |
| 0.00 | 0.20 | 3.00 | 0.50 | 0.00 | 2.00 | 10.00 | 5.00 | 0.00 | 0.44 | 8.00 | 10.00 | 0.00 | 15 | 2.4% | 26.2% | 60 |
| 0.00 | 5.00 | 5.00 | 0.50 | 0.00 | 0.75 | 0.50 | 9.00 | 0.00 | 0.50 | 7.00 | 0.50 | 0.00 | 6.25 | 3.6% | 26.2% | 5 |
| 0.00 | 0.20 | 3.00 | 0.50 | 0.00 | 0.00 | 10.00 | 5.00 | 0.00 | 0.44 | 8.00 | 10.00 | 0.00 | 13 | 7.1% | 26.2% | 70 |
| 0.00 | 0.50 | 2.50 | 0.00 | 0.00 | 1.16 | 0.74 | 6.00 | 0.00 | 0.76 | 10.00 | 0.00 | 0.00 | 4.4 | 0.0% | 26.2% | 20 |
| 0.00 | 0.20 | 3.00 | 0.50 | 0.00 | 4.00 | 10.00 | 5.00 | 0.00 | 0.44 | 8.00 | 4.00 | 0.00 | 17 | 5.9% | 26.2% | 75 |
| 0.00 | 0.20 | 3.00 | 0.50 | 0.00 | 8.00 | 8.00 | 5.00 | 0.00 | 0.44 | 8.00 | 10.00 | 0.00 | 19 | 4.0% | 26.2% | 60 |
| 0.00 | 0.50 | 2.50 | 2.00 | 0.00 | 1.16 | 0.74 | 6.00 | 0.00 | 0.76 | 10.00 | 0.00 | 0.00 | 4.4 | 0.0% | 26.2% | 15 |
| 0.00 | 0.20 | 3.00 | 0.00 | 0.00 | 0.75 | 10.00 | 5.00 | 0.00 | 0.44 | 8.00 | 10.00 | 0.00 | 13.75 | 7.0% | 26.2% | 65 |
| 0.00 | 0.20 | 3.00 | 2.00 | 0.00 | 0.75 | 10.00 | 5.00 | 0.00 | 0.44 | 8.00 | 8.00 | 0.00 | 13.75 | 0.0% | 26.2% | 70 |
| 0.00 | 0.20 | 3.00 | 0.50 | 0.00 | 8.00 | 10.00 | 5.00 | 0.00 | 0.44 | 8.00 | 6.00 | 0.00 | 21 | 0.0% | 26.2% | 60 |
| 0.00 | 1.00 | 2.50 | 2.00 | 0.00 | 1.16 | 0.74 | 7.00 | 0.00 | 0.76 | 8.00 | 0.00 | 0.00 | 4.4 | 0.0% | 26.2% | 60 |
| 0.00 | 0.50 | 2.50 | 2.00 | 0.00 | 1.16 | 0.74 | 9.00 | 0.00 | 0.76 | 8.00 | 0.00 | 0.00 | 4.4 | 0.0% | 26.3% | 15 |
| 0.00 | 0.20 | 3.00 | 0.50 | 0.00 | 8.00 | 10.00 | 5.00 | 0.00 | 0.44 | 8.00 | 8.00 | 0.00 | 21 | 0.0% | 26.3% | 50 |
| 0.00 | 0.20 | 3.00 | 0.50 | 0.00 | 10.00 | 10.00 | 5.00 | 0.00 | 0.44 | 8.00 | 8.00 | 0.00 | 23 | 0.0% | 26.3% | 50 |
| 0.00 | 0.20 | 3.00 | 0.50 | 0.00 | 6.00 | 10.00 | 5.00 | 0.00 | 0.44 | 8.00 | 8.00 | 0.00 | 19 | 6.4% | 26.3% | 50 |
| 0.00 | 0.20 | 3.00 | 0.50 | 0.00 | 4.00 | 10.00 | 5.00 | 0.00 | 0.44 | 8.00 | 8.00 | 0.00 | 17 | 6.4% | 26.3% | 60 |
| 0.00 | 0.20 | 3.00 | 2.00 | 0.00 | 0.75 | 10.00 | 5.00 | 0.00 | 0.44 | 8.00 | 6.00 | 0.00 | 13.75 | 0.0% | 26.3% | 75 |
| 0.00 | 0.20 | 3.00 | 0.50 | 0.00 | 2.00 | 10.00 | 5.00 | 0.00 | 0.44 | 8.00 | 8.00 | 0.00 | 15 | 6.4% | 26.3% | 65 |
| 0.00 | 0.20 | 3.00 | 0.50 | 0.00 | 8.00 | 8.00 | 5.00 | 0.00 | 0.44 | 8.00 | 4.00 | 0.00 | 19 | 0.0% | 26.3% | 65 |
| 0.00 | 0.20 | 3.00 | 0.50 | 0.00 | 0.00 | 10.00 | 5.00 | 0.00 | 0.44 | 8.00 | 8.00 | 0.00 | 13 | 6.3% | 26.3% | 70 |
| 0.00 | 0.20 | 3.00 | 0.00 | 0.00 | 0.75 | 10.00 | 5.00 | 0.00 | 0.44 | 8.00 | 8.00 | 0.00 | 13.75 | 6.3% | 26.4% | 65 |
| 0.00 | 0.20 | 3.00 | 0.50 | 0.00 | 10.00 | 8.00 | 5.00 | 0.00 | 0.44 | 8.00 | 4.00 | 0.00 | 21 | 0.0% | 26.4% | 60 |
| 0.00 | 0.50 | 2.50 | 0.00 | 0.00 | 1.16 | 0.74 | 7.00 | 0.00 | 0.76 | 10.00 | 0.00 | 0.00 | 4.4 | 0.0% | 26.4% | 30 |
| 0.00 | 0.20 | 3.00 | 0.50 | 0.00 | 6.00 | 10.00 | 5.00 | 0.00 | 0.44 | 8.00 | 6.00 | 0.00 | 19 | 0.0% | 26.4% | 60 |
| 0.00 | 0.20 | 3.00 | 0.50 | 0.00 | 4.00 | 10.00 | 5.00 | 0.00 | 0.44 | 8.00 | 6.00 | 0.00 | 17 | 5.8% | 26.4% | 65 |
| 0.00 | 5.00 | 6.00 | 0.50 | 0.00 | 0.75 | 0.50 | 10.00 | 0.00 | 0.50 | 7.00 | 0.50 | 0.00 | 7.25 | 0.0% | 26.4% | 5 |
| 0.00 | 0.20 | 3.00 | 0.50 | 0.00 | 2.00 | 10.00 | 5.00 | 0.00 | 0.44 | 8.00 | 6.00 | 0.00 | 15 | 5.7% | 26.4% | 70 |
| 0.00 | 0.20 | 3.00 | 0.50 | 0.00 | 0.00 | 10.00 | 5.00 | 0.00 | 0.44 | 8.00 | 6.00 | 0.00 | 13 | 5.7% | 26.4% | 70 |
| 0.00 | 0.00 | 3.00 | 0.00 | 0.00 | 1.16 | 0.74 | 4.00 | 0.00 | 0.76 | 9.00 | 6.00 | 0.00 | 4.9 | 0.0% | 26.4% | 50 |
| 0.00 | 0.20 | 3.00 | 0.50 | 0.00 | 10.00 | 4.00 | 5.00 | 0.00 | 0.44 | 8.00 | 4.00 | 0.00 | 17 | 2.3% | 26.4% | 65 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.20 | 3.00 | 0.00 | 0.00 | 0.75 | 10.00 | 5.00 | 0.00 | 0.44 | 8.00 | 6.00 | 0.00 | 13.75 | 3.2% | 26.4% | 70 |
| 0.00 | 0.20 | 3.00 | 0.50 | 0.00 | 8.00 | 4.00 | 5.00 | 0.00 | 0.44 | 8.00 | 4.00 | 0.00 | 15 | 2.3% | 26.5% | 75 |
| 0.00 | 0.20 | 3.00 | 0.50 | 0.00 | 6.00 | 8.00 | 5.00 | 0.00 | 0.44 | 8.00 | 4.00 | 0.00 | 17 | 0.0% | 26.5% | 75 |
| 0.00 | 0.20 | 3.00 | 0.50 | 0.00 | 6.00 | 4.00 | 5.00 | 0.00 | 0.44 | 8.00 | 4.00 | 0.00 | 13 | 2.3% | 26.5% | 75 |
| 0.00 | 0.20 | 3.00 | 0.50 | 0.00 | 6.00 | 8.00 | 5.00 | 0.00 | 0.44 | 8.00 | 10.00 | 0.00 | 17 | 3.9% | 26.5% | 60 |
| 0.00 | 0.50 | 2.50 | 0.00 | 0.00 | 1.16 | 0.74 | 8.00 | 0.00 | 0.76 | 10.00 | 4.00 | 0.00 | 4.4 | 0.0% | 26.5% | 50 |
| 0.00 | 4.00 | 6.00 | 0.50 | 0.00 | 0.75 | 0.50 | 10.00 | 0.00 | 0.50 | 7.00 | 0.50 | 0.00 | 7.25 | 4.7% | 26.5% | 5 |
| 0.00 | 0.50 | 2.50 | 0.00 | 0.00 | 1.16 | 0.74 | 8.00 | 0.00 | 0.76 | 10.00 | 2.00 | 0.00 | 4.4 | 0.0% | 26.5% | 50 |
| 0.00 | 0.50 | 2.50 | 4.00 | 0.00 | 1.16 | 0.74 | 8.00 | 0.00 | 0.76 | 10.00 | 0.00 | 0.00 | 4.4 | 1.9% | 26.5% | 40 |
| 0.00 | 0.50 | 2.50 | 0.00 | 0.00 | 1.16 | 0.74 | 10.00 | 0.00 | 0.76 | 8.00 | 6.00 | 0.00 | 4.4 | 0.0% | 26.5% | 50 |
| 0.00 | 0.50 | 2.50 | 0.00 | 0.00 | 1.16 | 0.74 | 10.00 | 0.00 | 0.76 | 8.00 | 4.00 | 0.00 | 4.4 | 0.0% | 26.5% | 50 |
| 0.00 | 1.00 | 2.50 | 0.00 | 0.00 | 1.16 | 0.74 | 4.00 | 0.00 | 0.76 | 10.00 | 0.00 | 0.00 | 4.4 | 0.0% | 26.6% | 50 |
| 0.00 | 5.00 | 5.00 | 0.50 | 0.00 | 0.75 | 0.50 | 7.00 | 0.00 | 0.50 | 8.00 | 0.50 | 0.00 | 6.25 | 7.2% | 26.6% | 10 |
| 0.00 | 0.20 | 3.00 | 0.50 | 0.00 | 10.00 | 8.00 | 5.00 | 0.00 | 0.44 | 8.00 | 8.00 | 0.00 | 21 | 0.0% | 26.6% | 55 |
| 0.00 | 0.00 | 3.00 | 0.00 | 0.00 | 1.16 | 0.74 | 6.00 | 0.00 | 0.76 | 8.00 | 6.00 | 0.00 | 4.9 | 0.0% | 26.6% | 50 |
| 0.00 | 0.50 | 2.50 | 0.00 | 0.00 | 1.16 | 0.74 | 8.00 | 0.00 | 0.76 | 10.00 | 0.00 | 0.00 | 4.4 | 0.0% | 26.6% | 45 |
| 0.00 | 0.50 | 2.50 | 2.00 | 0.00 | 1.16 | 0.74 | 10.00 | 0.00 | 0.76 | 8.00 | 0.00 | 0.00 | 4.4 | 0.0% | 26.6% | 20 |
| 0.00 | 0.50 | 2.50 | 0.00 | 0.00 | 1.16 | 0.74 | 10.00 | 0.00 | 0.76 | 8.00 | 0.00 | 0.00 | 4.4 | 0.0% | 26.6% | 25 |
| 0.00 | 1.00 | 2.50 | 2.00 | 0.00 | 1.16 | 0.74 | 4.00 | 0.00 | 0.76 | 10.00 | 0.00 | 0.00 | 4.4 | 0.0% | 26.7% | 45 |
| 0.00 | 0.00 | 3.00 | 0.00 | 0.00 | 1.16 | 0.74 | 6.00 | 0.00 | 0.76 | 10.00 | 2.00 | 0.00 | 4.9 | 0.0% | 26.7% | 50 |
| 0.00 | 0.50 | 2.50 | 0.00 | 0.00 | 1.16 | 0.74 | 9.00 | 0.00 | 0.76 | 10.00 | 0.00 | 0.00 | 4.4 | 0.0% | 26.7% | 60 |
| 0.00 | 0.20 | 3.00 | 0.50 | 0.00 | 6.00 | 4.00 | 5.00 | 0.00 | 0.44 | 8.00 | 6.00 | 0.00 | 13 | 0.0% | 26.7% | 75 |
| 0.00 | 0.20 | 3.00 | 0.50 | 0.00 | 4.00 | 4.00 | 5.00 | 0.00 | 0.44 | 8.00 | 6.00 | 0.00 | 11 | 2.3% | 26.7% | 75 |
| 0.00 | 0.20 | 3.00 | 0.50 | 0.00 | 10.00 | 6.00 | 5.00 | 0.00 | 0.44 | 8.00 | 4.00 | 0.00 | 19 | 2.4% | 26.7% | 65 |
| 0.00 | 0.20 | 3.00 | 0.50 | 0.00 | 8.00 | 4.00 | 5.00 | 0.00 | 0.44 | 8.00 | 6.00 | 0.00 | 15 | 2.3% | 26.7% | 75 |
| 0.00 | 1.00 | 2.50 | 4.00 | 0.00 | 1.16 | 0.74 | 4.00 | 0.00 | 0.76 | 10.00 | 0.00 | 0.00 | 4.4 | 0.0% | 26.7% | 40 |
| 0.00 | 0.20 | 3.00 | 0.50 | 0.00 | 8.00 | 6.00 | 5.00 | 0.00 | 0.44 | 8.00 | 4.00 | 0.00 | 17 | 2.4% | 26.7% | 75 |
| 0.00 | 0.00 | 3.00 | 0.00 | 0.00 | 1.16 | 0.74 | 8.00 | 0.00 | 0.76 | 7.00 | 6.00 | 0.00 | 4.9 | 0.0% | 26.7% | 50 |
| 0.00 | 0.20 | 3.00 | 0.50 | 0.00 | 10.00 | 4.00 | 5.00 | 0.00 | 0.44 | 8.00 | 6.00 | 0.00 | 17 | 2.3% | 26.7% | 65 |
| 0.00 | 5.00 | 6.00 | 0.50 | 0.00 | 0.75 | 0.50 | 8.00 | 0.00 | 0.50 | 8.00 | 0.50 | 0.00 | 7.25 | 2.2% | 26.8% | 5 |
| 0.00 | 0.20 | 3.00 | 0.50 | 0.00 | 10.00 | 8.00 | 5.00 | 0.00 | 0.44 | 8.00 | 6.00 | 0.00 | 21 | 0.0% | 26.8% | 60 |
| 0.00 | 4.00 | 6.00 | 0.50 | 0.00 | 0.75 | 0.50 | 8.00 | 0.00 | 0.50 | 8.00 | 0.50 | 0.00 | 7.25 | 5.7% | 26.8% | 10 |
| 0.00 | 0.20 | 3.00 | 0.50 | 0.00 | 4.00 | 8.00 | 5.00 | 0.00 | 0.44 | 8.00 | 10.00 | 0.00 | 15 | 3.7% | 26.8% | 60 |
| 0.00 | 0.20 | 3.00 | 0.50 | 0.00 | 8.00 | 8.00 | 5.00 | 0.00 | 0.44 | 8.00 | 8.00 | 0.00 | 19 | 0.0% | 26.9% | 60 |
| 0.00 | 0.00 | 3.00 | 0.00 | 0.00 | 1.16 | 0.74 | 8.00 | 0.00 | 0.76 | 9.00 | 2.00 | 0.00 | 4.9 | 0.0% | 26.9% | 50 |
| 0.00 | 0.50 | 3.00 | 0.50 | 0.00 | 0.75 | 0.50 | 6.00 | 0.00 | 0.50 | 9.00 | 0.50 | 0.00 | 4.25 | 0.0% | 26.9% | 75 |
| 0.00 | 0.00 | 3.00 | 0.00 | 0.00 | 1.16 | 0.74 | 10.00 | 0.00 | 0.76 | 8.00 | 0.00 | 0.00 | 4.9 | 0.0% | 26.9% | 50 |
| 0.00 | 0.20 | 3.00 | 0.50 | 0.00 | 10.00 | 4.00 | 5.00 | 0.00 | 0.44 | 8.00 | 8.00 | 0.00 | 17 | 0.0% | 26.9% | 60 |
| 0.00 | 0.20 | 3.00 | 0.50 | 0.00 | 8.00 | 6.00 | 5.00 | 0.00 | 0.44 | 8.00 | 6.00 | 0.00 | 17 | 2.4% | 26.9% | 75 |
| 0.00 | 0.20 | 3.00 | 0.50 | 0.00 | 6.00 | 6.00 | 5.00 | 0.00 | 0.44 | 8.00 | 6.00 | 0.00 | 15 | 0.0% | 26.9% | 75 |
| 0.00 | 0.20 | 3.00 | 0.50 | 0.00 | 8.00 | 4.00 | 5.00 | 0.00 | 0.44 | 8.00 | 8.00 | 0.00 | 15 | 2.1% | 26.9% | 65 |
| 0.00 | 0.20 | 3.00 | 2.00 | 0.00 | 0.75 | 8.00 | 5.00 | 0.00 | 0.44 | 8.00 | 10.00 | 0.00 | 11.75 | 0.0% | 26.9% | 75 |
| 0.00 | 0.20 | 3.00 | 0.50 | 0.00 | 10.00 | 6.00 | 5.00 | 0.00 | 0.44 | 8.00 | 6.00 | 0.00 | 19 | 0.0% | 27.0% | 75 |
| 0.00 | 0.20 | 3.00 | 0.50 | 0.00 | 8.00 | 8.00 | 5.00 | 0.00 | 0.44 | 8.00 | 6.00 | 0.00 | 19 | 0.0% | 27.0% | 65 |
| 0.00 | 0.20 | 3.00 | 0.50 | 0.00 | 6.00 | 4.00 | 5.00 | 0.00 | 0.44 | 8.00 | 8.00 | 0.00 | 13 | 2.1% | 27.0% | 65 |
| 0.00 | 0.20 | 3.00 | 0.50 | 0.00 | 10.00 | 2.00 | 5.00 | 0.00 | 0.44 | 8.00 | 4.00 | 0.00 | 15 | 0.8% | 27.0% | 65 |
| 0.00 | 0.20 | 3.00 | 0.50 | 0.00 | 8.00 | 2.00 | 5.00 | 0.00 | 0.44 | 8.00 | 4.00 | 0.00 | 13 | 0.8% | 27.0% | 65 |
| 0.00 | 0.00 | 3.00 | 0.00 | 0.00 | 1.16 | 0.74 | 10.00 | 0.00 | 0.76 | 7.00 | 6.00 | 0.00 | 4.9 | 0.0% | 27.0% | 50 |
| 0.00 | 0.20 | 3.00 | 0.50 | 0.00 | 6.00 | 2.00 | 5.00 | 0.00 | 0.44 | 8.00 | 4.00 | 0.00 | 11 | 0.8% | 27.0% | 75 |
| 0.00 | 0.20 | 3.00 | 0.50 | 0.00 | 2.00 | 8.00 | 5.00 | 0.00 | 0.44 | 8.00 | 10.00 | 0.00 | 13 | 2.4% | 27.0% | 70 |
| 0.00 | 0.20 | 3.00 | 0.50 | 0.00 | 4.00 | 2.00 | 5.00 | 0.00 | 0.44 | 8.00 | 4.00 | 0.00 | 9 | 0.8% | 27.0% | 75 |
| 0.00 | 0.20 | 3.00 | 0.50 | 0.00 | 4.00 | 4.00 | 5.00 | 0.00 | 0.44 | 8.00 | 8.00 | 0.00 | 11 | 2.0% | 27.0% | 65 |
| 0.00 | 0.20 | 3.00 | 0.50 | 0.00 | 0.00 | 8.00 | 5.00 | 0.00 | 0.44 | 8.00 | 10.00 | 0.00 | 11 | 2.4% | 27.0% | 70 |
| 0.00 | 0.20 | 3.00 | 0.00 | 0.00 | 0.75 | 8.00 | 5.00 | 0.00 | 0.44 | 8.00 | 10.00 | 0.00 | 11.75 | 1.2% | 27.0% | 65 |
| 0.00 | 0.20 | 3.00 | 0.50 | 0.00 | 2.00 | 4.00 | 5.00 | 0.00 | 0.44 | 8.00 | 8.00 | 0.00 | 9 | 2.0% | 27.1% | 70 |
| 0.00 | 0.20 | 3.00 | 2.00 | 0.00 | 0.75 | 6.00 | 5.00 | 0.00 | 0.44 | 8.00 | 8.00 | 0.00 | 9.75 | 2.3% | 27.1% | 75 |
| 0.00 | 0.20 | 3.00 | 0.50 | 0.00 | 10.00 | 6.00 | 5.00 | 0.00 | 0.44 | 8.00 | 8.00 | 0.00 | 19 | 2.3% | 27.1% | 60 |
| 0.00 | 0.20 | 3.00 | 0.50 | 0.00 | 8.00 | 6.00 | 5.00 | 0.00 | 0.44 | 8.00 | 8.00 | 0.00 | 17 | 2.3% | 27.1% | 65 |
| 0.00 | 0.20 | 3.00 | 0.50 | 0.00 | 6.00 | 6.00 | 5.00 | 0.00 | 0.44 | 8.00 | 8.00 | 0.00 | 15 | 2.3% | 27.1% | 65 |
| 0.00 | 0.20 | 3.00 | 0.50 | 0.00 | 4.00 | 6.00 | 5.00 | 0.00 | 0.44 | 8.00 | 8.00 | 0.00 | 13 | 2.3% | 27.1% | 70 |
| 0.00 | 0.00 | 3.00 | 0.00 | 0.00 | 1.16 | 0.74 | 20.00 | 0.00 | 0.76 | 2.00 | 0.00 | 0.00 | 4.9 | 0.0% | 27.1% | 50 |
| 0.00 | 0.20 | 3.00 | 0.50 | 0.00 | 2.00 | 6.00 | 5.00 | 0.00 | 0.44 | 8.00 | 8.00 | 0.00 | 11 | 2.3% | 27.1% | 70 |
| 0.00 | 0.20 | 3.00 | 0.50 | 0.00 | 0.00 | 6.00 | 5.00 | 0.00 | 0.44 | 8.00 | 8.00 | 0.00 | 9 | 2.4% | 27.1% | 75 |
| 0.00 | 0.00 | 3.00 | 0.00 | 0.00 | 1.16 | 0.74 | 10.00 | 0.00 | 0.76 | 8.00 | 2.00 | 0.00 | 4.9 | 0.0% | 27.1% | 50 |
| 0.00 | 0.20 | 3.00 | 0.50 | 0.00 | 6.00 | 8.00 | 5.00 | 0.00 | 0.44 | 8.00 | 8.00 | 0.00 | 17 | 0.0% | 27.1% | 65 |
| 0.00 | 0.20 | 3.00 | 0.00 | 0.00 | 0.75 | 6.00 | 5.00 | 0.00 | 0.44 | 8.00 | 8.00 | 0.00 | 9.75 | 2.4% | 27.1% | 70 |
| 0.00 | 0.20 | 3.00 | 0.50 | 0.00 | 0.00 | 4.00 | 5.00 | 0.00 | 0.44 | 8.00 | 8.00 | 0.00 | 7 | 1.9% | 27.1% | 75 |
| 0.00 | 5.00 | 5.00 | 0.50 | 0.00 | 0.75 | 0.50 | 10.00 | 0.00 | 0.50 | 7.00 | 0.50 | 0.00 | 6.25 | 2.9% | 27.1% | 5 |
| 0.00 | 0.20 | 3.00 | 0.50 | 0.00 | 4.00 | 8.00 | 5.00 | 0.00 | 0.44 | 8.00 | 8.00 | 0.00 | 15 | 3.1% | 27.1% | 70 |
| 0.00 | 0.20 | 3.00 | 0.50 | 0.00 | 10.00 | 0.00 | 5.00 | 0.00 | 0.44 | 8.00 | 4.00 | 0.00 | 13 | 0.0% | 27.1% | 65 |
| 0.00 | 0.20 | 3.00 | 0.50 | 0.00 | 2.00 | 8.00 | 5.00 | 0.00 | 0.44 | 8.00 | 8.00 | 0.00 | 13 | 3.0% | 27.1% | 75 |
| 0.00 | 0.20 | 3.00 | 0.50 | 0.00 | 6.00 | 8.00 | 5.00 | 0.00 | 0.44 | 8.00 | 6.00 | 0.00 | 17 | 0.0% | 27.1% | 70 |
| 0.00 | 0.20 | 3.00 | 0.50 | 0.00 | 8.00 | 0.00 | 5.00 | 0.00 | 0.44 | 8.00 | 4.00 | 0.00 | 11 | 0.0% | 27.1% | 65 |
| 0.00 | 0.20 | 3.00 | 0.50 | 0.00 | 4.00 | 8.00 | 5.00 | 0.00 | 0.44 | 8.00 | 6.00 | 0.00 | 15 | 0.0% | 27.1% | 70 |
| 0.00 | 0.20 | 3.00 | 0.50 | 0.00 | 6.00 | 0.00 | 5.00 | 0.00 | 0.44 | 8.00 | 4.00 | 0.00 | 9 | 0.0% | 27.1% | 65 |
| 0.00 | 0.50 | 3.00 | 0.50 | 0.00 | 0.75 | 0.50 | 8.00 | 0.00 | 0.50 | 8.00 | 0.50 | 0.00 | 4.25 | 0.0% | 27.1% | 75 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.20 | 3.00 | 0.50 | 0.00 | 4.00 | 0.00 | 5.00 | 0.00 | 0.44 | 8.00 | 4.00 | 0.00 | 7 | 0.0% | 27.1% | 70 |
| 0.00 | 0.20 | 3.00 | 2.00 | 0.00 | 0.75 | 6.00 | 5.00 | 0.00 | 0.44 | 8.00 | 10.00 | 0.00 | 9.75 | 0.0% | 27.2% | 75 |
| 0.00 | 0.20 | 3.00 | 0.00 | 0.00 | 0.75 | 8.00 | 5.00 | 0.00 | 0.44 | 8.00 | 8.00 | 0.00 | 11.75 | 5.3% | 27.2% | 75 |
| 0.00 | 0.20 | 3.00 | 0.00 | 0.00 | 0.75 | 0.00 | 5.00 | 0.00 | 0.44 | 8.00 | 4.00 | 0.00 | 3.75 | 0.0% | 27.2% | 75 |
| 0.00 | 0.20 | 3.00 | 0.50 | 0.00 | 2.00 | 0.00 | 5.00 | 0.00 | 0.44 | 8.00 | 4.00 | 0.00 | 5 | 0.0% | 27.2% | 75 |
| 0.00 | 0.20 | 3.00 | 0.50 | 0.00 | 10.00 | 6.00 | 5.00 | 0.00 | 0.44 | 8.00 | 10.00 | 0.00 | 19 | 2.3% | 27.2% | 50 |
| 0.00 | 0.20 | 3.00 | 0.50 | 0.00 | 8.00 | 6.00 | 5.00 | 0.00 | 0.44 | 8.00 | 10.00 | 0.00 | 17 | 2.3% | 27.2% | 55 |
| 0.00 | 0.20 | 3.00 | 0.50 | 0.00 | 6.00 | 6.00 | 5.00 | 0.00 | 0.44 | 8.00 | 10.00 | 0.00 | 15 | 2.3% | 27.2% | 55 |
| 0.00 | 0.20 | 3.00 | 0.50 | 0.00 | 4.00 | 6.00 | 5.00 | 0.00 | 0.44 | 8.00 | 10.00 | 0.00 | 13 | 2.3% | 27.2% | 65 |
| 0.00 | 5.00 | 6.00 | 0.50 | 0.00 | 0.75 | 0.50 | 6.00 | 0.00 | 0.50 | 9.00 | 0.50 | 0.00 | 7.25 | 3.4% | 27.2% | 5 |
| 0.00 | 0.20 | 3.00 | 0.50 | 0.00 | 2.00 | 6.00 | 5.00 | 0.00 | 0.44 | 8.00 | 10.00 | 0.00 | 11 | 2.3% | 27.2% | 65 |
| 0.00 | 0.20 | 3.00 | 0.50 | 0.00 | 0.00 | 6.00 | 5.00 | 0.00 | 0.44 | 8.00 | 10.00 | 0.00 | 9 | 2.3% | 27.2% | 70 |
| 0.00 | 0.20 | 3.00 | 0.00 | 0.00 | 0.75 | 6.00 | 5.00 | 0.00 | 0.44 | 8.00 | 10.00 | 0.00 | 9.75 | 2.3% | 27.2% | 70 |
| 0.00 | 1.00 | 2.50 | 2.00 | 0.00 | 1.16 | 0.74 | 8.00 | 0.00 | 0.76 | 8.00 | 0.00 | 0.00 | 4.4 | 0.0% | 27.2% | 45 |
| 0.00 | 1.00 | 2.50 | 4.00 | 0.00 | 1.16 | 0.74 | 8.00 | 0.00 | 0.76 | 8.00 | 0.00 | 0.00 | 4.4 | 0.0% | 27.2% | 40 |
| 0.00 | 4.00 | 5.00 | 0.50 | 0.00 | 0.75 | 0.50 | 10.00 | 0.00 | 0.50 | 7.00 | 0.50 | 0.00 | 6.25 | 8.5% | 27.2% | 5 |
| 0.00 | 0.20 | 3.00 | 0.50 | 0.00 | 10.00 | 4.00 | 5.00 | 0.00 | 0.44 | 8.00 | 10.00 | 0.00 | 17 | 0.0% | 27.3% | 55 |
| 0.00 | 0.20 | 3.00 | 0.50 | 0.00 | 8.00 | 4.00 | 5.00 | 0.00 | 0.44 | 8.00 | 10.00 | 0.00 | 15 | 1.7% | 27.3% | 55 |
| 0.00 | 5.00 | 6.00 | 0.50 | 0.00 | 0.75 | 0.50 | 11.00 | 0.00 | 0.50 | 7.00 | 0.50 | 0.00 | 7.25 | 0.0% | 27.3% | 5 |
| 0.00 | 0.20 | 3.00 | 0.50 | 0.00 | 6.00 | 4.00 | 5.00 | 0.00 | 0.44 | 8.00 | 10.00 | 0.00 | 13 | 1.7% | 27.3% | 60 |
| 0.00 | 0.80 | 2.40 | 0.00 | 0.00 | 1.16 | 0.74 | 8.00 | 0.00 | 0.76 | 9.00 | 0.00 | 0.00 | 4.3 | 0.0% | 27.3% | 50 |
| 0.00 | 0.00 | 3.00 | 0.00 | 0.00 | 1.16 | 0.74 | 8.00 | 0.00 | 0.76 | 10.00 | 2.00 | 0.00 | 4.9 | 0.0% | 27.3% | 50 |
| 0.00 | 0.20 | 3.00 | 2.00 | 0.00 | 0.75 | 4.00 | 5.00 | 0.00 | 0.44 | 8.00 | 10.00 | 0.00 | 7.75 | 0.0% | 27.4% | 70 |
| 0.00 | 0.20 | 3.00 | 0.50 | 0.00 | 4.00 | 4.00 | 5.00 | 0.00 | 0.44 | 8.00 | 10.00 | 0.00 | 11 | 1.6% | 27.4% | 60 |
| 0.00 | 0.20 | 3.00 | 0.50 | 0.00 | 2.00 | 4.00 | 5.00 | 0.00 | 0.44 | 8.00 | 10.00 | 0.00 | 9 | 1.6% | 27.4% | 65 |
| 0.00 | 4.00 | 6.00 | 0.50 | 0.00 | 0.75 | 0.50 | 11.00 | 0.00 | 0.50 | 7.00 | 0.50 | 0.00 | 7.25 | 4.9% | 27.4% | 5 |
| 0.00 | 0.20 | 3.00 | 0.50 | 0.00 | 0.00 | 4.00 | 5.00 | 0.00 | 0.44 | 8.00 | 10.00 | 0.00 | 7 | 1.5% | 27.4% | 70 |
| 0.00 | 0.00 | 3.00 | 0.00 | 0.00 | 1.16 | 0.74 | 14.00 | 0.00 | 0.76 | 6.00 | 0.00 | 0.00 | 4.9 | 0.0% | 27.4% | 50 |
| 0.00 | 0.20 | 3.00 | 0.00 | 0.00 | 0.75 | 4.00 | 5.00 | 0.00 | 0.44 | 8.00 | 10.00 | 0.00 | 7.75 | 3.0% | 27.5% | 65 |
| 0.00 | 1.00 | 2.50 | 0.00 | 0.00 | 1.16 | 0.74 | 5.00 | 0.00 | 0.76 | 10.00 | 0.00 | 0.00 | 4.4 | 0.0% | 27.5% | 30 |
| 0.00 | 5.00 | 5.00 | 0.50 | 0.00 | 0.75 | 0.50 | 8.00 | 0.00 | 0.50 | 8.00 | 0.50 | 0.00 | 6.25 | 5.8% | 27.5% | 5 |
| 0.00 | 1.00 | 2.50 | 4.00 | 0.00 | 1.16 | 0.74 | 5.00 | 0.00 | 0.76 | 10.00 | 0.00 | 0.00 | 4.4 | 0.0% | 27.5% | 25 |
| 0.00 | 1.00 | 2.50 | 2.00 | 0.00 | 1.16 | 0.74 | 5.00 | 0.00 | 0.76 | 10.00 | 0.00 | 0.00 | 4.4 | 0.0% | 27.5% | 30 |
| 0.00 | 0.20 | 3.00 | 0.50 | 0.00 | 4.00 | 0.00 | 5.00 | 0.00 | 0.44 | 8.00 | 6.00 | 0.00 | 7 | 0.0% | 27.6% | 75 |
| 0.00 | 0.00 | 3.00 | 0.00 | 0.00 | 1.16 | 0.74 | 10.00 | 0.00 | 0.76 | 9.00 | 2.00 | 0.00 | 4.9 | 0.0% | 27.6% | 50 |
| 0.00 | 0.20 | 3.00 | 0.50 | 0.00 | 6.00 | 0.00 | 5.00 | 0.00 | 0.44 | 8.00 | 6.00 | 0.00 | 9 | 0.0% | 27.6% | 70 |
| 0.00 | 0.00 | 3.00 | 0.00 | 0.00 | 1.16 | 0.74 | 10.00 | 0.00 | 0.76 | 9.00 | 6.00 | 0.00 | 4.9 | 0.0% | 27.6% | 50 |
| 0.00 | 0.20 | 3.00 | 0.50 | 0.00 | 8.00 | 0.00 | 5.00 | 0.00 | 0.44 | 8.00 | 6.00 | 0.00 | 11 | 0.0% | 27.6% | 65 |
| 0.00 | 0.20 | 3.00 | 0.50 | 0.00 | 10.00 | 0.00 | 5.00 | 0.00 | 0.44 | 8.00 | 6.00 | 0.00 | 13 | 0.0% | 27.6% | 65 |
| 0.00 | 0.00 | 3.00 | 0.00 | 0.00 | 1.16 | 0.74 | 10.00 | 0.00 | 0.76 | 9.00 | 0.00 | 0.00 | 4.9 | 0.0% | 27.7% | 50 |
| 0.00 | 0.20 | 3.00 | 0.50 | 0.00 | 6.00 | 2.00 | 5.00 | 0.00 | 0.44 | 8.00 | 6.00 | 0.00 | 11 | 0.0% | 27.7% | 75 |
| 0.00 | 5.00 | 6.00 | 0.50 | 0.00 | 0.75 | 0.50 | 9.00 | 0.00 | 0.50 | 8.00 | 0.50 | 0.00 | 7.25 | 2.5% | 27.7% | 5 |
| 0.00 | 4.00 | 6.00 | 0.50 | 0.00 | 0.75 | 0.50 | 9.00 | 0.00 | 0.50 | 8.00 | 0.50 | 0.00 | 7.25 | 6.1% | 27.7% | 10 |
| 0.00 | 0.20 | 3.00 | 2.00 | 0.00 | 0.75 | 0.00 | 5.00 | 0.00 | 0.44 | 8.00 | 8.00 | 0.00 | 3.75 | 0.0% | 27.7% | 75 |
| 0.00 | 0.20 | 3.00 | 0.50 | 0.00 | 8.00 | 2.00 | 5.00 | 0.00 | 0.44 | 8.00 | 6.00 | 0.00 | 13 | 0.0% | 27.7% | 70 |
| 0.00 | 0.20 | 3.00 | 0.50 | 0.00 | 6.00 | 0.00 | 5.00 | 0.00 | 0.44 | 8.00 | 8.00 | 0.00 | 9 | 0.0% | 27.7% | 65 |
| 0.00 | 0.20 | 3.00 | 0.50 | 0.00 | 4.00 | 0.00 | 5.00 | 0.00 | 0.44 | 8.00 | 8.00 | 0.00 | 7 | 0.0% | 27.7% | 65 |
| 0.00 | 0.20 | 3.00 | 0.50 | 0.00 | 8.00 | 0.00 | 5.00 | 0.00 | 0.44 | 8.00 | 8.00 | 0.00 | 11 | 0.0% | 27.7% | 65 |
| 0.00 | 0.20 | 3.00 | 0.50 | 0.00 | 2.00 | 0.00 | 5.00 | 0.00 | 0.44 | 8.00 | 8.00 | 0.00 | 5 | 0.0% | 27.7% | 70 |
| 0.00 | 0.20 | 3.00 | 0.50 | 0.00 | 0.00 | 0.00 | 5.00 | 0.00 | 0.44 | 8.00 | 8.00 | 0.00 | 3 | 0.0% | 27.7% | 75 |
| 0.00 | 0.20 | 3.00 | 0.50 | 0.00 | 10.00 | 0.00 | 5.00 | 0.00 | 0.44 | 8.00 | 8.00 | 0.00 | 13 | 0.0% | 27.7% | 60 |
| 0.00 | 0.20 | 3.00 | 0.00 | 0.00 | 0.75 | 0.00 | 5.00 | 0.00 | 0.44 | 8.00 | 8.00 | 0.00 | 3.75 | 0.0% | 27.7% | 70 |
| 0.00 | 0.00 | 3.00 | 0.00 | 0.00 | 1.16 | 0.74 | 10.00 | 0.00 | 0.76 | 10.00 | 6.00 | 0.00 | 4.9 | 1.8% | 27.8% | 50 |
| 0.00 | 0.20 | 3.00 | 0.50 | 0.00 | 10.00 | 2.00 | 5.00 | 0.00 | 0.44 | 8.00 | 6.00 | 0.00 | 15 | 0.0% | 27.8% | 65 |
| 0.00 | 0.20 | 3.00 | 2.00 | 0.00 | 0.75 | 0.00 | 5.00 | 0.00 | 0.44 | 8.00 | 10.00 | 0.00 | 3.75 | 0.0% | 27.8% | 75 |
| 0.00 | 0.20 | 3.00 | 0.50 | 0.00 | 10.00 | 0.00 | 5.00 | 0.00 | 0.44 | 8.00 | 10.00 | 0.00 | 13 | 0.0% | 27.8% | 55 |
| 0.00 | 0.00 | 3.00 | 0.00 | 0.00 | 1.16 | 0.74 | 12.00 | 0.00 | 0.76 | 8.00 | 0.00 | 0.00 | 4.9 | 0.0% | 27.8% | 50 |
| 0.00 | 0.20 | 3.00 | 0.50 | 0.00 | 8.00 | 0.00 | 5.00 | 0.00 | 0.44 | 8.00 | 10.00 | 0.00 | 11 | 0.0% | 27.8% | 55 |
| 0.00 | 0.20 | 3.00 | 0.50 | 0.00 | 6.00 | 0.00 | 5.00 | 0.00 | 0.44 | 8.00 | 10.00 | 0.00 | 9 | 0.0% | 27.8% | 60 |
| 0.00 | 0.20 | 3.00 | 0.50 | 0.00 | 4.00 | 0.00 | 5.00 | 0.00 | 0.44 | 8.00 | 10.00 | 0.00 | 7 | 0.0% | 27.8% | 60 |
| 0.00 | 0.20 | 3.00 | 0.50 | 0.00 | 2.00 | 0.00 | 5.00 | 0.00 | 0.44 | 8.00 | 10.00 | 0.00 | 5 | 0.0% | 27.8% | 65 |
| 0.00 | 0.20 | 3.00 | 0.50 | 0.00 | 0.00 | 0.00 | 5.00 | 0.00 | 0.44 | 8.00 | 10.00 | 0.00 | 3 | 0.0% | 27.8% | 65 |
| 0.00 | 0.20 | 3.00 | 0.00 | 0.00 | 0.75 | 0.00 | 5.00 | 0.00 | 0.44 | 8.00 | 10.00 | 0.00 | 3.75 | 0.0% | 27.9% | 65 |
| 0.00 | 0.20 | 3.00 | 0.50 | 0.00 | 8.00 | 2.00 | 5.00 | 0.00 | 0.44 | 8.00 | 8.00 | 0.00 | 13 | 0.0% | 28.0% | 60 |
| 0.00 | 0.20 | 3.00 | 0.50 | 0.00 | 10.00 | 2.00 | 5.00 | 0.00 | 0.44 | 8.00 | 8.00 | 0.00 | 15 | 0.0% | 28.0% | 60 |
| 0.00 | 0.20 | 3.00 | 0.50 | 0.00 | 6.00 | 2.00 | 5.00 | 0.00 | 0.44 | 8.00 | 8.00 | 0.00 | 11 | 0.0% | 28.0% | 60 |
| 0.00 | 0.20 | 3.00 | 0.50 | 0.00 | 4.00 | 2.00 | 5.00 | 0.00 | 0.44 | 8.00 | 8.00 | 0.00 | 9 | 0.0% | 28.0% | 70 |
| 0.00 | 0.20 | 3.00 | 0.50 | 0.00 | 2.00 | 2.00 | 5.00 | 0.00 | 0.44 | 8.00 | 8.00 | 0.00 | 7 | 0.0% | 28.0% | 70 |
| 0.00 | 0.20 | 3.00 | 0.50 | 0.00 | 0.00 | 2.00 | 5.00 | 0.00 | 0.44 | 8.00 | 8.00 | 0.00 | 5 | 0.0% | 28.0% | 70 |
| 0.00 | 0.20 | 3.00 | 0.00 | 0.00 | 0.75 | 2.00 | 5.00 | 0.00 | 0.44 | 8.00 | 8.00 | 0.00 | 5.75 | 0.0% | 28.0% | 70 |
| 0.00 | 5.00 | 5.00 | 0.50 | 0.00 | 0.75 | 0.50 | 11.00 | 0.00 | 0.50 | 7.00 | 0.50 | 0.00 | 6.25 | 2.2% | 28.0% | 5 |
| 0.00 | 1.00 | 2.50 | 4.00 | 0.00 | 1.16 | 0.74 | 9.00 | 0.00 | 0.76 | 8.00 | 0.00 | 0.00 | 4.4 | 0.0% | 28.0% | 30 |
| 0.00 | 0.00 | 3.00 | 8.74 | 1.46 | 0.36 | 0.36 | 24.21 | 5.82 | 0.36 | 0.00 | 0.00 | 0.00 | 3.728 | 0.0% | 28.0% | 60 |
| 0.00 | 5.00 | 6.00 | 0.50 | 0.00 | 0.75 | 0.50 | 7.00 | 0.00 | 0.50 | 9.00 | 0.50 | 0.00 | 7.25 | 3.5% | 28.0% | 5 |
| 0.00 | 1.00 | 2.50 | 2.00 | 0.00 | 1.16 | 0.74 | 9.00 | 0.00 | 0.76 | 8.00 | 0.00 | 0.00 | 4.4 | 0.0% | 28.1% | 25 |
| 0.00 | 0.20 | 3.00 | 2.00 | 0.00 | 0.75 | 2.00 | 5.00 | 0.00 | 0.44 | 8.00 | 10.00 | 0.00 | 5.75 | 0.0% | 28.1% | 75 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 0.50 | 3.00 | 0.50 | 0.00 | 0.75 | 0.50 | 9.00 | 0.00 | 0.50 | 8.00 | 0.50 | 0.00 | 4.25 | 0.0% | 28.1% | 60 |
| 0.00 | 1.00 | 2.50 | 0.00 | 0.00 | 1.16 | 0.74 | 9.00 | 0.00 | 0.76 | 8.00 | 0.00 | 0.00 | 4.4 | 0.0% | 28.1% | 30 |
| 0.00 | 0.20 | 3.00 | 0.50 | 0.00 | 10.00 | 2.00 | 5.00 | 0.00 | 0.44 | 8.00 | 10.00 | 0.00 | 15 | 0.0% | 28.1% | 50 |
| 0.00 | 0.20 | 3.00 | 0.50 | 0.00 | 8.00 | 2.00 | 5.00 | 0.00 | 0.44 | 8.00 | 10.00 | 0.00 | 13 | 0.0% | 28.1% | 55 |
| 0.00 | 0.20 | 3.00 | 0.50 | 0.00 | 6.00 | 2.00 | 5.00 | 0.00 | 0.44 | 8.00 | 10.00 | 0.00 | 11 | 0.0% | 28.1% | 55 |
| 0.00 | 0.20 | 3.00 | 0.50 | 0.00 | 4.00 | 2.00 | 5.00 | 0.00 | 0.44 | 8.00 | 10.00 | 0.00 | 9 | 0.0% | 28.1% | 60 |
| 0.00 | 0.20 | 3.00 | 0.50 | 0.00 | 2.00 | 2.00 | 5.00 | 0.00 | 0.44 | 8.00 | 10.00 | 0.00 | 7 | 0.0% | 28.1% | 65 |
| 0.00 | 0.20 | 3.00 | 0.50 | 0.00 | 0.00 | 2.00 | 5.00 | 0.00 | 0.44 | 8.00 | 10.00 | 0.00 | 5 | 0.0% | 28.1% | 70 |
| 0.00 | 0.20 | 3.00 | 0.00 | 0.00 | 0.75 | 2.00 | 5.00 | 0.00 | 0.44 | 8.00 | 10.00 | 0.00 | 5.75 | 0.0% | 28.1% | 65 |
| 0.00 | 1.00 | 2.50 | 4.00 | 0.00 | 1.16 | 0.74 | 6.00 | 0.00 | 0.76 | 10.00 | 0.00 | 0.00 | 4.4 | 0.0% | 28.2% | 25 |
| 0.00 | 3.00 | 6.00 | 0.50 | 0.00 | 0.75 | 0.50 | 6.00 | 0.00 | 0.50 | 10.00 | 0.50 | 0.00 | 7.25 | 0.0% | 28.2% | 290 |
| 0.00 | 1.00 | 2.40 | 0.00 | 0.00 | 1.16 | 0.74 | 8.00 | 0.00 | 0.76 | 9.00 | 0.00 | 0.00 | 4.3 | 0.0% | 28.2% | 50 |
| 0.00 | 1.00 | 2.50 | 2.00 | 0.00 | 1.16 | 0.74 | 6.00 | 0.00 | 0.76 | 10.00 | 0.00 | 0.00 | 4.4 | 0.0% | 28.3% | 20 |
| 0.00 | 1.00 | 2.50 | 0.00 | 0.00 | 1.16 | 0.74 | 6.00 | 0.00 | 0.76 | 10.00 | 0.00 | 0.00 | 4.4 | 0.0% | 28.3% | 25 |
| 0.00 | 0.50 | 3.00 | 0.50 | 0.00 | 0.75 | 0.50 | 6.00 | 0.00 | 0.50 | 10.00 | 0.50 | 0.00 | 4.25 | 0.0% | 28.4% | 45 |
| 0.00 | 5.00 | 5.00 | 0.50 | 0.00 | 0.75 | 0.50 | 9.00 | 0.00 | 0.50 | 8.00 | 0.50 | 0.00 | 6.25 | 6.0% | 28.4% | 5 |
| 0.00 | 0.00 | 3.00 | 0.00 | 0.00 | 1.16 | 0.74 | 16.00 | 0.00 | 0.76 | 10.00 | 0.00 | 0.00 | 4.9 | 0.0% | 28.5% | 50 |
| 0.00 | 1.50 | 2.50 | 0.00 | 0.00 | 1.16 | 0.74 | 5.00 | 0.00 | 0.76 | 10.00 | 0.00 | 0.00 | 4.4 | 0.0% | 28.5% | 75 |
| 0.00 | 0.00 | 3.00 | 0.00 | 0.00 | 1.16 | 0.74 | 18.00 | 0.00 | 0.76 | 8.00 | 0.00 | 0.00 | 4.9 | 0.0% | 28.6% | 50 |
| 0.00 | 3.00 | 1.00 | 0.50 | 0.00 | 0.75 | 0.50 | 6.00 | 0.00 | 0.50 | 8.00 | 0.50 | 0.00 | 2.25 | 0.0% | 28.6% | 30 |
| 0.00 | 4.00 | 6.00 | 0.50 | 0.00 | 0.75 | 0.50 | 10.00 | 0.00 | 0.50 | 8.00 | 0.50 | 0.00 | 7.25 | 6.4% | 28.6% | 10 |
| 0.00 | 5.00 | 6.00 | 0.50 | 0.00 | 0.75 | 0.50 | 10.00 | 0.00 | 0.50 | 8.00 | 0.50 | 0.00 | 7.25 | 2.7% | 28.6% | 5 |
| 0.00 | 0.50 | 3.00 | 0.50 | 0.00 | 0.75 | 0.50 | 8.00 | 0.00 | 0.50 | 9.00 | 0.50 | 0.00 | 4.25 | 0.0% | 28.6% | 45 |
| 0.00 | 1.00 | 2.50 | 0.00 | 0.00 | 1.16 | 0.74 | 6.00 | 0.00 | 0.76 | 10.00 | 4.00 | 0.00 | 4.4 | 0.0% | 28.7% | 50 |
| 0.00 | 1.50 | 2.50 | 2.00 | 0.00 | 1.16 | 0.74 | 5.00 | 0.00 | 0.76 | 10.00 | 0.00 | 0.00 | 4.4 | 0.0% | 28.7% | 65 |
| 0.00 | 1.00 | 2.50 | 0.00 | 0.00 | 1.16 | 0.74 | 6.00 | 0.00 | 0.76 | 10.00 | 6.00 | 0.00 | 4.4 | 0.0% | 28.7% | 50 |
| 0.00 | 0.00 | 3.00 | 0.00 | 0.00 | 1.16 | 0.74 | 18.00 | 0.00 | 0.76 | 10.00 | 0.00 | 0.00 | 4.9 | 0.0% | 28.7% | 50 |
| 0.00 | 1.50 | 2.50 | 4.00 | 0.00 | 1.16 | 0.74 | 5.00 | 0.00 | 0.76 | 10.00 | 0.00 | 0.00 | 4.4 | 0.0% | 28.8% | 60 |
| 0.00 | 0.80 | 2.60 | 0.00 | 0.00 | 1.16 | 0.74 | 9.00 | 0.00 | 0.76 | 9.00 | 0.00 | 0.00 | 4.5 | 0.0% | 28.8% | 50 |
| 0.00 | 1.00 | 2.50 | 2.00 | 0.00 | 1.16 | 0.74 | 10.00 | 0.00 | 0.76 | 8.00 | 0.00 | 0.00 | 4.4 | 0.0% | 28.8% | 20 |
| 0.00 | 1.00 | 2.50 | 4.00 | 0.00 | 1.16 | 0.74 | 10.00 | 0.00 | 0.76 | 8.00 | 0.00 | 0.00 | 4.4 | 0.0% | 28.8% | 40 |
| 0.00 | 3.00 | 1.00 | 0.50 | 0.00 | 0.75 | 0.50 | 7.00 | 0.00 | 0.50 | 8.00 | 0.50 | 0.00 | 2.25 | 0.0% | 28.8% | 25 |
| 0.00 | 3.00 | 1.00 | 0.50 | 0.00 | 0.75 | 0.50 | 8.00 | 0.00 | 0.50 | 7.00 | 0.50 | 0.00 | 2.25 | 0.0% | 28.8% | 70 |
| 0.00 | 1.00 | 2.50 | 2.00 | 0.00 | 1.16 | 0.74 | 7.00 | 0.00 | 0.76 | 10.00 | 0.00 | 0.00 | 4.4 | 0.0% | 28.9% | 15 |
| 0.00 | 0.00 | 3.00 | 0.00 | 0.00 | 1.16 | 0.74 | 20.00 | 0.00 | 0.76 | 8.00 | 0.00 | 0.00 | 4.9 | 0.0% | 28.9% | 50 |
| 0.00 | 1.00 | 2.50 | 0.00 | 0.00 | 1.16 | 0.74 | 7.00 | 0.00 | 0.76 | 10.00 | 0.00 | 0.00 | 4.4 | 0.0% | 28.9% | 15 |
| 0.00 | 0.50 | 3.00 | 0.50 | 0.00 | 0.75 | 0.50 | 10.00 | 0.00 | 0.50 | 8.00 | 0.50 | 0.00 | 4.25 | 0.0% | 28.9% | 45 |
| 0.00 | 3.00 | 1.00 | 0.50 | 0.00 | 0.75 | 0.50 | 8.00 | 0.00 | 0.50 | 8.00 | 0.50 | 0.00 | 2.25 | 0.0% | 28.9% | 40 |
| 0.00 | 5.00 | 6.00 | 0.50 | 0.00 | 0.75 | 0.50 | 8.00 | 0.00 | 0.50 | 9.00 | 0.50 | 0.00 | 7.25 | 3.7% | 28.9% | 5 |
| 0.00 | 0.00 | 3.00 | 0.00 | 0.00 | 1.16 | 0.74 | 20.00 | 0.00 | 0.76 | 10.00 | 0.00 | 0.00 | 4.9 | 0.0% | 29.0% | 50 |
| 0.00 | 1.00 | 2.50 | 0.00 | 0.00 | 1.16 | 0.74 | 10.00 | 0.00 | 0.76 | 8.00 | 2.00 | 0.00 | 4.4 | 0.0% | 29.0% | 50 |
| 0.00 | 1.50 | 2.50 | 4.00 | 0.00 | 1.16 | 0.74 | 9.00 | 0.00 | 0.76 | 8.00 | 0.00 | 0.00 | 4.4 | 1.0% | 29.0% | 70 |
| 0.00 | 3.00 | 1.00 | 0.50 | 0.00 | 0.75 | 0.50 | 9.00 | 0.00 | 0.50 | 8.00 | 0.50 | 0.00 | 2.25 | 0.0% | 29.0% | 35 |
| 0.00 | 3.00 | 1.00 | 0.50 | 0.00 | 0.75 | 0.50 | 9.00 | 0.00 | 0.50 | 7.00 | 0.50 | 0.00 | 2.25 | 0.0% | 29.1% | 50 |
| 0.00 | 1.00 | 2.50 | 0.00 | 0.00 | 1.16 | 0.74 | 10.00 | 0.00 | 0.76 | 8.00 | 4.00 | 0.00 | 4.4 | 0.0% | 29.1% | 50 |
| 0.00 | 1.00 | 2.50 | 0.00 | 0.00 | 1.16 | 0.74 | 10.00 | 0.00 | 0.76 | 8.00 | 6.00 | 0.00 | 4.4 | 0.0% | 29.1% | 50 |
| 0.00 | 3.00 | 1.00 | 0.50 | 0.00 | 0.75 | 0.50 | 10.00 | 0.00 | 0.50 | 8.00 | 0.50 | 0.00 | 2.25 | 0.0% | 29.2% | 30 |
| 0.00 | 3.00 | 1.00 | 0.50 | 0.00 | 0.75 | 0.50 | 10.00 | 0.00 | 0.50 | 7.00 | 0.50 | 0.00 | 2.25 | 0.0% | 29.2% | 50 |
| 0.00 | 1.50 | 2.50 | 0.00 | 0.00 | 1.16 | 0.74 | 9.00 | 0.00 | 0.76 | 8.00 | 0.00 | 0.00 | 4.4 | 0.0% | 29.2% | 70 |
| 0.00 | 1.00 | 2.50 | 0.00 | 0.00 | 1.16 | 0.74 | 8.00 | 0.00 | 0.76 | 10.00 | 6.00 | 0.00 | 4.4 | 0.0% | 29.2% | 50 |
| 0.00 | 1.00 | 2.50 | 0.00 | 0.00 | 1.16 | 0.74 | 8.00 | 0.00 | 0.76 | 10.00 | 4.00 | 0.00 | 4.4 | 0.0% | 29.2% | 50 |
| 0.00 | 1.50 | 2.50 | 2.00 | 0.00 | 1.16 | 0.74 | 9.00 | 0.00 | 0.76 | 8.00 | 0.00 | 0.00 | 4.4 | 0.0% | 29.2% | 70 |
| 0.00 | 3.00 | 1.00 | 0.50 | 0.00 | 0.75 | 0.50 | 11.00 | 0.00 | 0.50 | 8.00 | 0.50 | 0.00 | 2.25 | 0.0% | 29.3% | 25 |
| 0.00 | 3.00 | 1.00 | 0.50 | 0.00 | 0.75 | 0.50 | 11.00 | 0.00 | 0.50 | 7.00 | 0.50 | 0.00 | 2.25 | 0.0% | 29.3% | 45 |
| 0.00 | 1.00 | 2.50 | 0.00 | 0.00 | 1.16 | 0.74 | 8.00 | 0.00 | 0.76 | 10.00 | 0.00 | 0.00 | 4.4 | 0.0% | 29.3% | 20 |
| 0.00 | 1.00 | 2.50 | 2.00 | 0.00 | 1.16 | 0.74 | 8.00 | 0.00 | 0.76 | 10.00 | 0.00 | 0.00 | 4.4 | 0.0% | 29.3% | 15 |
| 0.00 | 5.00 | 5.00 | 0.50 | 0.00 | 0.75 | 0.50 | 10.00 | 0.00 | 0.50 | 8.00 | 0.50 | 0.00 | 6.25 | 6.3% | 29.4% | 5 |
| 0.00 | 1.00 | 2.50 | 4.00 | 0.00 | 1.16 | 0.74 | 9.00 | 0.00 | 0.76 | 10.00 | 0.00 | 0.00 | 4.4 | 0.0% | 29.4% | 40 |
| 0.00 | 1.00 | 2.50 | 0.00 | 0.00 | 1.16 | 0.74 | 9.00 | 0.00 | 0.76 | 10.00 | 0.00 | 0.00 | 4.4 | 0.0% | 29.5% | 30 |
| 0.00 | 1.00 | 2.50 | 0.00 | 0.00 | 1.16 | 0.74 | 10.00 | 0.00 | 0.76 | 10.00 | 2.00 | 0.00 | 4.4 | 0.0% | 29.5% | 50 |
| 0.00 | 1.00 | 2.50 | 4.00 | 0.00 | 1.16 | 0.74 | 10.00 | 0.00 | 0.76 | 10.00 | 0.00 | 0.00 | 4.4 | 0.0% | 29.6% | 40 |
| 0.00 | 4.00 | 6.00 | 0.50 | 0.00 | 0.75 | 0.50 | 11.00 | 0.00 | 0.50 | 8.00 | 0.50 | 0.00 | 7.25 | 6.7% | 29.6% | 10 |
| 0.00 | 5.00 | 6.00 | 0.50 | 0.00 | 0.75 | 0.50 | 11.00 | 0.00 | 0.50 | 8.00 | 0.50 | 0.00 | 7.25 | 2.9% | 29.6% | 5 |
| 0.00 | 1.50 | 2.50 | 4.00 | 0.00 | 1.16 | 0.74 | 6.00 | 0.00 | 0.76 | 10.00 | 0.00 | 0.00 | 4.4 | 0.0% | 29.6% | 45 |
| 0.00 | 1.00 | 2.50 | 0.00 | 0.00 | 1.16 | 0.74 | 10.00 | 0.00 | 0.76 | 10.00 | 0.00 | 0.00 | 4.4 | 0.0% | 29.6% | 45 |
| 0.00 | 5.00 | 5.00 | 0.50 | 0.00 | 0.75 | 0.50 | 8.00 | 0.00 | 0.50 | 9.00 | 0.50 | 0.00 | 6.25 | 7.3% | 29.7% | 5 |
| 0.00 | 5.00 | 6.00 | 0.50 | 0.00 | 0.75 | 0.50 | 9.00 | 0.00 | 0.50 | 9.00 | 0.50 | 0.00 | 7.25 | 3.9% | 29.8% | 5 |
| 0.00 | 0.50 | 3.00 | 0.00 | 0.00 | 1.16 | 0.74 | 8.00 | 0.00 | 0.76 | 10.00 | 4.00 | 0.00 | 4.9 | 0.0% | 29.8% | 50 |
| 0.00 | 1.00 | 2.60 | 0.00 | 0.00 | 1.16 | 0.74 | 8.00 | 0.00 | 0.76 | 10.00 | 0.00 | 0.00 | 4.5 | 0.0% | 29.9% | 50 |
| 0.00 | 0.50 | 3.00 | 0.00 | 0.00 | 1.16 | 0.74 | 8.00 | 0.00 | 0.76 | 10.00 | 6.00 | 0.00 | 4.9 | 0.0% | 29.9% | 50 |
| 0.00 | 5.00 | 6.00 | 0.50 | 0.00 | 0.75 | 0.50 | 7.00 | 0.00 | 0.50 | 10.00 | 0.50 | 0.00 | 7.25 | 5.0% | 30.2% | 10 |
| 0.00 | 1.50 | 2.50 | 0.00 | 0.00 | 1.16 | 0.74 | 10.00 | 0.00 | 0.76 | 8.00 | 0.00 | 0.00 | 4.4 | 0.0% | 30.2% | 50 |
| 0.00 | 1.50 | 2.50 | 4.00 | 0.00 | 1.16 | 0.74 | 10.00 | 0.00 | 0.76 | 8.00 | 0.00 | 0.00 | 4.4 | 0.0% | 30.2% | 45 |
| 0.00 | 1.50 | 2.50 | 2.00 | 0.00 | 1.16 | 0.74 | 10.00 | 0.00 | 0.76 | 8.00 | 0.00 | 0.00 | 4.4 | 0.0% | 30.2% | 50 |
| 0.00 | 5.00 | 5.00 | 0.50 | 0.00 | 0.75 | 0.50 | 11.00 | 0.00 | 0.50 | 8.00 | 0.50 | 0.00 | 6.25 | 6.6% | 30.3% | 5 |
| 0.00 | 0.00 | 3.50 | 0.00 | 0.00 | 1.16 | 0.74 | 6.00 | 0.00 | 0.76 | 10.00 | 6.00 | 0.00 | 5.4 | 0.0% | 30.5% | 50 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 1.50 | 2.50 | 2.00 | 0.00 | 1.16 | 0.74 | 7.00 | 0.00 | 0.76 | 10.00 | 0.00 | 0.00 | 4.4 | 0.0% | 30.5% | 30 |
| 0.00 | 0.50 | 3.00 | 0.00 | 0.00 | 1.16 | 0.74 | 10.00 | 0.00 | 0.76 | 10.00 | 4.00 | 0.00 | 4.9 | 0.0% | 30.5% | 50 |
| 0.00 | 0.50 | 3.00 | 0.00 | 0.00 | 1.16 | 0.74 | 10.00 | 0.00 | 0.76 | 10.00 | 6.00 | 0.00 | 4.9 | 0.0% | 30.5% | 50 |
| 0.00 | 4.00 | 5.00 | 0.50 | 0.00 | 0.75 | 0.50 | 9.00 | 0.00 | 0.50 | 9.00 | 0.50 | 0.00 | 6.25 | 8.9% | 30.6% | 15 |
| 0.00 | 0.00 | 3.50 | 0.00 | 0.00 | 1.16 | 0.74 | 10.00 | 0.00 | 0.76 | 10.00 | 0.00 | 0.00 | 5.4 | 0.0% | 30.6% | 50 |
| 0.00 | 5.00 | 5.00 | 0.50 | 0.00 | 0.75 | 0.50 | 9.00 | 0.00 | 0.50 | 9.00 | 0.50 | 0.00 | 6.25 | 7.5% | 30.6% | 5 |
| 0.00 | 1.00 | 3.00 | 0.50 | 0.00 | 0.75 | 0.70 | 9.00 | 0.00 | 0.44 | 9.00 | 0.36 | 0.00 | 4.45 | 0.1% | 30.6% | 65 |
| 0.00 | 0.00 | 3.50 | 0.00 | 0.00 | 1.16 | 0.74 | 8.00 | 0.00 | 0.76 | 9.00 | 6.00 | 0.00 | 5.4 | 0.0% | 30.6% | 50 |
| 0.00 | 0.00 | 3.50 | 0.00 | 0.00 | 1.16 | 0.74 | 8.00 | 0.00 | 0.76 | 10.00 | 6.00 | 0.00 | 5.4 | 0.0% | 30.7% | 50 |
| 0.00 | 5.00 | 6.00 | 0.50 | 0.00 | 0.75 | 0.50 | 10.00 | 0.00 | 0.50 | 9.00 | 0.50 | 0.00 | 7.25 | 4.1% | 30.8% | 10 |
| 0.00 | 0.00 | 3.50 | 0.00 | 0.00 | 1.16 | 0.74 | 10.00 | 0.00 | 0.76 | 8.00 | 6.00 | 0.00 | 5.4 | 0.0% | 30.8% | 50 |
| 0.00 | 1.00 | 3.00 | 0.50 | 0.00 | 0.75 | 0.70 | 11.00 | 0.00 | 0.44 | 8.00 | 0.36 | 0.00 | 4.45 | 0.3% | 30.9% | 70 |
| 0.00 | 0.00 | 3.50 | 0.00 | 0.00 | 1.16 | 0.74 | 10.00 | 0.00 | 0.76 | 9.00 | 6.00 | 0.00 | 5.4 | 0.0% | 30.9% | 50 |
| 0.00 | 5.00 | 6.00 | 0.50 | 0.00 | 0.75 | 0.50 | 8.00 | 0.00 | 0.50 | 10.00 | 0.50 | 0.00 | 7.25 | 5.3% | 31.0% | 10 |
| 0.00 | 1.50 | 2.50 | 4.00 | 0.00 | 1.16 | 0.74 | 8.00 | 0.00 | 0.76 | 10.00 | 0.00 | 0.00 | 4.4 | 0.0% | 31.2% | 20 |
| 0.00 | 1.50 | 2.50 | 2.00 | 0.00 | 1.16 | 0.74 | 8.00 | 0.00 | 0.76 | 10.00 | 0.00 | 0.00 | 4.4 | 0.0% | 31.2% | 25 |
| 0.00 | 1.00 | 3.00 | 0.50 | 0.00 | 0.75 | 0.70 | 8.00 | 0.00 | 0.44 | 10.00 | 0.36 | 0.00 | 4.45 | 0.0% | 31.3% | 50 |
| 0.00 | 2.00 | 2.50 | 0.00 | 0.00 | 1.16 | 0.74 | 7.00 | 0.00 | 0.76 | 10.00 | 0.00 | 0.00 | 4.4 | 0.0% | 31.4% | 75 |
| 0.00 | 1.00 | 3.00 | 0.50 | 0.00 | 0.75 | 0.70 | 10.00 | 0.00 | 0.44 | 9.00 | 0.36 | 0.00 | 4.45 | 0.1% | 31.5% | 50 |
| 0.00 | 2.00 | 2.50 | 2.00 | 0.00 | 1.16 | 0.74 | 7.00 | 0.00 | 0.76 | 10.00 | 0.00 | 0.00 | 4.4 | 0.0% | 31.5% | 70 |
| 0.00 | 5.00 | 5.00 | 0.50 | 0.00 | 0.75 | 0.50 | 10.00 | 0.00 | 0.50 | 9.00 | 0.50 | 0.00 | 6.25 | 7.7% | 31.6% | 5 |
| 0.00 | 2.00 | 2.50 | 4.00 | 0.00 | 1.16 | 0.74 | 7.00 | 0.00 | 0.76 | 10.00 | 0.00 | 0.00 | 4.4 | 0.0% | 31.6% | 70 |
| 0.00 | 1.50 | 2.50 | 0.00 | 0.00 | 1.16 | 0.74 | 8.00 | 0.00 | 0.76 | 10.00 | 4.00 | 0.00 | 4.4 | 0.0% | 31.6% | 50 |
| 0.00 | 4.00 | 6.00 | 0.50 | 0.00 | 0.75 | 0.50 | 11.00 | 0.00 | 0.50 | 9.00 | 0.50 | 0.00 | 7.25 | 8.3% | 31.7% | 10 |
| 0.00 | 1.50 | 2.50 | 0.00 | 0.00 | 1.16 | 0.74 | 8.00 | 0.00 | 0.76 | 10.00 | 6.00 | 0.00 | 4.4 | 0.0% | 31.7% | 50 |
| 0.00 | 0.50 | 3.50 | 0.50 | 0.00 | 0.75 | 0.50 | 9.00 | 0.00 | 0.50 | 10.00 | 0.50 | 0.00 | 4.75 | 0.0% | 31.7% | 65 |
| 0.00 | 5.00 | 6.00 | 0.50 | 0.00 | 0.75 | 0.50 | 11.00 | 0.00 | 0.50 | 9.00 | 0.50 | 0.00 | 7.25 | 4.3% | 31.7% | 10 |
| 0.00 | 1.00 | 3.00 | 0.50 | 0.00 | 0.75 | 0.70 | 12.00 | 0.00 | 0.44 | 8.00 | 0.36 | 0.00 | 4.45 | 0.2% | 31.8% | 45 |
| 0.00 | 0.00 | 3.50 | 0.00 | 0.00 | 1.16 | 0.74 | 12.00 | 0.00 | 0.76 | 10.00 | 0.00 | 0.00 | 5.4 | 0.0% | 31.8% | 50 |
| 0.00 | 0.00 | 3.50 | 0.00 | 0.00 | 1.16 | 0.74 | 18.00 | 0.00 | 0.76 | 6.00 | 0.00 | 0.00 | 5.4 | 0.0% | 31.8% | 50 |
| 0.00 | 1.50 | 2.50 | 2.00 | 0.00 | 1.16 | 0.74 | 9.00 | 0.00 | 0.76 | 10.00 | 0.00 | 0.00 | 4.4 | 0.0% | 31.9% | 20 |
| 0.00 | 1.50 | 2.50 | 0.00 | 0.00 | 1.16 | 0.74 | 9.00 | 0.00 | 0.76 | 10.00 | 0.00 | 0.00 | 4.4 | 0.0% | 31.9% | 20 |
| 0.00 | 5.00 | 6.00 | 0.50 | 0.00 | 0.75 | 0.50 | 9.00 | 0.00 | 0.50 | 10.00 | 0.50 | 0.00 | 7.25 | 5.5% | 31.9% | 10 |
| 0.00 | 1.00 | 3.00 | 0.50 | 0.00 | 0.75 | 0.70 | 9.00 | 0.00 | 0.44 | 10.00 | 0.36 | 0.00 | 4.45 | 0.0% | 32.0% | 35 |
| 0.00 | 1.50 | 2.50 | 0.00 | 0.00 | 1.16 | 0.74 | 10.00 | 0.00 | 0.76 | 10.00 | 6.00 | 0.00 | 4.4 | 0.0% | 32.2% | 50 |
| 0.00 | 1.50 | 2.50 | 0.00 | 0.00 | 1.16 | 0.74 | 10.00 | 0.00 | 0.76 | 10.00 | 4.00 | 0.00 | 4.4 | 0.0% | 32.3% | 50 |
| 0.00 | 1.50 | 2.50 | 0.00 | 0.00 | 1.16 | 0.74 | 10.00 | 0.00 | 0.76 | 10.00 | 2.00 | 0.00 | 4.4 | 0.0% | 32.3% | 50 |
| 0.00 | 1.50 | 2.50 | 4.00 | 0.00 | 1.16 | 0.74 | 10.00 | 0.00 | 0.76 | 10.00 | 0.00 | 0.00 | 4.4 | 0.5% | 32.3% | 40 |
| 0.00 | 1.00 | 3.00 | 0.50 | 0.00 | 0.75 | 0.70 | 11.00 | 0.00 | 0.44 | 9.00 | 0.36 | 0.00 | 4.45 | 0.0% | 32.3% | 35 |
| 0.00 | 1.50 | 2.50 | 0.00 | 0.00 | 1.16 | 0.74 | 10.00 | 0.00 | 0.76 | 10.00 | 0.00 | 0.00 | 4.4 | 0.0% | 32.3% | 20 |
| 0.00 | 1.50 | 2.50 | 2.00 | 0.00 | 1.16 | 0.74 | 10.00 | 0.00 | 0.76 | 10.00 | 0.00 | 0.00 | 4.4 | 0.0% | 32.3% | 20 |
| 0.00 | 1.00 | 3.00 | 0.50 | 0.00 | 0.75 | 0.70 | 8.00 | 0.00 | 0.44 | 11.00 | 0.36 | 0.00 | 4.45 | 0.0% | 32.4% | 25 |
| 0.00 | 2.00 | 2.50 | 0.00 | 0.00 | 1.16 | 0.74 | 8.00 | 0.00 | 0.76 | 10.00 | 0.00 | 0.00 | 4.4 | 0.0% | 32.4% | 55 |
| 0.00 | 2.00 | 2.50 | 2.00 | 0.00 | 1.16 | 0.74 | 8.00 | 0.00 | 0.76 | 10.00 | 0.00 | 0.00 | 4.4 | 0.0% | 32.5% | 50 |
| 0.00 | 2.00 | 2.50 | 4.00 | 0.00 | 1.16 | 0.74 | 8.00 | 0.00 | 0.76 | 10.00 | 0.00 | 0.00 | 4.4 | 0.0% | 32.5% | 50 |
| 0.00 | 5.00 | 5.00 | 0.50 | 0.00 | 0.75 | 0.50 | 11.00 | 0.00 | 0.50 | 9.00 | 0.50 | 0.00 | 6.25 | 8.0% | 32.5% | 10 |
| 0.00 | 0.50 | 3.50 | 0.50 | 0.00 | 0.75 | 0.50 | 10.00 | 0.00 | 0.50 | 10.00 | 0.50 | 0.00 | 4.75 | 0.0% | 32.5% | 45 |
| 0.00 | 0.00 | 3.50 | 8.21 | 1.37 | 0.34 | 0.34 | 28.07 | 5.47 | 0.34 | 0.00 | 0.00 | 0.00 | 4.1842 | 0.0% | 32.6% | 60 |
| 0.00 | 1.00 | 3.00 | 0.50 | 0.00 | 0.75 | 0.70 | 10.00 | 0.00 | 0.44 | 10.00 | 0.36 | 0.00 | 4.45 | 0.0% | 32.6% | 25 |
| 0.00 | 0.00 | 4.00 | 0.00 | 0.00 | 1.16 | 0.74 | 6.00 | 0.00 | 0.76 | 8.00 | 6.00 | 0.00 | 5.9 | 0.0% | 32.7% | 50 |
| 0.00 | 1.00 | 3.00 | 0.00 | 0.00 | 1.16 | 0.74 | 10.00 | 0.00 | 0.76 | 10.00 | 2.00 | 0.00 | 4.9 | 0.0% | 32.7% | 50 |
| 0.00 | 5.00 | 6.00 | 0.50 | 0.00 | 0.75 | 0.50 | 10.00 | 0.00 | 0.50 | 10.00 | 0.50 | 0.00 | 7.25 | 5.7% | 32.8% | 10 |
| 0.00 | 1.00 | 3.00 | 0.00 | 0.00 | 1.16 | 0.74 | 10.00 | 0.00 | 0.76 | 10.00 | 4.00 | 0.00 | 4.9 | 0.0% | 32.8% | 50 |
| 0.00 | 1.00 | 3.00 | 0.50 | 0.00 | 0.75 | 0.70 | 9.00 | 0.00 | 0.44 | 11.00 | 0.36 | 0.00 | 4.45 | 0.0% | 32.9% | 20 |
| 0.00 | 1.00 | 3.00 | 0.00 | 0.00 | 1.16 | 0.74 | 10.00 | 0.00 | 0.76 | 10.00 | 6.00 | 0.00 | 4.9 | 0.0% | 32.9% | 50 |
| 0.00 | 1.00 | 3.00 | 0.50 | 0.00 | 0.75 | 0.70 | 12.00 | 0.00 | 0.44 | 9.00 | 0.36 | 0.00 | 4.45 | 0.0% | 32.9% | 25 |
| 0.00 | 5.00 | 5.00 | 0.50 | 0.00 | 0.75 | 0.50 | 7.00 | 0.00 | 0.50 | 11.00 | 0.50 | 0.00 | 6.25 | 6.3% | 33.0% | 5 |
| 0.00 | 0.00 | 3.50 | 0.00 | 0.00 | 1.16 | 0.74 | 20.00 | 0.00 | 0.76 | 10.00 | 0.00 | 0.00 | 5.4 | 0.0% | 33.0% | 50 |
| 0.00 | 1.00 | 3.00 | 0.50 | 0.00 | 0.75 | 0.70 | 8.00 | 0.00 | 0.44 | 12.00 | 0.36 | 0.00 | 4.45 | 0.0% | 33.1% | 15 |
| 0.00 | 5.00 | 6.00 | 0.50 | 0.00 | 0.75 | 0.50 | 8.00 | 0.00 | 0.50 | 11.00 | 0.50 | 0.00 | 7.25 | 6.5% | 33.1% | 10 |
| 0.00 | 1.00 | 3.00 | 0.50 | 0.00 | 0.75 | 0.70 | 11.00 | 0.00 | 0.44 | 10.00 | 0.36 | 0.00 | 4.45 | 0.0% | 33.2% | 20 |
| 0.00 | 1.50 | 3.00 | 0.50 | 0.00 | 0.75 | 0.70 | 9.00 | 0.00 | 0.44 | 10.00 | 0.36 | 0.00 | 4.45 | 0.2% | 33.2% | 70 |
| 0.00 | 2.00 | 2.50 | 4.00 | 0.00 | 1.16 | 0.74 | 9.00 | 0.00 | 0.76 | 10.00 | 0.00 | 0.00 | 4.4 | 0.0% | 33.3% | 35 |
| 0.00 | 1.00 | 3.00 | 0.50 | 0.00 | 0.75 | 0.70 | 10.00 | 0.00 | 0.44 | 11.00 | 0.36 | 0.00 | 4.45 | 0.0% | 33.3% | 15 |
| 0.00 | 2.00 | 2.50 | 2.00 | 0.00 | 1.16 | 0.74 | 9.00 | 0.00 | 0.76 | 10.00 | 0.00 | 0.00 | 4.4 | 0.0% | 33.4% | 30 |
| 0.00 | 2.00 | 2.50 | 0.00 | 0.00 | 1.16 | 0.74 | 9.00 | 0.00 | 0.76 | 10.00 | 0.00 | 0.00 | 4.4 | 0.0% | 33.4% | 40 |
| 0.00 | 1.00 | 3.00 | 0.50 | 0.00 | 0.75 | 0.70 | 9.00 | 0.00 | 0.44 | 12.00 | 0.36 | 0.00 | 4.45 | 0.0% | 33.4% | 20 |
| 0.00 | 1.50 | 3.00 | 0.50 | 0.00 | 0.75 | 0.70 | 11.00 | 0.00 | 0.44 | 9.00 | 0.36 | 0.00 | 4.45 | 0.3% | 33.5% | 70 |
| 0.00 | 1.00 | 3.00 | 0.50 | 0.00 | 0.75 | 0.70 | 12.00 | 0.00 | 0.44 | 10.00 | 0.36 | 0.00 | 4.45 | 0.0% | 33.6% | 15 |
| 0.00 | 1.00 | 3.00 | 0.50 | 0.00 | 0.75 | 0.70 | 10.00 | 0.00 | 0.44 | 12.00 | 0.36 | 0.00 | 4.45 | 0.0% | 33.6% | 30 |
| 0.00 | 1.00 | 3.00 | 0.50 | 0.00 | 0.75 | 0.70 | 11.00 | 0.00 | 0.44 | 11.00 | 0.36 | 0.00 | 4.45 | 0.0% | 33.7% | 20 |
| 0.00 | 5.00 | 6.00 | 0.50 | 0.00 | 0.75 | 0.50 | 11.00 | 0.00 | 0.50 | 10.00 | 0.50 | 0.00 | 7.25 | 5.9% | 33.8% | 10 |
| 0.00 | 1.00 | 3.00 | 0.50 | 0.00 | 0.75 | 0.70 | 11.00 | 0.00 | 0.44 | 12.00 | 0.36 | 0.00 | 4.45 | 0.0% | 33.8% | 40 |
| 0.00 | 4.00 | 1.00 | 0.50 | 0.00 | 0.75 | 0.50 | 6.00 | 0.00 | 0.50 | 10.00 | 0.50 | 0.00 | 2.25 | 0.0% | 33.8% | 45 |
| 0.00 | 1.00 | 3.00 | 0.50 | 0.00 | 0.75 | 0.70 | 12.00 | 0.00 | 0.44 | 11.00 | 0.36 | 0.00 | 4.45 | 0.0% | 33.8% | 35 |
| 0.00 | 1.50 | 3.00 | 0.50 | 0.00 | 0.75 | 0.70 | 8.00 | 0.00 | 0.44 | 11.00 | 0.36 | 0.00 | 4.45 | 0.0% | 33.9% | 55 |

TABLE 3-continued

List of alloy compositions that meet the disclosed thermodynamic criteria

| Al | B | C | Cr | Cu | Mn | Mo | Nb | Ni | Si | Ti | V | W | 1 | 2 | 3 | 4 |
|---|---|---|---|---|---|---|---|---|---|---|---|---|---|---|---|---|
| 0.00 | 1.00 | 3.00 | 0.50 | 0.00 | 0.75 | 0.70 | 12.00 | 0.00 | 0.44 | 12.00 | 0.36 | 0.00 | 4.45 | 0.0% | 33.9% | 55 |
| 0.00 | 5.00 | 6.00 | 0.50 | 0.00 | 0.75 | 0.50 | 9.00 | 0.00 | 0.50 | 11.00 | 0.50 | 0.00 | 7.25 | 6.9% | 34.0% | 10 |
| 0.00 | 1.50 | 3.00 | 0.50 | 0.00 | 0.75 | 0.70 | 10.00 | 0.00 | 0.44 | 10.00 | 0.36 | 0.00 | 4.45 | 0.1% | 34.1% | 50 |
| 0.00 | 2.00 | 2.50 | 2.00 | 0.00 | 1.16 | 0.74 | 10.00 | 0.00 | 0.76 | 10.00 | 0.00 | 0.00 | 4.4 | 0.0% | 34.2% | 20 |
| 0.00 | 2.00 | 2.50 | 4.00 | 0.00 | 1.16 | 0.74 | 10.00 | 0.00 | 0.76 | 10.00 | 0.00 | 0.00 | 4.4 | 0.0% | 34.2% | 40 |
| 0.00 | 4.00 | 1.00 | 0.50 | 0.00 | 0.75 | 0.50 | 7.00 | 0.00 | 0.50 | 10.00 | 0.50 | 0.00 | 2.25 | 0.0% | 34.2% | 25 |
| 0.00 | 4.00 | 1.00 | 0.50 | 0.00 | 0.75 | 0.50 | 8.00 | 0.00 | 0.50 | 10.00 | 0.50 | 0.00 | 2.25 | 0.0% | 34.3% | 35 |
| 0.00 | 1.50 | 3.00 | 0.50 | 0.00 | 0.75 | 0.70 | 12.00 | 0.00 | 0.44 | 9.00 | 0.36 | 0.00 | 4.45 | 0.3% | 34.4% | 50 |
| 0.00 | 4.00 | 1.00 | 0.50 | 0.00 | 0.75 | 0.50 | 9.00 | 0.00 | 0.50 | 10.00 | 0.50 | 0.00 | 2.25 | 0.0% | 34.5% | 35 |
| 0.00 | 4.00 | 1.00 | 0.50 | 0.00 | 0.75 | 0.50 | 10.00 | 0.00 | 0.50 | 9.00 | 0.50 | 0.00 | 2.25 | 0.1% | 34.5% | 75 |
| 0.00 | 4.00 | 1.00 | 0.50 | 0.00 | 0.75 | 0.50 | 10.00 | 0.00 | 0.50 | 10.00 | 0.50 | 0.00 | 2.25 | 0.0% | 34.6% | 30 |
| 0.00 | 0.00 | 4.00 | 0.00 | 0.00 | 1.16 | 0.74 | 10.00 | 0.00 | 0.76 | 10.00 | 6.00 | 0.00 | 5.9 | 0.0% | 34.6% | 50 |
| 0.00 | 1.50 | 3.00 | 0.50 | 0.00 | 0.75 | 0.70 | 9.00 | 0.00 | 0.44 | 11.00 | 0.36 | 0.00 | 4.45 | 0.0% | 34.6% | 35 |
| 0.00 | 4.00 | 1.00 | 0.50 | 0.00 | 0.75 | 0.50 | 11.00 | 0.00 | 0.50 | 9.00 | 0.50 | 0.00 | 2.25 | 0.1% | 34.7% | 70 |
| 0.00 | 4.00 | 1.00 | 0.50 | 0.00 | 0.75 | 0.50 | 11.00 | 0.00 | 0.50 | 10.00 | 0.50 | 0.00 | 2.25 | 0.0% | 34.7% | 25 |
| 0.00 | 5.00 | 6.00 | 0.50 | 0.00 | 0.75 | 0.50 | 10.00 | 0.00 | 0.50 | 11.00 | 0.50 | 0.00 | 7.25 | 7.4% | 34.9% | 10 |
| 0.00 | 1.50 | 3.00 | 0.50 | 0.00 | 0.75 | 0.70 | 11.00 | 0.00 | 0.44 | 10.00 | 0.36 | 0.00 | 4.45 | 0.0% | 34.9% | 35 |
| 0.00 | 1.50 | 3.00 | 0.50 | 0.00 | 0.75 | 0.70 | 8.00 | 0.00 | 0.44 | 12.00 | 0.36 | 0.00 | 4.45 | 0.0% | 35.0% | 25 |
| 0.00 | 1.50 | 3.00 | 0.50 | 0.00 | 0.75 | 0.70 | 10.00 | 0.00 | 0.44 | 11.00 | 0.36 | 0.00 | 4.45 | 0.0% | 35.3% | 25 |
| 0.00 | 0.00 | 4.00 | 0.00 | 0.00 | 1.16 | 0.74 | 18.00 | 0.00 | 0.76 | 8.00 | 0.00 | 0.00 | 5.9 | 0.0% | 35.4% | 50 |
| 0.00 | 1.50 | 3.00 | 0.50 | 0.00 | 0.75 | 0.70 | 9.00 | 0.00 | 0.44 | 12.00 | 0.36 | 0.00 | 4.45 | 0.0% | 35.5% | 20 |
| 0.00 | 1.50 | 3.00 | 0.50 | 0.00 | 0.75 | 0.70 | 12.00 | 0.00 | 0.44 | 10.00 | 0.36 | 0.00 | 4.45 | 0.0% | 35.6% | 30 |
| 0.00 | 2.00 | 3.00 | 0.50 | 0.00 | 0.75 | 0.70 | 9.00 | 0.00 | 0.44 | 11.00 | 0.36 | 0.00 | 4.45 | 0.2% | 35.7% | 75 |
| 0.00 | 1.50 | 3.00 | 0.50 | 0.00 | 0.75 | 0.70 | 11.00 | 0.00 | 0.44 | 11.00 | 0.36 | 0.00 | 4.45 | 0.0% | 35.8% | 15 |
| 0.00 | 1.50 | 3.00 | 0.50 | 0.00 | 0.75 | 0.70 | 10.00 | 0.00 | 0.44 | 12.00 | 0.36 | 0.00 | 4.45 | 0.0% | 36.0% | 15 |
| 0.00 | 0.00 | 4.50 | 0.00 | 0.00 | 1.16 | 0.74 | 6.00 | 0.00 | 0.76 | 10.00 | 6.00 | 0.00 | 6.4 | 0.0% | 36.1% | 50 |
| 0.00 | 1.50 | 3.00 | 0.50 | 0.00 | 0.75 | 0.70 | 12.00 | 0.00 | 0.44 | 11.00 | 0.36 | 0.00 | 4.45 | 0.0% | 36.3% | 10 |
| 0.00 | 1.50 | 3.00 | 0.50 | 0.00 | 0.75 | 0.70 | 11.00 | 0.00 | 0.44 | 12.00 | 0.36 | 0.00 | 4.45 | 0.0% | 36.3% | 15 |
| 0.00 | 2.00 | 3.00 | 0.50 | 0.00 | 0.75 | 0.70 | 8.00 | 0.00 | 0.44 | 12.00 | 0.36 | 0.00 | 4.45 | 0.0% | 36.4% | 55 |
| 0.00 | 0.00 | 4.50 | 0.00 | 0.00 | 1.16 | 0.74 | 8.00 | 0.00 | 0.76 | 9.00 | 6.00 | 0.00 | 6.4 | 0.0% | 36.4% | 50 |
| 0.00 | 1.50 | 3.00 | 0.50 | 0.00 | 0.75 | 0.70 | 12.00 | 0.00 | 0.44 | 12.00 | 0.36 | 0.00 | 4.45 | 0.0% | 36.5% | 30 |
| 0.00 | 2.00 | 3.00 | 0.50 | 0.00 | 0.75 | 0.70 | 10.00 | 0.00 | 0.44 | 11.00 | 0.36 | 0.00 | 4.45 | 0.2% | 36.6% | 55 |
| 0.00 | 0.00 | 4.00 | 0.00 | 0.00 | 1.16 | 0.74 | 20.00 | 0.00 | 0.76 | 8.00 | 0.00 | 0.00 | 5.9 | 0.0% | 36.7% | 50 |
| 0.00 | 2.00 | 3.00 | 0.50 | 0.00 | 0.75 | 0.70 | 12.00 | 0.00 | 0.44 | 10.00 | 0.36 | 0.00 | 4.45 | 0.3% | 36.9% | 60 |
| 0.00 | 2.00 | 3.00 | 0.50 | 0.00 | 0.75 | 0.70 | 9.00 | 0.00 | 0.44 | 12.00 | 0.36 | 0.00 | 4.45 | 0.0% | 37.1% | 40 |
| 0.00 | 2.00 | 3.00 | 0.50 | 0.00 | 0.75 | 0.70 | 11.00 | 0.00 | 0.44 | 11.00 | 0.36 | 0.00 | 4.45 | 0.0% | 37.5% | 40 |
| 0.00 | 2.00 | 3.00 | 0.50 | 0.00 | 0.75 | 0.70 | 10.00 | 0.00 | 0.44 | 12.00 | 0.36 | 0.00 | 4.45 | 0.0% | 37.8% | 30 |
| 0.00 | 1.00 | 4.00 | 0.50 | 0.00 | 0.75 | 0.70 | 11.00 | 0.00 | 0.44 | 12.00 | 0.36 | 0.00 | 5.45 | 0.0% | 37.9% | 70 |
| 0.00 | 2.00 | 3.00 | 0.50 | 0.00 | 0.75 | 0.70 | 12.00 | 0.00 | 0.44 | 11.00 | 0.36 | 0.00 | 4.45 | 0.0% | 38.1% | 30 |
| 0.00 | 2.00 | 3.00 | 0.50 | 0.00 | 0.75 | 0.70 | 11.00 | 0.00 | 0.44 | 12.00 | 0.36 | 0.00 | 4.45 | 0.0% | 38.4% | 20 |
| 0.00 | 1.00 | 4.00 | 0.50 | 0.00 | 0.75 | 0.70 | 12.00 | 0.00 | 0.44 | 12.00 | 0.36 | 0.00 | 5.45 | 0.0% | 38.7% | 55 |
| 0.00 | 2.00 | 3.00 | 0.50 | 0.00 | 0.75 | 0.70 | 12.00 | 0.00 | 0.44 | 12.00 | 0.36 | 0.00 | 4.45 | 0.0% | 38.9% | 10 |
| 0.00 | 2.50 | 3.00 | 0.50 | 0.00 | 0.75 | 0.70 | 10.00 | 0.00 | 0.44 | 12.00 | 0.36 | 0.00 | 4.45 | 0.2% | 39.0% | 60 |
| 0.00 | 2.50 | 3.00 | 0.50 | 0.00 | 0.75 | 0.70 | 12.00 | 0.00 | 0.44 | 11.00 | 0.36 | 0.00 | 4.45 | 0.3% | 39.3% | 60 |
| 0.00 | 2.50 | 3.00 | 0.50 | 0.00 | 0.75 | 0.70 | 11.00 | 0.00 | 0.44 | 12.00 | 0.36 | 0.00 | 4.45 | 0.1% | 39.9% | 45 |
| 0.00 | 2.50 | 3.00 | 0.50 | 0.00 | 0.75 | 0.70 | 12.00 | 0.00 | 0.44 | 12.00 | 0.36 | 0.00 | 4.45 | 0.0% | 40.6% | 30 |
| 0.00 | 3.00 | 3.00 | 0.50 | 0.00 | 0.75 | 0.70 | 12.00 | 0.00 | 0.44 | 12.00 | 0.36 | 0.00 | 4.45 | 0.4% | 41.6% | 70 |

The Fe content identified in all of the compositions described in the above paragraphs may be the balance of the composition as indicated above, or alternatively, the balance of the composition may comprise Fe and other elements. In some embodiments, the balance may consist essentially of Fe and may include incidental impurities.

Thermodynamic Criteria

In some embodiments, the alloys can be fully described by thermodynamic criteria. Alloys which meet all the disclosed thermodynamic criteria have a high likelihood of exhibiting both the desired microstructural features and performance characteristics disclosed herein.

In some embodiments, a first thermodynamic criterion can be related to the prevention of stress cracking in the alloy. Alloys which thermodynamically form grain boundary carbides in sufficient fraction and at sufficiently high temperatures are likely to stress crack in many welding processes. Therefore the first thermodynamic criterion can be related to minimizing the total grain boundary hard phase fraction. Experimental verification has shown that the grain boundary phase fraction calculated at 1300K (or about 1300K) most closely represents the measured phase fraction of physical experimental ingots produced in the laboratory. Grain boundary hard phases can be defined in this disclosure as carbides, borides, silicides, laves phases, and other known hard phases about 750 Vickers hardness or more (or about 750 Vickers hardness are more) which form upon solidification at the same temperature (or at about the same temperature) or at a temperature below the steel matrix phase.

In some embodiments, the grain boundary phase fraction can be below 10 mole % at 1300K (or below about 10% at about 1300K). In some embodiments, the grain boundary phase fraction can be below 5 mole % at 1300K (or below about 5 mole % at about 1300K). In some embodiments, the grain boundary phase fraction is 0 mole % at 1300K (or about 0 mole % at about 1300K).

FIG. 1 depicts the thermodynamic profile of an alloy which has no eutectic hard phases upon solidification. As shown, there is no hard phase which begins precipitating out of the liquid after the formation of the matrix phase. In other words, there is no hard phase which begins to be thermodynamically stable between the liquid and solidus region [101].

Figure 2:
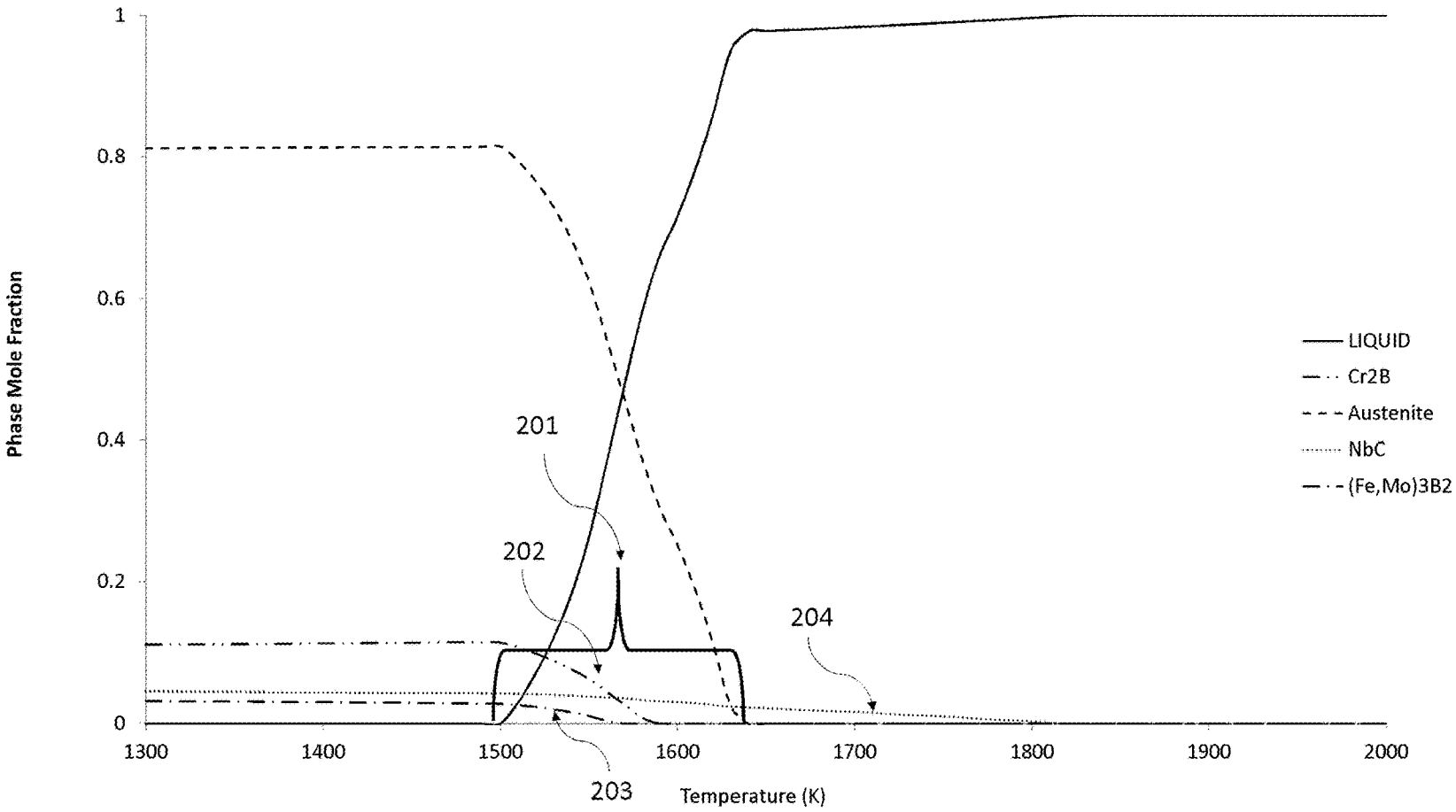
FIG. 2 shows a thermodynamic profile of an alloy which produces a eutectic phase upon solidification.

In order to demonstrate the thermodynamic profile of an alloy which produces a eutectic phase upon solidification, FIG. 2 is presented. As shown, two phases begin to precipitate with the liquidus and solidus region [201]. In this example, $Cr_2B$ [202] and $(Fe,Mo)_3B_2$ [203] are the eutectic hard phases. FIG. 2 depicts an alloy which possess over 10% grain boundary hard phases and is thus outside of the scope of this disclosure.

In some embodiments, a second thermodynamic criterion can be related to the solidification profile of the alloy upon cooling. Alloys which have a wide gap between the liquidus temperature and the solidus temperature tend to have an increased tendency to hot tear. This tendency can increase in many specialized welding applications, such as welding onto a cooled substrate. Therefore, the second thermodynamic criterion can be calculated by subtracting the highest temperature at which austenite or ferrite is thermodynamically stable minus the lowest temperature at which some non-zero fraction of liquid is thermodynamically stable. This calculation is referred to as the melt range for the purposes of this patent.

In some embodiments, the melt range can be below 90K (or below about 90K). In some embodiments, the melt range can be below 60K (or below about 60K). In some embodiments, the melt range can be 45K or below (or about 45K or below). FIG. 1 details an alloy, X3, which does not meet this criteria and has experimentally demonstrated the tendency to hot tear. As shown in FIG. 1, the melt range [101] for this alloy is defined as the temperature gap between the ferrite formation temperature and the solidus temperature of the alloy and is 95K. The alloy shown in FIG. 1 has a melt range above the specification of this disclosure. In accordance with the predictive models described herein, it does hot tear under certain welding conditions.

Figure 3:
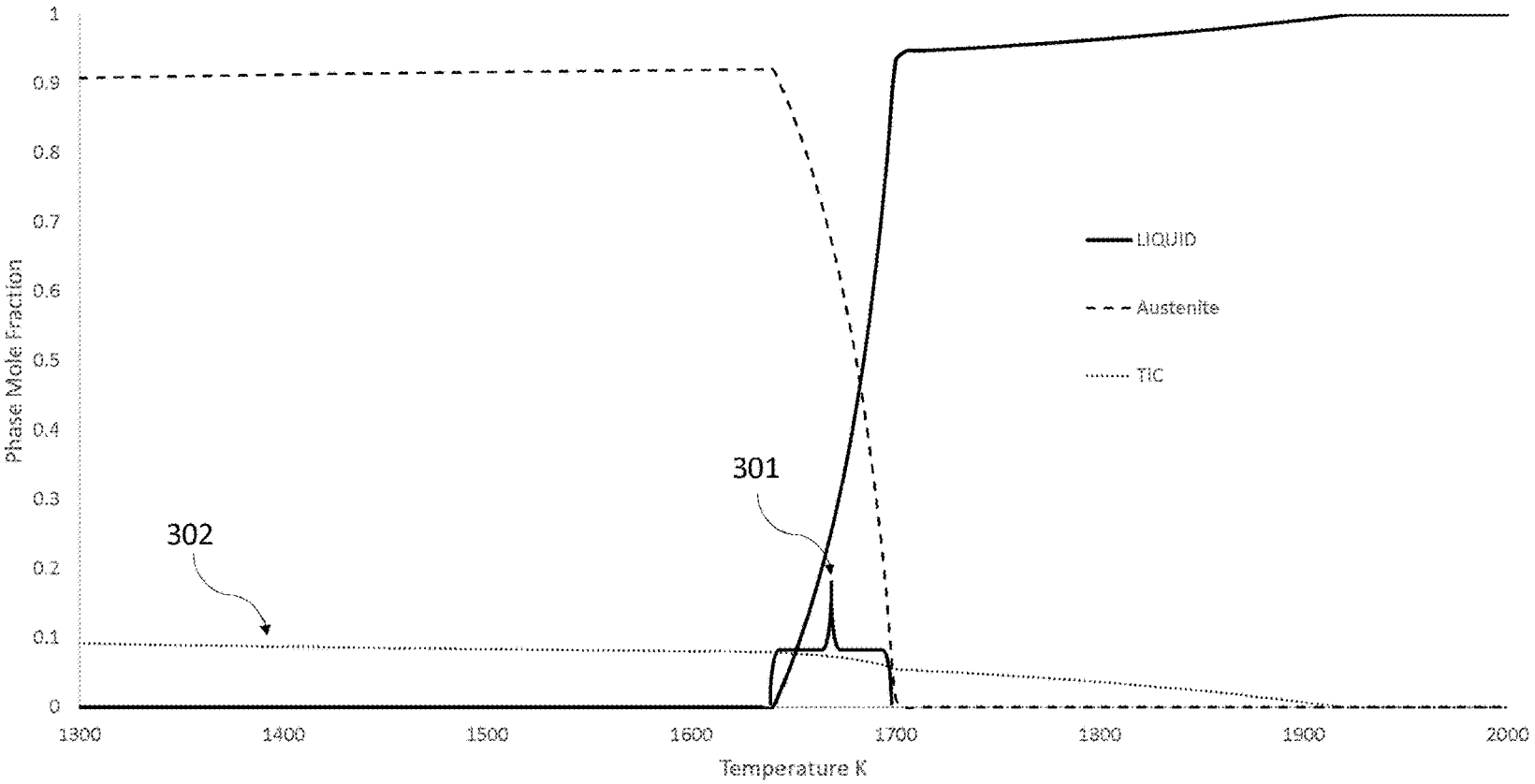
FIG. 3 discloses the thermodynamic profile of an embodiment of an alloy (X2).

On the other hand, FIG. 3 depicts the thermodynamic profile of alloy X2 listed in Table 2. This alloy does meet the preferred melt range criteria. As shown in figure, the melt range [301] is 30K. The determination of the melt range criteria was developed based on extensive experimentation with both experimental wires produced for this disclosure (X1-X3) and commercially available hardbanding alloys (C1-C2).

Table 4 shows the melt range parameter for the alloys evaluated in this study and detailed in Table 2. In hardbanding applications where welds are overlayed on top of existing worn down welds to repair the surface, it can be advantageous for the hardbanding alloy to resist hot tearing in all subsequent levels. Table 4 shows how an alloy can become more or less resistant to hot tearing as a function of dilution with the substrate. Layer 1 is fully diluted and each subsequent layer becomes less dilute until layer 4 is reached and the weld composition is effectively equal to the composition of the welding wire itself. For example, alloy C1 becomes more likely to hot tear as subsequent layers are applied, 65K melt range in layer 1 increase to 70K melt range in the fourth layer. This effect matches what is seen experimentally with weld re-application. It should be noted that 5K differences in melt range are a significant change in the behavior of the material.

TABLE 4

Melt Range in K of alloys presented in Table 2, in both single layer (fully diluted) and four layer (undiluted) states

| Alloy | Layer | Melt Range |
|---|---|---|
| X1 | 1 | 55 |
| X2 | 1 | 30 |
| X3 | 1 | 90 |

TABLE 4-continued

Melt Range in K of alloys presented in Table 2, in both single layer (fully diluted) and four layer (undiluted) states

| Alloy | Layer | Melt Range |
|---|---|---|
| C1 | 1 | 60 |
| C2 | 1 | 65 |
| X1 | 4 | 60 |
| X2 | 4 | 20 |
| C1 | 4 | 70 |
| C2 | 4 | 70 |

In some embodiments, a third thermodynamic criterion can be related to the hardness of the iron-based matrix phase and the tendency to form martensite. Alloys which have a sufficiently high carbon content in the liquid phase prior to the solidification of the austenite or ferrite matrix phase have an increased tendency to form martensite as the final weld microstructure. This value can be calculated by identifying the local minimum weight fraction of carbon in the liquid. Typically, the formation of (Nb,Ti,V) carbides or other primary carbide phases can deplete the liquid in carbon prior to the formation of the austenite, such that the local carbon minimum in the liquid can be used to effectively predict martensitic formation as opposed to the carbon content in the alloy itself In some embodiments, the carbon content in the liquid can be 0.5 wt. % or above (or about 0.5 wt. % or above). In some embodiments, the carbon content in the liquid can be 0.6 wt. % or above (or about 0.6 wt. % or above). In some embodiments, the carbon content in the liquid can be 0.7 wt. % or above (or about 0.7 wt. % or above).

In some embodiments, a fourth thermodynamic criterion can be related to the formation of isolated carbides and/or borides in the microstructure which can affect the wear resistance of the alloy. Niobium carbide, titanium carbide, and titanium boride are non-limiting examples of isolated hard particles. Experimental verification has shown that the equilibrium phase fraction of isolated hard particles at 1300K (or about 1300K) can closely match the volume fraction of isolated hard particles in a weld microstructure.

In some embodiments, the alloy can have isolated hard particle phases. These hard particle phases can have a hardness of above 1,000 Vickers (or above about 1,000 Vickers). In some embodiments, the isolated hard particle phase mole fraction can be 2% or greater (or about 2% or greater). In some embodiments, the isolated hard particle mole fraction can be 5% or greater (or about 5% or greater). In some embodiments, the isolated hard particle phase mole fraction can be 7% or greater (or about 7% or greater).

The isolated carbide mole fraction is measured as the amount of known isolated hard phases which exist at a temperature above the liquidus temperature of the austenite. Phases which are known to form isolated hard phases include niobium carbide, titanium carbide, vanadium carbide, titanium boride and combinations thereof. Phases that are known not to form isolated hard phases include chromium borides, chromium carbides, iron borides, iron carbides.

The alloys depicted in FIGS. 1, 2, and 3 all depict isolated hard phase formation TiC [102] and [302] and NbC [204].

It can be appreciated that all four thermodynamic criteria can be highly dependent upon changes in alloy composition. The difficulty of identifying alloy compositions which meet the four described thermodynamic criteria simultaneously is large enough to require the use of computational modeling in order to achieve successful design. Selection of candidates is not intuitive; for example, increasing the carbon content of an alloy will tend to increase the isolated carbide fraction and the carbon content in the liquid which favors wear resistance, but will also tend to increase the melt range and the potential to form grain boundary carbides which stimulates both crack mechanisms.

Microstructural Criteria

In some embodiments, the alloy can be described by microstructural criteria. The microstructure of the alloys described in this disclosure can possess a martensitic matrix with isolated carbide and/or boride precipitates. It can be advantageous to minimize the amount of grain boundary hard particles, as this can increase the tendency for stress cracking. Furthermore, it can be advantageous to avoid microstructural features which are indicative of the potential to hot tear. These microstructural features can be detected with back-scatter mode scanning electron microscopy and represent enrichment of the matrix in alloying elements, typically carbon or boron, along the grain boundary.

In some embodiments, the disclosed microstructural criteria can be combined with the other criteria defined in the disclosure as, in some embodiments, the microstructural features alone may not be sufficient to determine manufacturability of the alloy. For example, some embodiments of alloys using only microstructural criteria can hot tear under certain welding conditions.

In some embodiments, the matrix can contain at least 50% martensite (or at least about 50% martensite), the remainder being either austenite or ferrite. In some embodiments, the matrix can contain at least 75% martensite (or at least about 75% martensite). In some embodiments, the matrix can contain at least 90% martensite (or at least about 90% martensite).

In some embodiments, the volume fraction of grain boundary hard particles can be below 10% (or below about 10%). In some embodiments, the volume fraction of grain boundary hard phases can be below 5% (or below about 5%). In some embodiments, the volume fraction of grain boundary hard phases can be 0% (or about 0%).

Figure 4:
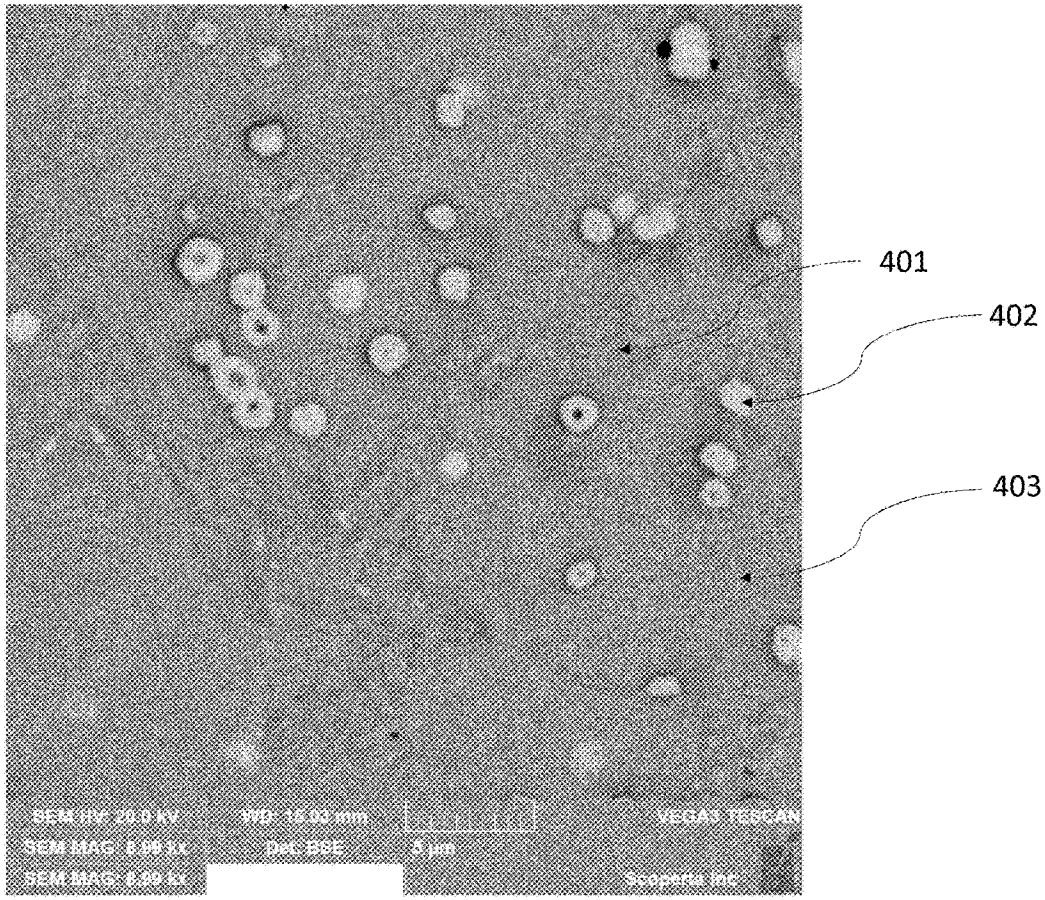
FIG. 4 shows microstructure of an alloy possessing $Cr_2B$ grain boundary borides in addition to the isolated hard phase NbC embedded in the martensitic matrix.

In order to describe grain boundary hard particles formation, the microstructure of an alloy outside of the scope of this disclosure is presented in FIG. 4. The thermodynamic behavior of this alloy was also presented in FIG. 2. As shown in FIG. 4, the alloy possess $Cr_2B$ grain boundary borides [401] in addition to the isolated hard phase NbC [402] embedded in the martensitic matrix [403]. The $Cr_2B$ borides contribute to the embrittlement of the alloy such that it stress cracks when welded under water cooled conditions.

In some embodiments, the volume fraction of primary hard particles can be above 2% (or above about 2%). In some embodiments, the volume fraction of primary hard particles can be above 5% (or above about 5%). In some embodiments, the volume fraction of primary hard particles can be above 10% (or above about 10%).

Figure 5:
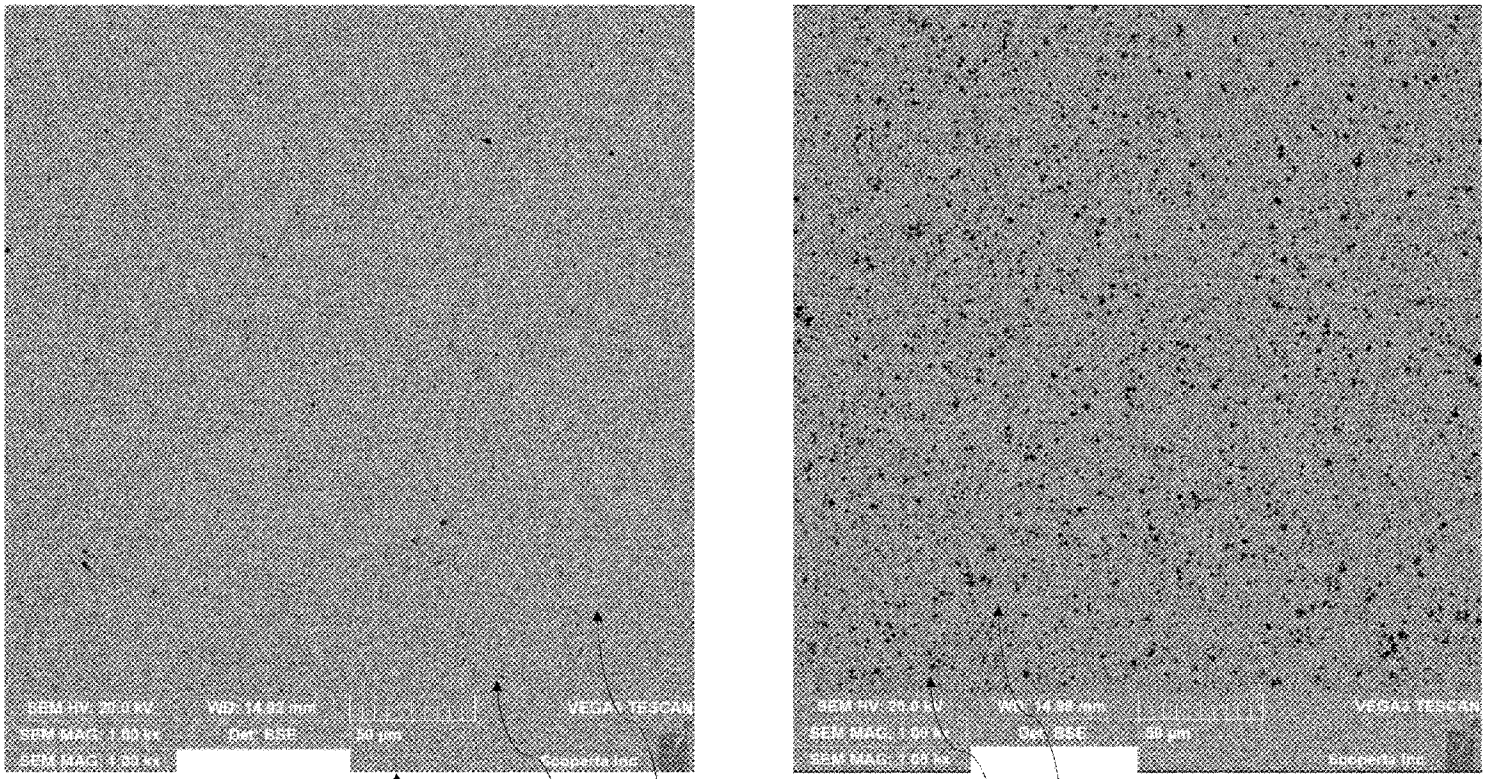
FIG. 5 shows Alloy X2 microstructure after 1 layer (left) and 4 layers (right).

FIG. 5 shows Alloy X2, which embodies the microstructural criteria of this disclosure. Furthermore, X2 embodies the microstructural criteria when it is deposited as a single layer hardfacing material, a double hardfacing layer, a triple hardfacing layer, and a four layer hardfacing layer. As each subsequent layer is welded on top of the previous layer, the alloy goes from a fully diluted state to a fully undiluted state once four layers are reached. Varying levels of dilution create differences in alloy chemistry in each layer, and thereby can alter the performance of the alloy. FIG. 5 shows Alloy X2 as a fully diluted weld [501] which contains titanium carbide particles [503] in a martensitic matrix [504]. FIG. 5 also shows Alloy X2 as a fully undiluted weld [502] which contains titanium carbide [505] particles in a martensitic matrix [506].

Performance Criteria

In some embodiments, the alloy can be described by a set of performance criteria, which make them advantageous for certain hardfacing applications. In some embodiments, the performance criteria can relate to the ability to deposit the disclosed hardfacing alloys onto water cooled substrates without cracking, either through stress cracking or hot tearing. In general, increasing the hardness and wear resistance of a material can promote the tendency for stress cracking. Certain design techniques can be used to create hardfacing materials which can better avoid stress cracking such as those disclosed in U.S. patent application Ser. No. 14/179,369, filed Feb. 12, 2014, published on Aug. 21, 2014 as U.S. App. No. 2014/0234154, hereby incorporated by reference in its entirety. However, this type of alloy can be highly susceptible to hot tearing especially in conditions where the weldment is rapidly cooled. Embodiments of the alloys described in this disclosure are thus more resistant to both stress cracking and hot tearing than those previously described. Furthermore, embodiments of the disclosed alloys can perform as exemplary hardfacing alloys in that they possess a high resistance to abrasion and a high hardness.

In some embodiments, the hardfacing weldment can have a global hardness of 45 HRC or more (or about 45 HRC or more). In some embodiments, the hardfacing weldment can have a global hardness of 50 HRC or more (or about 50 HRC or more). In some embodiments, the hardfacing weldment can have a global hardness of 55 HRC or more (or about 55 HRC or more).

In some embodiments, the hardfacing weldment can have an abrasion resistance as characterized by a ASTM G65A mass loss, hereby incorporated by reference in its entirety, of 1 gram or less (or about 1 gram or less). In some embodiments, the hardfacing weldment can have an abrasion resistance as characterized by an ASTM G65A mass loss of 0.75 grams or less (or about 0.75 grams or less). In some embodiments, the hardfacing weldment can have an abrasion resistance as characterized by an ASTM G65A mass loss of 0.5 grams or less (or about 0.5 grams or less).

Rapid cooling of a metal from a liquid or high temperature state can increase the hardness and thereby decrease the toughness of the material. Thus, as a substrate, such as a work piece, pipe, or tool joint, is held at a lower temperature the weld thereby will cool faster and realize high hardness and low toughness physical behavior. It is common in the art of hardbanding to preheat the pipe to 500° F. prior to welding, in which case the substrate will reach 700-800° F. after welding. This practice is used to prevent cracking in the weld and also reduce embrittlement in the substrate.

However, in some hardbanding practices it is advantageous to keep the substrate at a much lower temperature. In some embodiments, cooling, such as water cooling, can be used on the interior of the pipe to prevent melting the interior plastic lining. Interior plastic lining are commonly used in drill pipes to prevent corrosion on the interior diameter of the pipe.

In some embodiments, the hardfacing weldment does not exhibit any cracks when welded onto a water cooled substrate. In some embodiments, the substrate can be cooled such that the substrate surface on the opposite side of the weld or next to the weld does not exceed 500° F. (or about 500° F.). In some embodiments, the substrate can be cooled such that the substrate surface on the opposite side of the weld or next to the weld does not exceed 400° F. (or about 400° F.). In some embodiments, the substrate can be cooled such that the substrate surface on the opposite side of the weld or next to the weld does not exceed 300° F. (or about 300° F.). The substrate next to the weld can include the underlying material. For example, a first hardfacing layer can be deposited over a pipe. Thus, the pipe would be the substrate for the first hardfacing layer. A second hardfacing layer can be deposited over the first hardfacing layer. Thus, the pipe and/or the first hardfacing layer can be the substrate for the second hardfacing layer. Further, the term next to can be within 6, 5, 4, 3, 2, 1, or 0.5 inches from the weld itself.

In many hardfacing applications it can be advantageous to be able to weld the hardfacing alloys on top of previous hardfacing weldments that have been at least partially worn away. This re-application of the hardfacing alloy can allow for continuous protection of the substrate. However, this process can effectively increase the alloy chemistry of the subsequent re-applications from a fully diluted chemistry ($1^{st}$ application) to a fully undiluted chemistry ($4^{th}$ application or higher). The undiluted chemistry is often more prone to stress cracking and/or hot tearing and it is thus it can be advantageous to have an alloy which meets the previously described performance criteria in the dilute and undiluted state.

In some embodiments, the hardfacing alloy meets the hardness, abrasion resistance, and crack resistance criteria in the dilute state, undiluted state, and every intermediate state.

EXAMPLE 1

The following example is intended to be illustrative and non-limiting. This example details the performance evaluation for Alloy #2.

A 5" tool joint consisting of 4137 steel was inserted into the welding chuck and centered. A hose attached to a water supply with a right angle fitting at the end was inserted into the inside of the tool joint. This was oriented so the end pointed vertically up towards the underside of the welding area. A plug was inserted into the ID of the chuck end of the tool joint and a barrel was positioned under the other end. The welding parameters provided and key results for each weld layer are listed in Table 5.

TABLE 5

Layer 1 Specific Welding Parameters and Results

| | Layer | | | |
|---|---|---|---|---|
| | 1 | 2 | 3 | 4 |
| Shielding Gas | Argon | Argon | Argon | Argon |
| Gas Flow | 38 CPH | 38 CPH | 38 CPH | 38 CPH |
| Offset | 0.5" | 0.5" | 0.5" | 0.5" |
| Rotation | 2.2 RPM | 2.2 RPM | 2.2 RPM | 2.2 RPM |
| Oscillation Width | 1" | 1" | 1" | 1" |
| Oscillation Frequency | 56"/min | 56"/min | 56"/min | 56"/min |
| Stepover | 1" | 1" | 1" | 1" |
| Amps | 320 | 285 | 320 | 320 |
| Wire Feed | 260 | 235 | 285 | 260 |
| Stickout | ⅞" | ⅞" | ⅞" | ⅞" |
| Water Flow (gal/min) | 3.75 | 3.75 | 3.75 | 4.5 |
| Weld Thickness | 3/32" | 3/32" | 3/32" | 3.5/32" |
| Bead Width | 1⅛" | 1⅛" | 1⅛" | 1⅛" |
| Interpass Temperature | 310° F. | 320° F. | 340° F. | 280° F. |
| Hardness | | | | 50-55 |
| ASTM G65 Mass Loss | | | | 0.22 |

Before welding, the stickout was set and the tool joint was preheated to 350° F.+/−10° F. with a propane torch. Preheat temperature was measured in the center of the area to be welded immediately before welding began. The water was turned on such that the tool joint was filled with running water, and welding was started within 5 seconds. Without stopping the arc and after a full rotation plus 6 additional oscillation cycles to create a tie in, the gun was automatically stepped over the stepover distance away from the chuck. After another rotation the stepover process was repeated and a final band was welded. Once the final band had gone a full rotation plus 6 additional oscillation cycles welding was stopped. The water was then shutoff within 15 seconds. Interpass temperature was recorded immediately approximately ¼ inch away from the final tie in on the un-welded section of the tool joint. The weld was visually inspected for cracks. Thickness and width of each bead was measured.

Layer 1: No cracks were found through dye penetrant testing. The $1^{st}$ layer weld was then ground to a uniform thickness of about 1/32" thick and layer 2 was subsequently deposited over the top of this ground layer. The microstructure of the initial layer was evaluates using a scanning electron microscope and is shown in the left photograph of FIG. 5. The microstructure shows no grain boundary phase, a martensitic matrix, and a Ti carbide volume fraction in excess of 2% thereby meeting the microstructural criteria outlined in the disclosure.

Layers 2-4: After layer 2 was deposited, crack penetrant testing was run and no cracks were found. The weld was then ground to a uniform thickness of about 1/32" thick and layer 3 was subsequently deposited over the top of this ground layer. After layer 3 was deposited, crack penetrant testing was run and no cracks were found. The weld was then ground to a uniform thickness of about 1/32" thick and layer 4 was subsequently deposited over the top of this ground layer. After layer 4 was deposited, crack penetrant testing was run and no cracks were found. FIG. 5 also shows the micrograph for the $4^{th}$ layer of Alloy 2 in the right photograph. As shown, the Ti carbide volume fraction has increased to about 5%, the martensitic matrix is maintained, and no grain boundary phases have precipitated thereby meeting the microstructural criteria as well.

EXAMPLE 2

Figure 6:
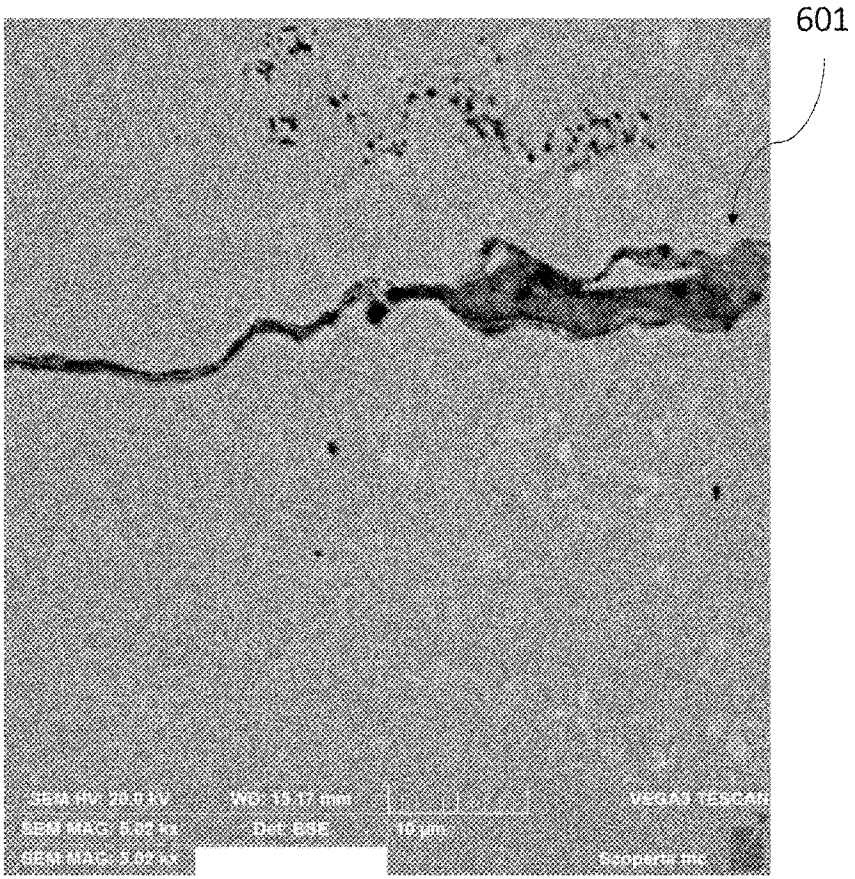
FIG. 6 illustrates a microstructural example of a hot tear.

Both alloys X3 and C1 were test welded using interior water cooling via similar parameters presented in Table 5. It was seen that both alloys showed the potential to hot tear. In most welds there was no hot tearing, however hot tearing did occur in a small fraction of welds, on the order of 10% or lower. The tendency to hot tear increased in subsequent re-application layers. An illustrative example of a hot tear [601] is shown in FIG. 6. The extensive evaluation of the X and C1 alloys in relationship to the comparison between the melt range and the hot tearing phenomenon were used to identify the melt range limit to predict alloys which do not hot tear. Furthermore, this melt range criteria was used to successfully develop the specific alloys disclosed herein.

Applications and Processes for Use:

Embodiments of the alloys described in this patent can be used in a variety of applications and industries. Some non-limiting examples of applications of use include:

Surface Mining applications include the following components and coatings for the following components: Wear resistant sleeves and/or wear resistant hardfacing for slurry pipelines, mud pump components including pump housing or impeller or hardfacing for mud pump components, ore feed chute components including chute blocks or hardfacing of chute blocks, separation screens including but not limited to rotary breaker screens, banana screens, and shaker screens, liners for autogenous grinding mills and semi-autogenous grinding mills, ground engaging tools and hardfacing for ground engaging tools, drill bits and drill bit inserts, wear plate for buckets and dumptruck liners, heel blocks and hardfacing for heel blocks on mining shovels, grader blades and hardfacing for grader blades, stacker reclaimers, sizer crushers, general wear packages for mining components and other comminution components.

Upstream oil and gas applications include the following components and coatings for the following components: Downhole casing and downhole casing, drill pipe and coatings for drill pipe including hardbanding, mud management components, mud motors, fracking pump sleeves, fracking impellers, fracking blender pumps, stop collars, drill bits and drill bit components, directional drilling equipment and coatings for directional drilling equipment including stabilizers and centralizers, blow out preventers and coatings for blow out preventers and blow out preventer components including the shear rams, oil country tubular goods and coatings for oil country tubular goods.

Downstream oil and gas applications include the following components and coatings for the following components: Process vessels and coating for process vessels including steam generation equipment, amine vessels, distillation towers, cyclones, catalytic crackers, general refinery piping, corrosion under insulation protection, sulfur recovery units, convection hoods, sour stripper lines, scrubbers, hydrocarbon drums, and other refinery equipment and vessels.

Pulp and paper applications include the following components and coatings for the following components: Rolls used in paper machines including yankee dryers and other dryers, calendar rolls, machine rolls, press rolls, digesters, pulp mixers, pulpers, pumps, boilers, shredders, tissue machines, roll and bale handling machines, doctor blades, evaporators, pulp mills, head boxes, wire parts, press parts, M.G. cylinders, pope reels, winders, vacuum pumps, deflakers, and other pulp and paper equipment, Power generation applications include the following components and coatings for the following components: boiler tubes, precipitators, fireboxes, turbines, generators, cooling towers, condensers, chutes and troughs, augers, bag houses, ducts, ID fans, coal piping, and other power generation components.

Agriculture applications include the following components and coatings for the following components: chutes, base cutter blades, troughs, primary fan blades, secondary fan blades, augers and other agricultural applications.

Construction applications include the following components and coatings for the following components: cement chutes, cement piping, bag houses, mixing equipment and other construction applications Machine element applications include the following components and coatings for the following components: Shaft journals, paper rolls, gear boxes, drive rollers, impellers, general reclamation and dimensional restoration applications and other machine element applications Steel applications include the following components and coatings for the following components: cold rolling mills, hot rolling mills, wire rod mills, galvanizing lines, continue pickling lines, continuous casting rolls and other steel mill rolls, and other steel applications.

The alloys described in this patent can be produced and or deposited in a variety of techniques effectively. Some non-limiting examples of processes include:

Thermal spray process including those using a wire feedstock such as twin wire arc, spray, high velocity arc spray, combustion spray and those using a powder feedstock such as high velocity oxygen fuel, high velocity air spray, plasma spray, detonation gun spray, and cold spray. Wire feedstock can be in the form of a metal core wire, solid wire, or flux core wire. Powder feedstock can be either a single homogenous alloy or a combination of multiple alloy powder which result in the desired chemistry when melted together.

Welding processes including those using a wire feedstock including but not limited to metal inert gas (MIG) welding, tungsten inert gas (TIG) welding, arc welding, submerged arc welding, open arc welding, bulk welding, laser cladding, and those using a powder feedstock including but not limited to laser cladding and plasma transferred arc welding. Wire feedstock can be in the form of a metal core wire, solid wire, or flux core wire. Powder feedstock can be either a single homogenous alloy or a combination of multiple alloy powder which result in the desired chemistry when melted together.

Casting processes including processes typical to producing cast iron including but not limited to sand casting, permanent mold casting, chill casting, investment casting, lost foam casting, die casting, centrifugal casting, glass casting, slip casting and process typical to producing wrought steel products including continuous casting processes.

Post processing techniques including but not limited to rolling, forging, surface treatments such as carburizing, nitriding, carbonitriding, heat treatments including but not limited to austenitizing, normalizing, annealing, stress relieving, tempering, aging, quenching, cryogenic treatments, flame hardening, induction hardening, differential hardening, case hardening, decarburization, machining, grinding, cold working, work hardening, and welding.

From the foregoing description, it will be appreciated that an inventive product and approaches for hardfacing alloys are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as any subcombination or variation of any subcombination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A hardfacing layer comprising:

a microstructure which contains below 5 volume % grain boundary carbides precipitating from a liquid phase, and contains at least 5 volume % Ti and/or Nb carbides precipitating from the liquid phase;

wherein the hardfacing layer comprises a macro-hardness of at least 50 HRC;

wherein the hardfacing layer comprises a melt range of 60K or below;

wherein the hardfacing layer in liquid phase prior to solidification comprises a carbon content of 0.5 weight percent or above; and wherein the hardfacing layer and/or a feedstock welding material used to form the hardfacing layer comprises the following composition, in weight %:

Fe: BAL, C: 0.80% to 1.40%, Cr: 6.26% to 9.00%, Mn: 1.10% to 2.00%, Si: 0.76% to 2.00%, B: 0.00%; and Ti: 2.00% to 4.00%; and Nb+Ti: 2.5% to 3.5%.

2. The hardfacing layer of claim 1, wherein the hardfacing layer and/or the feedstock welding material further comprises, in weight percent, Nb+Ti+V: 2.5% to 3.5%.

3. The hardfacing layer of claim 1, wherein the hardfacing layer comprises:

high abrasion resistance as defined by an ASTM G65A mass loss of less than 1 gram;

at least 50% martensite;

below 5 mole % grain boundary carbides precipitating from the liquid phase; and at least 5 mole % Ti and/or Nb carbides precipitating from the liquid phase.

4. A work piece having at least a portion of its surface covered by a substrate layer comprising:

a microstructure which contains below 5 volume % grain boundary carbides precipitating from a liquid phase, and contains at least 5 volume % Ti and/or Nb carbides precipitating from the liquid phase;

wherein the substrate layer comprises a macro-hardness of at least 50 HRC;

wherein the substrate layer comprises a melt range of 60K or below;

wherein the substrate layer in liquid phase prior to solidification comprises a carbon content of 0.5 weight percent or above; and wherein the substrate layer and/or a feedstock welding material used to form the substrate layer comprises the following composition, in weight %: Fe: BAL, C: 0.80% to 1.40%, Cr: 6.26% to 9.00%, Mn: 1.10% to 2.00%, Si: 0.76% to 2.00%, B: 0.00%, and Ti: 2.00% to 4.00%.

5. The work piece of claim 4, wherein the substrate layer and/or a feedstock welding material used to form the substrate layer further comprises, in weight percent:

Nb+Ti: 2.5% to 3.5%.

6. The work piece of claim 4, wherein the substrate layer and/or a feedstock welding material used to form the substrate layer further comprises, in weight percent, Nb+Ti+V: 2.5% to 3.5%.

7. The work piece of claim 4, wherein the substrate layer and/or a feedstock welding material used to form the substrate layer comprises a mixture of one or more of the following compositions, in weight %:

Fe: BAL, C: about 1.2%, Cr: about 7.8%, Mn: about 1.4%, Mo: about 1.2%, Si: about 1%, and Ti: about 3.4%;

Fe: BAL, C: about 1.15%, Cr: about 7.8%, Mn: about 1.4%, Mo: about 1.2%, Si: about 1%, and Ti: about 3.4%;

Fe: BAL, C: about 1.1%, Cr: about 7.8%, Mn: about 1.4%, Mo: about 1.2%, Si: about 1%, and Ti: about 3.4%;

Fe: BAL, C: about 1%, Cr: about 7.8%, Mn: about 1.4%, Mo: about 1.2%, Si: about 1%, and Ti: about 3.4%;

Fe: BAL, C: about 0.9%, Cr: about 7.8%, Mn: about 1.4%, Mo: about 1.2%, Si: about 1%, Ti: about 3.4%; and Fe: BAL, C: about 0.85%, Cr: about 7.2%, Mn: about 1.3%, Mo: about 1%, Si: about 0.8%, Ti: about 3%.

8. The work piece of claim 4, wherein the substrate layer comprises:

high abrasion resistance as defined by an ASTM G65A mass loss of less than 1 gram;

at least 50% martensite;

below 5 mole % grain boundary carbides precipitating from the liquid phase; and at least 5 mole % Ti and/or Nb carbides precipitating from the liquid phase.

9. The work piece of claim 4, further comprising a top layer formed over the substrate layer, the top layer having approximately the same chemistry as the substrate layer and comprising:

a microstructure which contains below 10 volume % grain boundary carbides precipitating from the liquid phase, and contains at least 2% isolated primary carbides precipitating from the liquid phase; and a macrohardness of at least 45HRC;

wherein the top layer is configured to be deposited onto the work piece over the substrate layer, wherein the work piece and substrate layer remain at 500° F. or below during deposition without forming cracks in the top layer or the substrate layer.

10. The work piece of claim 4, further comprising a middle and top layer formed over the substrate layer, the middle and top layer having approximately the same chemistry as the substrate layer, wherein:

the top layer comprises a microstructure which contains below 10 volume % grain boundary carbides precipitating from the liquid phase, and contains at least 2 volume % isolated primary carbides precipitating from the liquid phase;

the top layer comprises a macrohardness of at least 45HRC; and the top layer is configured to be deposited onto the work piece over the middle layer, wherein the work piece, substrate layer, and middle layer remain at 500° F. or below during deposition without forming cracks in the top layer, middle layer, or substrate layer.

11. A method of forming a coated work piece comprising:

depositing a first layer on at least a portion of a work piece from a metal core wire welding feedstock;

wherein the first layer comprises a microstructure which contains below 10 volume % grain boundary carbides precipitating from a liquid phase, and contains at least 2 volume % isolated primary carbides precipitating from the liquid phase;

wherein the first layer is configured to be deposited onto the work piece which is chilled during the welding process without forming cracks;

wherein the first layer comprises a macrohardness of at least 45HRC;

wherein the first layer has a melt range of 60K or below;

wherein the first layer in liquid phase prior to solidification comprises a carbon content of 0.5 weight percent or above; and wherein the first layer and/or the metal core wire welding feedstock comprises the following composition, in weight %: Fe: BAL, C: 0.80% to 1.40%, Cr: 6.26% to 9.00%, Mn: 1.10% to 2.00%, Si: 0.76% to 2.00%, B: 0.00%, and Ti: 2.00% to 4.00%.

12. The method of claim 11, wherein the first layer and/or the metal core wire welding feedstock further comprises, in weight percent:

Nb+Ti: 2.5% to 3.5%.

13. The method of claim 11, wherein the first layer and/or the metal core wire welding feedstock comprises a mixture of one or more of the following compositions, in weight %:

Fe: BAL, C: about 1.2%, Cr: about 7.8%, Mn: about 1.4%, Mo: about 1.2%, Si: about 1%, and Ti: about 3.4%;

Fe: BAL, C: about 1.15%, Cr: about 7.8%, Mn: about 1.4%, Mo: about 1.2%, Si: about 1%, and Ti: about 3.4%;

Fe: BAL, C: about 1.1%, Cr: about 7.8%, Mn: about 1.4%, Mo: about 1.2%, Si: about 1%, and Ti: about 3.4%;

Fe: BAL, C: about 1%, Cr: about 7.8%, Mn: about 1.4%, Mo: about 1.2%, Si: about 1%, and Ti: about 3.4%;

Fe: BAL, C: about 0.9%, Cr: about 7.8%, Mn: about 1.4%, Mo: about 1.2%, Si: about 1%, Ti: about 3.4%; and Fe: BAL, C: about 0.85%, Cr: about 7.2%, Mn: about 1.3%, Mo: about 1%, Si: about 0.8%, Ti: about 3%.

14. The method of claim 11, further comprising depositing a second layer over the first layer, the first and second layers having approximately the same chemistry, wherein:

the second layer comprises a microstructure which contains below 10 volume % grain boundary carbides precipitating from the liquid phase, and contains at least 2 volume % isolated primary carbides precipitating from the liquid phase;

the second layer configured to be deposited onto the work piece over the first layer, wherein the work piece and first layer temperature remain at 500° F. or below during deposition without forming cracks in the second layer or the first layer; and wherein the second layer comprises a macrohardness of at least 45HRC.

15. The method of claim 11, further comprising depositing a second layer over the first layer and a third layer of the second layer, the first, second, and third layers having approximately the same chemistry, wherein:

the third layer comprises a microstructure which contains below 10 volume % grain boundary carbides precipitating from the liquid phase, and contains at least 2 volume % isolated primary carbides precipitating from the liquid phase;

the third layer configured to be deposited onto the work piece over the second layer, wherein the work piece, first layer, and second layer temperatures remain at 500° F. or below during deposition without forming cracks in the first, second, or third layer; and wherein the second layer comprises a macrohardness of at least 45HRC.

16. The method of claim 11, wherein the work piece layer comprises:

high abrasion resistance as defined by an ASTM G65A mass loss of less than 1 gram;

at least 50% martensite;

below 5 mole % grain boundary carbides precipitating from the liquid phase; and at least 5 mole % Ti and/or Nb carbides precipitating from the liquid phase.

17. The method of claim 11, wherein the metal core wire welding feedstock further comprises, in weight percent, Nb+Ti+V: 2.5% to 3.5%.

18. The method of claim 11, wherein the microstructure comprises at least 2% mole fraction Nb and/or Ti carbides precipitating from the liquid phase which are thermodynamically stable at temperatures at least 10K above the solidification temperature of a Fe-based matrix in the microstructure.

19. The method of claim 11, wherein the microstructure comprises less than 5% mole fraction carbides precipitating from the liquid phase which are only thermodynamically stable below a liquid temperature of an iron matrix phase of the microstructure.

20. The hardfacing layer of claim 1, wherein the hardfacing layer and/or a metal core wire feedstock welding material used to form the hardfacing layer comprises a mixture of one or more of the following compositions, in weight %:

Fe: BAL, C: about 1.2%, Cr: about 7.8%, Mn: about 1.4%, Mo: about 1.2%, Si: about 1%, and Ti: about 3.4%;

Fe: BAL, C: about 1.15%, Cr: about 7.8%, Mn: about 1.4%, Mo: about 1.2%, Si: about 1%, and Ti: about 3.4%;

Fe: BAL, C: about 1.1%, Cr: about 7.8%, Mn: about 1.4%, Mo: about 1.2%, Si: about 1%, and Ti: about 3.4%;

Fe: BAL, C: about 1%, Cr: about 7.8%, Mn: about 1.4%, Mo: about 1.2%, Si: about 1%, and Ti: about 3.4%;

Fe: BAL, C: about 0.9%, Cr: about 7.8%, Mn: about 1.4%, Mo: about 1.2%, Si: about 1%, Ti: about 3.4%; and Fe: BAL, C: about 0.85%, Cr: about 7.2%, Mn: about 1.3%, Mo: about 1%, Si: about 0.8%, Ti: about 3%.

21. The hardfacing layer of claim 1, wherein the feedstock welding material used to form the hardfacing layer is a powder.

22. The work piece of claim 4, wherein the feedstock welding material used to form the substrate layer is a powder.

23. The hardfacing layer of claim 1, wherein the feedstock welding material used to form the hardfacing layer is a metal core wire welding feedstock.

* * * * *